US010888825B2

(12) United States Patent
Jeong et al.

(10) Patent No.: US 10,888,825 B2
(45) Date of Patent: Jan. 12, 2021

(54) REFRIGERATOR

(71) Applicant: Samsung Electronics Co., Ltd., Suwon-si (KR)

(72) Inventors: Jin Jeong, Yongin-si (KR); Do Yun Jang, Suwon-si (KR); Bong Su Son, Cheonan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 117 days.

(21) Appl. No.: 15/976,334

(22) Filed: May 10, 2018

(65) Prior Publication Data

US 2018/0272293 A1 Sep. 27, 2018

Related U.S. Application Data

(62) Division of application No. 14/832,635, filed on Aug. 21, 2015, now Pat. No. 9,999,863.

(30) Foreign Application Priority Data

Aug. 22, 2014 (KR) ..... 10-2014-0109611
Dec. 23, 2014 (KR) ..... 10-2014-0187457

(51) Int. Cl.
*B01F 3/04* (2006.01)
*F25D 23/12* (2006.01)
*F25C 5/20* (2018.01)

(52) U.S. Cl.
CPC ..... *B01F 3/04808* (2013.01); *B01F 3/04815* (2013.01); *F25C 5/22* (2018.01);
(Continued)

(58) Field of Classification Search
CPC .... B01F 3/04808; B01F 3/04815; F25C 5/22; F25C 2400/08; F25C 2600/04
(Continued)

(56) References Cited

U.S. PATENT DOCUMENTS 2,575,509 A * 11/1951 Bayston ..... A23G 9/20 426/67
4,058,383 A 11/1977 Peterson, III
(Continued)

FOREIGN PATENT DOCUMENTS

CN 101512261 8/2009
CN 103423936 12/2013
(Continued)

OTHER PUBLICATIONS

Restriction Requirement issued in related U.S. Appl. No. 14/832,635 dated Mar. 29, 2017.
(Continued)

*Primary Examiner* — Thien S Tran
(74) *Attorney, Agent, or Firm* — Staas & Halsey LLP

(57) ABSTRACT

Provided is a refrigerator including: a main body; a storage compartment formed in the main body; a door that opens/closes the storage compartment; a general water tank in which general water supplied from an external water supply source is stored; a mixing tank in which general water supplied from the general water tank is mixed with carbon dioxide ($CO_2$) so that carbonated water is made and stored; a dispenser that provides general water supplied from the general water tank to an outside and provides carbonated water supplied from the mixing tank to the outside of the refrigerator; and an ice-making machine that makes general ice by receiving general water from the external water supply source or the general water tank and makes carbonated ice by receiving carbonated water from the mixing tank, thereby providing general water, carbonated water, general ice, and carbonated ice through the dispenser.

24 Claims, 44 Drawing Sheets

(52) U.S. Cl.
CPC ..... *F25D 23/126* (2013.01); *F25C 2400/08* (2013.01); *F25C 2600/04* (2013.01)

(58) Field of Classification Search
USPC ..... 62/66, 74, 85; 99/300
See application file for complete search history.

(56) References Cited

U.S. PATENT DOCUMENTS

| | | | | |
|---|---|---|---|---|
| 4,912,942 | A | 4/1990 | Katterhenry | |
| 6,513,337 | B1 | 2/2003 | Astvatsatrian et al. | |
| 6,672,097 | B1 | 1/2004 | Ashley | |
| 2010/0192613 | A1 | 8/2010 | Kim | |
| 2013/0133524 | A1* | 5/2013 | Vastardis | A47J 31/4403 99/300 |
| 2013/0174596 | A1 | 7/2013 | Kim | |
| 2013/0309361 | A1* | 11/2013 | Kyong | F25D 23/126 426/67 |
| 2016/0059192 | A1 | 3/2016 | Jeong et al. | |

FOREIGN PATENT DOCUMENTS

| | | | |
|---|---|---|---|
| GB | 1095004 | | 12/1967 |
| GB | 2287306 | | 9/1995 |
| JP | HO1114681 | A | 5/1989 |
| JP | H03059372 | A | 3/1991 |
| JP | 2000304389 | A | 11/2000 |
| KR | 10-2014-0040395 | | 3/2014 |
| WO | 03/098136 | A1 | 11/2003 |

OTHER PUBLICATIONS

Office Action issued in related U.S. Appl. No. 14/832,635 dated Aug. 1, 2017.

Notice of Allowance issued in related U.S. Appl. No. 14/832,635 dated Jan. 17, 2018.

Corrected Notice of Allowance issued in related U.S. Appl. No. 14/832,635 dated Jan. 26, 2018.

Corrected Notice of Allowance issued in related U.S. Appl. No. 14/832,635 dated Feb. 9, 2018.

U.S. Appl. No. 14/832,635, filed Aug. 21, 2015, Jin Jeong, Samsung Electronics Co., Ltd.

Chinese Office Action dated Aug. 20, 2019 in Chinese Patent Application No. 201580056544.2.

Chinese Office Action dated Jan. 30, 2019 in Chinese Patent Application No. 201580056544.2.

International Search Report dated Dec. 2, 2015 corresponding to International Application No. PCT/KR2015/008696.

Communication dated Mar. 23, 2018 with Supplementary European Search Report and European Search Opinion corresponding to European Application No. EP15833562.

Chinese Office Action dated Feb. 7, 2020 in Chinese Patent Application No. 201580056544.2.

European Communication dated Jul. 2, 2020 in European Patent Application No. 15833562.0.

* cited by examiner

REFRIGERATOR

RELATED APPLICATIONS

This application is a divisional of U.S. application Ser. No. 14/832,635, filed Aug. 21, 2015, which claims the benefit of Korean Patent Application Nos. 2014-0109611 and 2014-0187457, filed on Aug. 22, 2014 and Dec. 23, 2014, respectively, in the Korean Intellectual Property Office, the disclosure of each of which is hereby incorporated herein by reference in its entirety.

BACKGROUND

Embodiments of the present disclosure relate to a refrigerator that is capable of making carbonated ice.

In general, a refrigerator is a home appliance that keeps food fresh by including a storage compartment for storing food and a cold air supplying device for supplying cold air to the storage compartment. An ice bucket for making ice and a dispenser that dispenses water or ice from the outside without opening a door are also provided in the refrigerator according to a user's need.

Furthermore, a carbonated water-making device for making carbonated water is also provided in the refrigerator. The carbonated water-making device includes a carbon dioxide ($CO_2$) gas cylinder in which a high-pressure $CO_2$ gas is stored, and a mixing tank in which $CO_2$ gas and general water are mixed with each other so that carbonated water can be made.

Carbonated water made in the mixing tank is connected to an external water intake space through the dispenser and can be taken from the outside without opening the door.

Meanwhile, an ice-making machine for making ice using internal cold air is also provided in the refrigerator. An automatic ice-making machine according to the related art makes general ice by using general water supplied from an external water supply source or a general water tank and cooling the general water.

SUMMARY

Therefore, it is an aspect of the present disclosure to provide a refrigerator that is capable of making carbonated water and carbonated ice, and dispensing the carbonated water and carbonated ice through a dispenser.

It is another aspect of the present disclosure to provide a refrigerator that minimizes problem related to unstable ice separation and caught ice when carbonated ice is made, and improves so that reliability of the supply of carbonated ice and high-concentration carbonated ice can be made.

Additional aspects of the disclosure will be set forth in part in the description which follows and, in part, will be apparent from the description, or may be readily appreciated by practice of the various embodiments of the invention.

In accordance with one aspect of the present disclosure, a refrigerator includes: a main body; a storage compartment formed in the main body; a door that opens/closes the storage compartment; a general water tank in which general water supplied from an external water supply source is stored; a mixing tank in which general water supplied from the general water tank is mixed with carbon dioxide ($CO_2$) so that carbonated water is able to be made and stored; a dispenser that provides general water supplied from the general water tank to an outside and provides carbonated water supplied from the mixing tank to the outside of the refrigerator; and an ice-making machine that makes general ice by receiving general water from the external water supply source or the general water tank and makes carbonated ice by receiving carbonated water from the mixing tank.

The refrigerator may further include an ice-making general water flow path which connects the external water supply source and the ice-making machine so that general water is able to be supplied to the ice-making machine.

The refrigerator may further include a dispensing general water flow path that connects the external water supply source and the dispenser so that general water is able to be supplied to the dispenser.

The refrigerator may further include a carbonated water-making general water flow path that connects the external water supply source and the mixing tank so that general water is able to be supplied to the mixing tank.

The refrigerator may further include an ice-making carbonated water flow path that connects the mixing tank and the ice-making machine so that carbonated water is able to be supplied to the ice-making machine.

The refrigerator may further include a dispensing carbonated water flow path that connects the mixing tank and the dispenser so that carbonated water is able to be supplied to the dispenser.

The ice-making general water flow path may not pass through the mixing tank.

The dispensing general water flow path may not pass through the mixing tank.

The ice-making general water flow path may pass through the general water tank or not.

The dispensing general water flow path may pass through the general water tank.

The carbonated water-making general water flow path may pass through the general water tank.

The dispenser and the mixing tank may be disposed on the door, and the general water tank and the ice-making machine may be disposed in the main body.

One end of a door hose that extends from the door and one end of a main body hose that extends from the main body may be coupled to each other at an outside of the main body using a fitting member.

The refrigerator may further include a hinge member that supports the door rotatably and a cover member that is coupled to an upper side of the hinge member to cover the hinge member, wherein the fitting member may be disposed in the cover member.

The refrigerator may further include: an ice bucket in which general ice or carbonated ice made by the ice-making machine is stored; an auger that transports general ice or carbonated ice stored in the ice bucket; and a chute that connects the ice bucket and the dispenser, wherein the dispenser may provide general ice or carbonated ice made by the ice-making machine to the outside of the refrigerator.

In accordance with another aspect of the present disclosure, a refrigerator including a mixing tank in which carbon dioxide ($CO_2$) and general water are mixed with each other so that carbonated water is able to be made, a dispenser, and an ice-making machine, the refrigerator further includes: an ice-making general water flow path that connects an external water supply source and the ice-making machine so that general water is able to be supplied to the ice-making machine; a dispensing general water flow path that connects the external water supply source and the dispenser so that general water is able to be supplied to the dispenser; a carbonated water-making general water flow path that connects the external water supply source and the mixing tank so that general water is able to be supplied to the mixing tank; an ice-making carbonated water flow path that connects the mixing tank and the ice-making machine so that carbonated water is able to be supplied to the ice-making machine; and a dispensing carbonated water flow path that connects the mixing tank and the dispenser so that carbonated water is able to be supplied to the dispenser.

The ice-making general water flow path and the ice-making carbonated water flow path may join at one join point and may form a common flow path.

A flow sensor may be disposed in each of the ice-making general water flow path and the ice-making carbonated water flow path so that a predetermined amount of general water or carbonated water is able to be supplied to the ice-making machine.

A flow sensor may be disposed on a common path of the ice-making general water flow path and the ice-making carbonated water flow path so that a predetermined amount of general water or carbonated water is able to be supplied to the ice-making machine.

The ice-making general water flow path may be diverged from the dispensing general water flow path and the carbonated water-making general water flow path at a first divergence point, and a first three-way valve may be disposed at the first divergence point and may open/close the ice-making general water flow path, the dispensing general water flow path, and the carbonated water-making general water flow path.

The dispensing general water flow path and the carbonated water-making general water flow path may be diverged at a second divergence point, and a second three-way valve may be disposed at the second divergence point and may open/close the dispensing general water flow path and the carbonated water-making general water flow path.

The ice-making carbonated water flow path and the dispensing carbonated water flow path may be diverged at a third divergence point, and a third three-way valve may be disposed at the third divergence point and may open/close the ice-making carbonated water flow path and the dispensing carbonated water flow path.

The ice-making general water flow path, the dispensing general water flow path, and the carbonated water-making general water flow path may be diverged at a first divergence point, and a four-way valve may be disposed at the first divergence point and may open/close the ice-making general water flow path, the dispensing general water flow path, and the carbonated water-making general water flow path.

The ice-making carbonated water flow path and the dispensing carbonated water flow path may be diverged at a second divergence point, and a three-way valve may be disposed at the second divergence point and may open/close the ice-making carbonated water flow path and the dispensing carbonated water flow path.

A first two-way valve may be disposed on a common flow path of the ice-making general water flow path, the dispensing general water flow path and the carbonated water-making general water flow path and may open/close the ice-making general water flow path, the dispensing general water flow path, and the carbonated water-making general water flow path.

The ice-making general water flow path and the carbonated water-making general water flow path may be diverged at a first divergence point, and a three-way valve may be disposed at the first divergence point and may open/close the ice-making general water flow path and the carbonated water-making general water flow path.

The dispensing general water flow path and the dispensing carbonated water flow path may join at one join point and may form a common flow path, and a second two-way valve may be disposed on the common flow path and may open/close the common flow path.

A third two-way valve may be disposed on the ice-making carbonated water flow path and may open/close the ice-making carbonated water flow path.

A fourth two-way valve may be disposed on the dispensing carbonated water flow path and may open/close the dispensing carbonated water flow path.

In accordance with still another aspect of the present disclosure, a refrigerator includes: an ice-making compartment; an ice-making tray disposed in the ice-making compartment; a cooling device that supplies cooling energy to the ice-making tray; and a mixing tank in which general water and carbon dioxide ($CO_2$) are mixed so that carbonated water is able to be made, wherein the refrigerator may have a general ice-making mode in which general ice is made by supplying general water to the ice-making tray, and a carbonated ice-making mode in which carbonated ice is made by supplying carbonated water to the ice-making tray, and each of the general ice-making mode and the carbonated ice-making mode may include a water-supplying operation of supplying water to the ice-making tray, an ice-making operation of making ice by cooling the ice-making tray, and an ice-separating operation of separating ice in the ice-making tray from the ice-making tray, and in the water-supplying operation of the general ice-making mode, a first water-supply amount of general water may be supplied to the ice-making tray, and in the water-supplying operation of the carbonated ice-making mode, a second water-supply amount of carbonated water that is smaller than the first water-supply amount may be supplied to the ice-making tray.

The amount of water-supply per unit time in the water-supplying operation of the general ice-making mode and the amount of water-supply per unit time the water-supplying operation of the carbonated ice-making mode may be controlled to be different from each other.

A time for performing the water-supplying operation of the general ice-making mode and a time for performing the water-supplying operation of the carbonated ice-making mode may be controlled to be different from each other.

In accordance with yet still another aspect of the present disclosure, a refrigerator includes: an ice-making compartment; an ice-making tray disposed in the ice-making compartment; a cooling device that supplies cooling energy to the ice-making tray; and a mixing tank in which general water and carbon dioxide ($CO_2$) are mixed so that carbonated water is able to be made, wherein the refrigerator may have a general ice-making mode in which general ice is made by supplying general water to the ice-making tray, and a carbonated ice-making mode in which carbonated ice is made by supplying carbonated water to the ice-making tray, and each of the general ice-making mode and the carbonated ice-making mode may include an ice-making compartment cooling operation of cooling the ice-making compartment, a water-supplying operation of supplying water to the ice-making tray, an ice-making operation of making ice by cooling the ice-making tray, and an ice-separating operation of separating ice in the ice-making tray from the ice-making tray, and at an initial stage of the ice-making operation of the general ice-making mode, the ice-making compartment may have a first ice-making compartment temperature, and at an initial stage of the ice-making operation of the carbonated ice-making mode, the ice-making compartment may have a second ice-making compartment temperature that is lower than the first ice-making compartment temperature.

The ice-making compartment cooling operation of the general ice-making mode may have a first performance time, and the ice-making compartment cooling operation of the carbonated ice-making mode may have a second performance time that is longer than the first performance time.

In accordance with yet still another aspect of the present disclosure, a refrigerator includes: an ice-making compartment; an ice-making tray disposed in the ice-making compartment; a cooling device that supplies cooling energy to the ice-making tray; and a mixing tank in which general water and carbon dioxide ($CO_2$) are mixed so that carbonated water is able to be made, wherein the refrigerator may have a general ice-making mode in which general ice is made by supplying general water to the ice-making tray, and a carbonated ice-making mode in which carbonated ice is made by supplying carbonated water to the ice-making tray, and each of the general ice-making mode and the carbonated ice-making mode may include a water-supplying operation of supplying water to the ice-making tray, an ice-making operation of making ice by cooling the ice-making tray, and an ice-separating operation of separating ice in the ice-making tray from the ice-making tray, and the ice-making operation of the general ice-making mode may have a first ice-making speed, and the ice-making operation of the carbonated ice-making mode may have a second ice-making speed that is faster than the first ice-making speed.

The cooling device may include a compressor that constitutes a freezing cycle device, and rotation speed of the compressor in the ice-making operation of the general ice-making mode and rotation speed of the compressor in the ice-making operation of the carbonated ice-making mode may be controlled to be different from each other.

The cooling device may include a blower fan that allows air to flow in the ice-making compartment, and rotation speed of the blower fan in the ice-making operation of the general ice-making mode and rotation speed of the blower fan in the ice-making operation of the carbonated ice-making mode may be controlled to be different from each other.

In accordance with yet still another aspect of the present disclosure, a refrigerator includes: a mixing tank in which general water and carbon dioxide ($CO_2$) are mixed so that carbonated water is able to be made; a dispenser that provides carbonated water made in the mixing tank to an outside; and an ice-making machine that makes carbonated ice by receiving carbonated water from the mixing tank, wherein the refrigerator may have a carbonated water mode in which carbonated water is supplied to the dispenser, and a carbonated ice mode in which carbonated water is provided to the ice-making machine, and in a carbon dioxide ($CO_2$) injecting operation of the carbonated water mode, a first injection amount of $CO_2$ may be injected into the mixing tank, and in a $CO_2$ injecting operation of the carbonated ice mode, a second injection amount of $CO_2$ that is larger than the first injection amount may be injected into the mixing tank.

The number of times of injecting $CO_2$ in the $CO_2$ injecting operation of the carbonated water mode and the number of times of injecting $CO_2$ in the $CO_2$ injecting operation of the carbonated ice mode may be controlled to be different from each other.

An interval for injecting $CO_2$ in the $CO_2$ injecting operation of the carbonated water mode and an interval for injecting $CO_2$ in the $CO_2$ injecting operation of the carbonated ice mode may be controlled to be different from each other.

BRIEF DESCRIPTION OF THE DRAWINGS

These and/or other aspects of the various embodiments of the invention will become apparent and more readily appreciated from the following description of the embodiments, taken in conjunction with the accompanying drawings of which.

DETAILED DESCRIPTION

Hereinafter, exemplary embodiments of the present disclosure will be described in detail.

Figure 1:
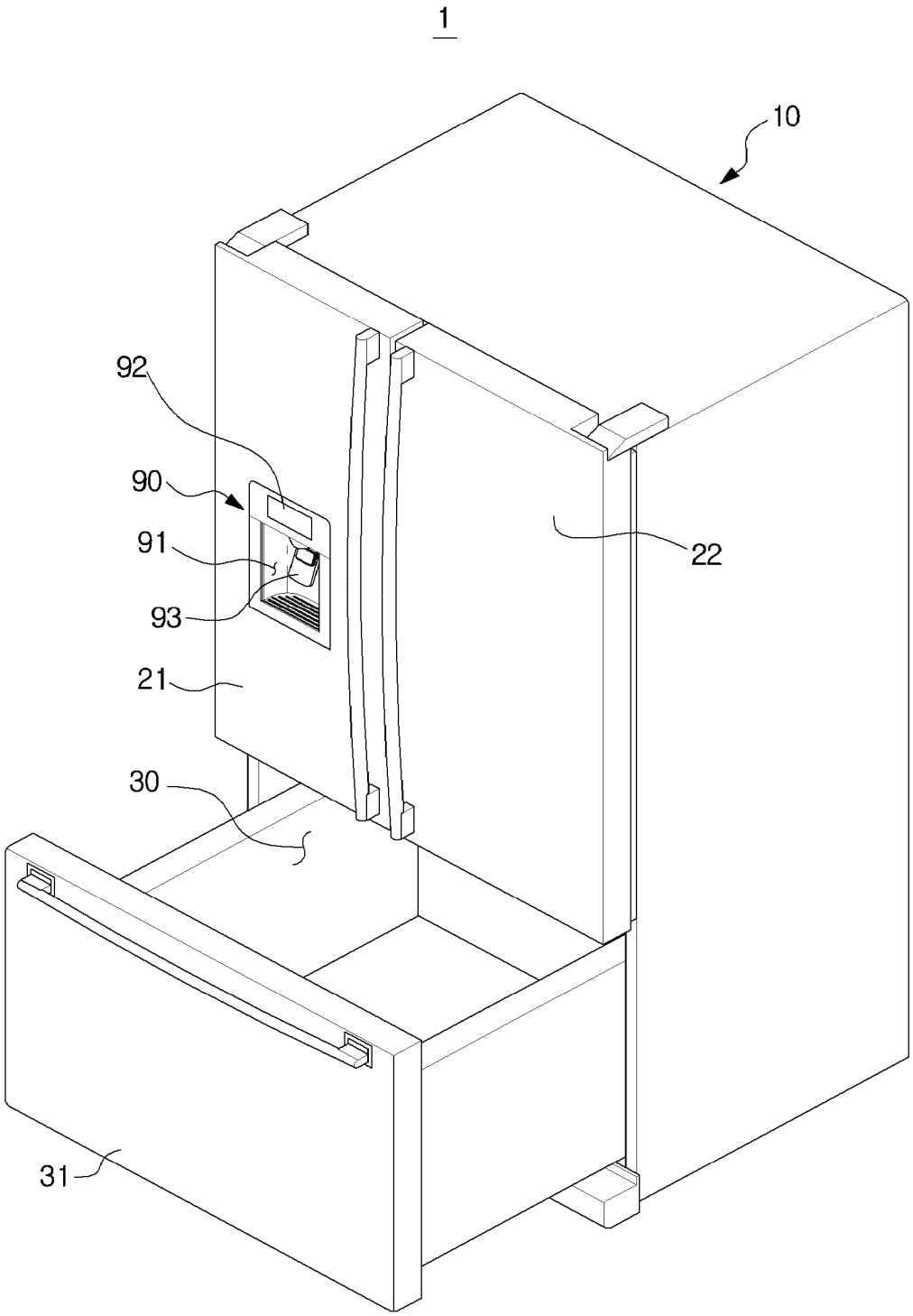
FIG. 1 is a perspective view of an exterior of a refrigerator according to a first embodiment of the present disclosure.
Figure 2:
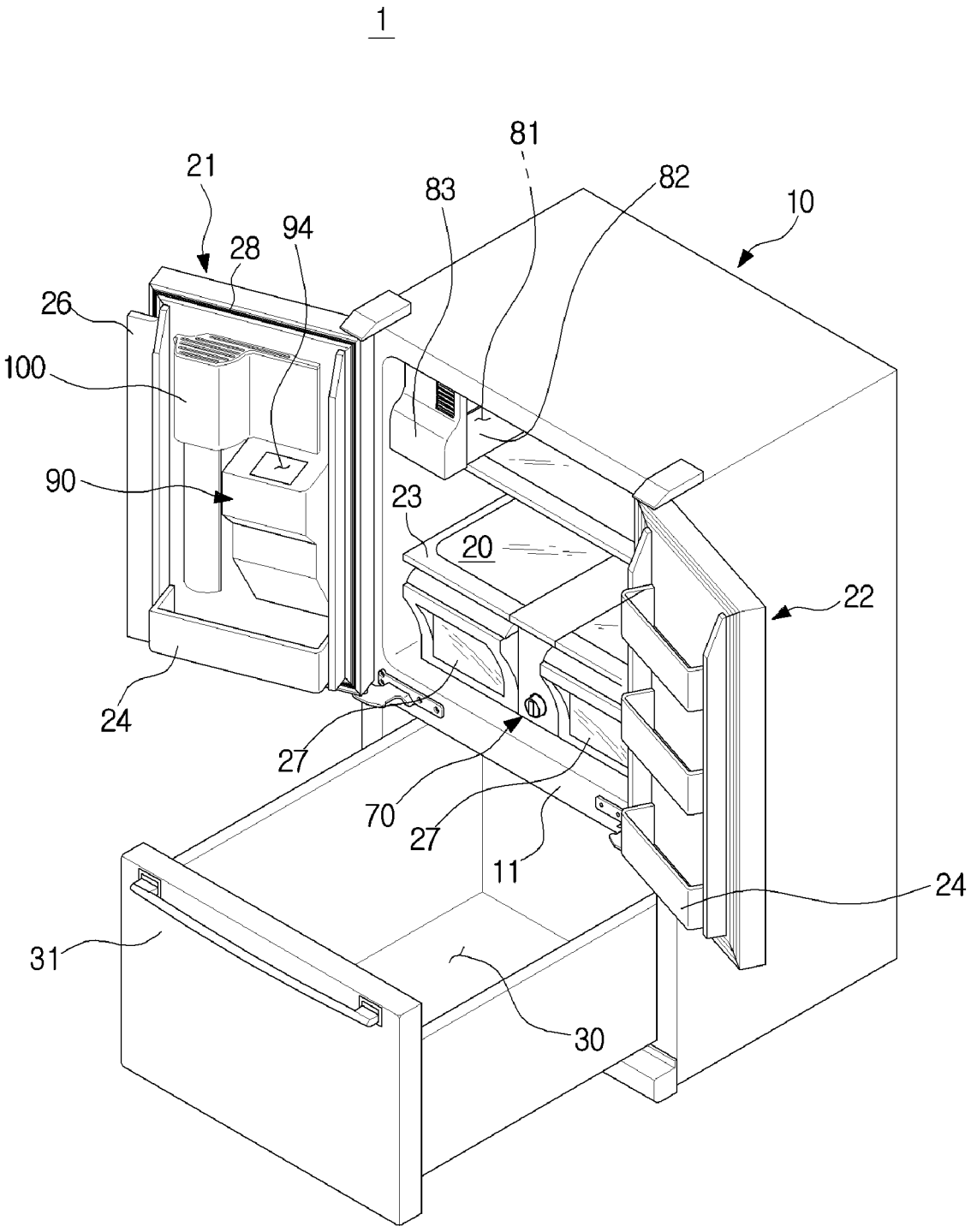
FIG. 2 is a perspective view of an interior of the refrigerator illustrated in FIG. 1.
Figure 3:
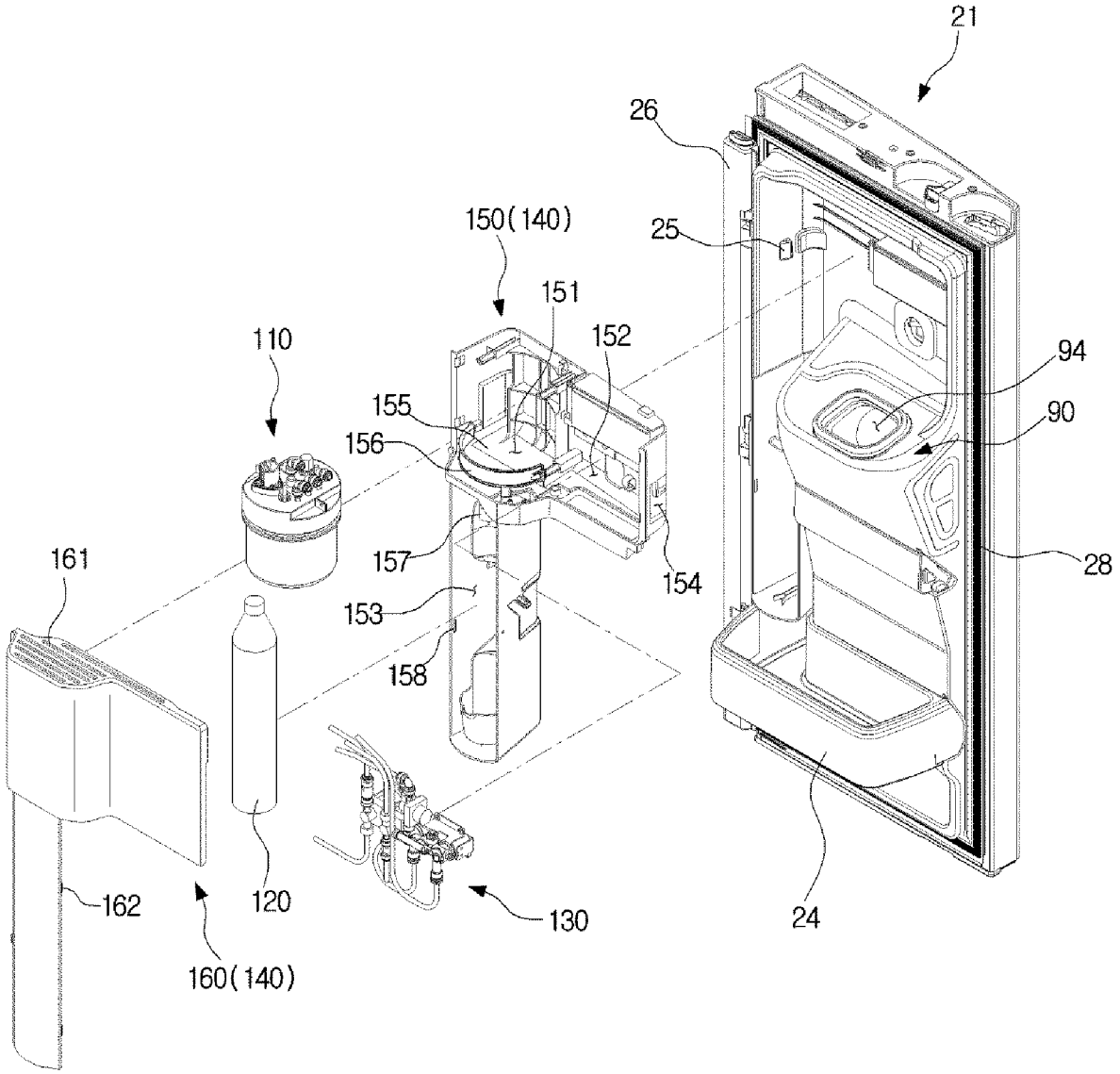
FIG. 3 is an exploded perspective view of a mixing tank mounted on a door of the refrigerator of FIG. 1.
Figure 4:
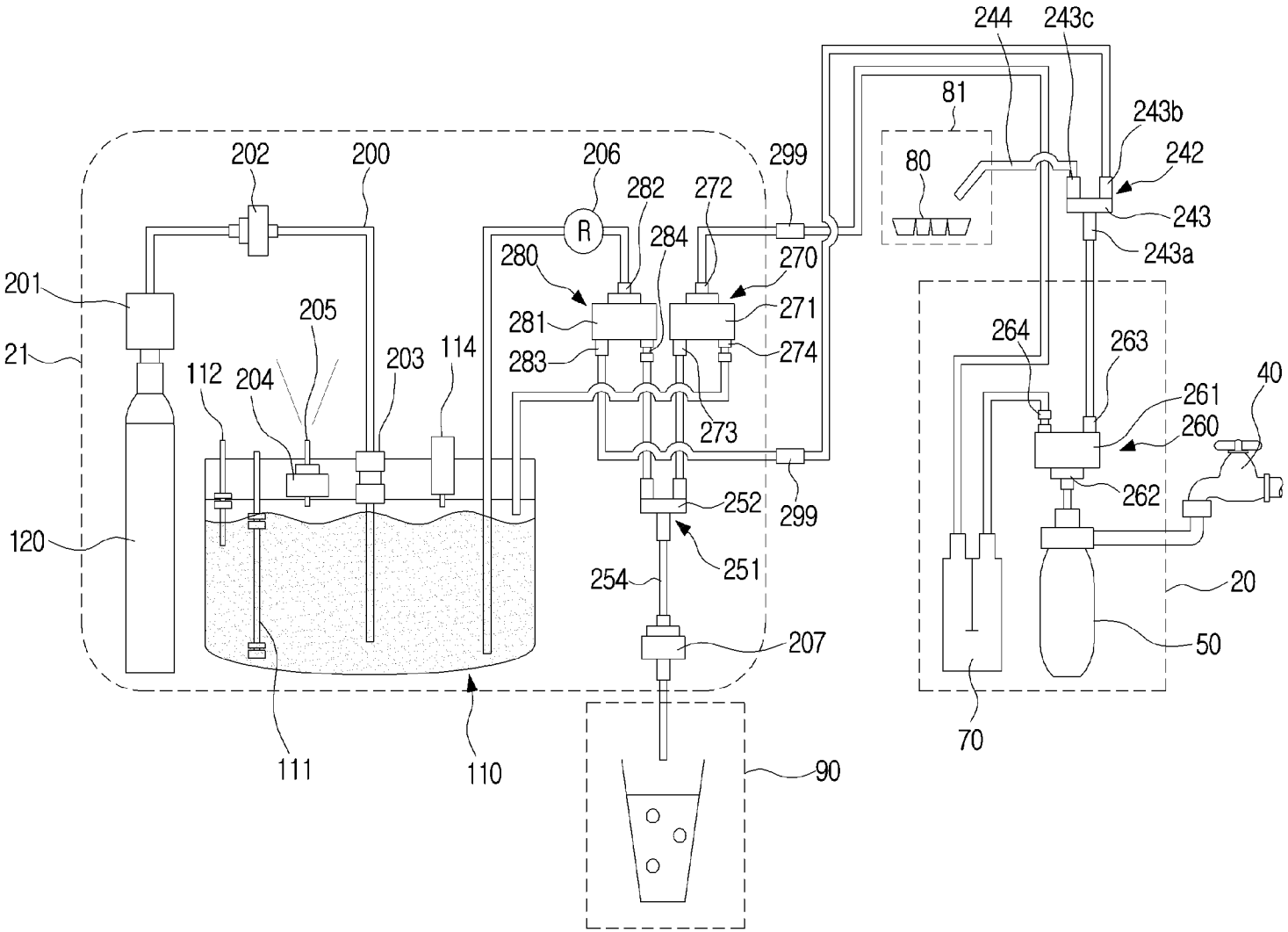
FIG. 4 is a conceptual view of a main configuration of the refrigerator of FIG. 1.

FIG. 1 is a perspective view of an exterior of a refrigerator 1 according to a first embodiment of the present disclosure. FIG. 2 is a perspective view of an interior of the refrigerator illustrated in FIG. 1. FIG. 3 is an exploded perspective view of a mixing tank 110 mounted on a door of the refrigerator 1 of FIG. 1. FIG. 4 is a conceptual view of a main configuration of the refrigerator 1 of FIG. 1.

Referring to FIGS. 1 through 4, a refrigerator 1 includes a main body 10, storage compartments 20 and 30 formed in the main body 10, and a cooling device (not shown) that supplies cold air into the storage compartments 20 and 30.

The main body 10 may include an inner case that forms the storage compartments 20 and 30, an outer case that is coupled to an outside of the inner case and forms an exterior of the refrigerator 1, and an insulating material (not shown) that is disposed between the inner case and the outer case and insulates the storage compartments 20 and 30.

The storage compartments 20 and 30 may be partitioned off into an upper refrigerator compartment 20 and a lower freezer compartment 30 by an intermediate partition wall 11. The refrigerator compartment 20 may be maintained at a temperature of about 3° C. so that food can be kept under refrigeration, and the freezer compartment 30 may be maintained at a temperature of about −18.5° C. so that food can be kept in a freezer. A shelf 23 on which food can be put, and at least one accommodation box 27 in which food can be kept in a sealed state, may be provided at the refrigerator compartment 20.

In addition, an ice-making compartment 81 in which ice can be made, may be formed in a corner of an upper portion of the refrigerator compartment 20 to be partitioned off from the refrigerator compartment 20 by an ice-making compartment wall 82. An ice-making machine 80 that makes general ice or carbonated ice, an ice bucket 83 in which general ice or carbonated ice made by the ice-making machine 80 is stored, and an auger (see 84 of FIG. 10) that transfers general ice or carbonated ice stored in the ice bucket 83 to a chute 94 may be provided in the ice-making compartment 81.

Here, general ice refers to ice formed by cooling general water that does not include carbonic acid, and carbonated ice refers to ice formed by cooling carbonated water including carbonic acid. Hereinafter, when general water and carbonated water do not necessarily need to be distinguished from each other, both general water and carbonated water may be referred to as water, simply, and when general ice and carbonated ice do not necessarily need to be distinguished from each other, both general ice and carbonated ice may be referred to as ice, simply.

A general water tank 70 in which general water may be stored, may be provided in the refrigerator compartment 20. The general water tank 70 may be disposed between a plurality of accommodation boxes 27, as illustrated in FIG. 2. However, the present disclosure is not limited thereto, and the general water tank 70 may be provided in the refrigerator compartment 20 so that general water in the general water tank 70 may be cooled due to cold air in the refrigerator compartment 20.

The general water tank 70 may be connected to an external water supply source 40, such as a water pipe, and may store general water purified by a water-purifying filter 50. A first three-way valve 261 may be disposed in a water supply hose that connects the external water supply source 40 and the general water tank 70.

The refrigerator compartment 20 and the freezer compartment 30 may have an open front side through which food may be put into/taken out of the refrigerator compartment 20 and the freezer compartment 30. The open front side of the refrigerator compartment 20 may be open/closed by a pair of rotating doors 21 and 22 hinge-coupled to the main body 10, and the open front side of the freezer compartment 30 may be open/closed by a sliding door 31 that may slide with respect to the main body 10. A door guard 24 in which food may be stored, may be provided at rear sides of the refrigerator compartment doors 21 and 22.

Meanwhile, a gasket 28, which regulates cold air in the refrigerator compartment 20 by sealing a space between the refrigerator compartment doors 21 and 22 and the main body 10 when the refrigerator compartment doors 21 and 22 are closed, may be provided at an edge of each of the rear sides of the refrigerator compartment doors 21 and 22. In addition, a rotation bar 26, which regulates cold air in the refrigerator compartment 20 by sealing a space between the refrigerator compartment door 21 and the refrigerator compartment door 22 when the refrigerator compartment doors 21 and 22 are closed, may be provided at one refrigerator compartment door 21 of the refrigerator compartment doors 21 and 22.

A dispenser 90 that may take water or ice from the outside without opening the refrigerator compartment door 21, may be provided at one refrigerator compartment door 21 of the refrigerator compartment doors 21 and 22.

The dispenser 90 may include a water intake space 91 in which water or ice may be taken by inserting a container, such as a cup, a control panel 92 on which an input button for manipulating various settings of the dispenser 90 and a display for displaying various pieces of information of the dispenser 90 are disposed, and an operation lever 93 that may operate the dispenser 90 so that water or ice may be discharged.

The dispenser 90 may include the chute 94 that connects the ice-making machine 80 and the water intake space 91 so that ice made by the ice-making machine 80 may be discharged into the water intake space 91.

A carbonated water-making module 100 that makes carbonated water may be mounted on a rear side of the refrigerator compartment door 21 on which the dispenser 90 is provided.

The carbonated water-making module 100 is provided to make carbonated water in the refrigerator 1. The carbonated water-making module 100 may include a carbon dioxide ($CO_2$) gas cylinder 120 in which a high-pressure $CO_2$ gas is stored, a mixing tank 110 in which general water and $CO_2$ gas are mixed with each other so that carbonated water may be made, a module case 140 having accommodation spaces 151, 152, and 153 in which the $CO_2$ gas cylinder 120 and the mixing tank 110 are accommodated, formed in the module case 140, and the module case 140 being coupled to the rear side of the refrigerator compartment door 21, and a valve assembly 130.

A high-pressure $CO_2$ gas of about 45 to 60 bar may be stored in the $CO_2$ gas cylinder 120. The $CO_2$ gas cylinder 120 may be mounted on a cylinder connector 157 of the module case 140 and may be accommodated in a lower accommodation space 153 of the module case 140.

The $CO_2$ gas in the $CO_2$ gas cylinder 120 may be supplied to the mixing tank 110 through a $CO_2$ gas supply flow path 200 that connects the $CO_2$ gas cylinder 120 and the mixing tank 110.

A $CO_2$ gas regulator 201 that regulates pressure of the $CO_2$ gas, a $CO_2$ gas supply valve 202 that opens/closes the $CO_2$ gas supply flow path 200, and a $CO_2$ gas backflow prevention valve 203 that prevents backflow of the $CO_2$ gas may be provided on the $CO_2$ gas supply flow path 200.

The $CO_2$ gas regulator 201 may adjust pressure of the $CO_2$ gas discharged from the $CO_2$ gas cylinder 120 and may supply the $CO_2$ gas to the mixing tank 110. The $CO_2$ gas regulator 201 may reduce pressure of the $CO_2$ gas to be equal to or less than about 10 bar.

In the mixing tank 110, the $CO_2$ gas supplied from the $CO_2$ gas cylinder 120 and general water supplied from the general water tank 70 are mixed to make carbonated water, and the carbonated water may be stored in the mixing tank 110.

An exhaust flow path 205 on which the $CO_2$ gas that remains in the mixing tank 110 is discharged so that general water may be smoothly supplied to the mixing tank 110, may be provided in the mixing tank 110. An exhaust valve 204 that opens/closes the exhaust flow path 205 may be provided on the exhaust flow path 205.

A water level sensor 111 that may measure the amount of general water supplied to the mixing tank 110 or the amount of carbonated water made in the mixing tank 110, and a temperature sensor 112 that may measure the temperature of general water supplied to the mixing tank 110 or the temperature of carbonated water made in the mixing tank 110 may be provided in the mixing tank 110.

A safety valve 114 that may discharge high-pressure $CO_2$ gas when the high-pressure $CO_2$ gas that exceeds a predetermined pressure is supplied to the mixing tank 110 due to malfunction of the $CO_2$ gas regulator 201, may be provided in the mixing tank 110.

The mixing tank 110 may be formed to have a predetermined size and to accommodate general water or carbonated water of about 1 L. The mixing tank 110 may be formed of a stainless material having pressure-resistant and corrosion-resistant characteristics.

The mixing tank 110 may be accommodated in a first upper accommodation space 151 of the module case 140. The mixing tank 110 may be supported by a bottom support portion 155 and a guide portion 156 of the module case 140.

The valve assembly 130 may include a second three-way valve 271 and a third three-way valve 281 that will be described later. The valve assembly 130 may be accommodated in a second upper accommodation space 152 of the module case 140.

The module case 140 may include a back case 150, one side of which is open, and a cover 160 coupled to the open side of the back case 150.

At least one insertion groove 154 may be formed in the module case 140 in a position corresponding to at least one insertion protrusion 25 formed on the rear side of the door 21. Thus, the at least one insertion protrusion 25 is inserted into the at least one insertion groove 154 so that the module case 140 may be easily mounted on the rear side of the door 21. However, this coupling structure is just an example, and the module case 140 may be separably mounted on the rear side of the door 21 using various coupling structures including a screw-coupling structure or a hook-coupling structure in addition to this insertion structure.

An insertion groove 158 and an insertion protrusion 162 are formed in positions corresponding to the back case 150 and the cover 160, respectively, so that the cover 160 may be coupled to the back case 150. However, this coupling structure is also just an example, and the back case 150 and the cover 160 may also be separably coupled to each other using various coupling structures.

In a state in which the cover 160 is coupled to the back case 150, the $CO_2$ gas cylinder 120, the mixing tank 110, and a valve assembly 130, which are disposed in the module case 140, may not be exposed to the outside of the refrigerator 1. Thus, an esthetic appealing effect of the door 21 may not be lowered.

A ventilation port 161 through which an inside and an outside of the module case 140 are in communication with each other, is formed in the cover 160 so that, even when the cover 160 is coupled to the back case 150, cold air in the storage compartment may be supplied to the mixing tank 110 in the module case 140 and carbonated water stored in the mixing tank 110 may be cooled at an appropriate temperature.

From another viewpoint, the carbonated water-making module 100 of the refrigerator 1 according to an embodiment of the present disclosure may include a first module having the first accommodation space 151 in which the mixing tank 110 is accommodated, and the second accommodation space 153 in which the $CO_2$ gas cylinder 120 is accommodated.

In this case, the second module may be disposed at a lower side of the first module. Also, the second module may be disposed in a lateral direction of the chute 94 that guides ice in the ice bucket 83 into the water intake space 91.

Figure 5:
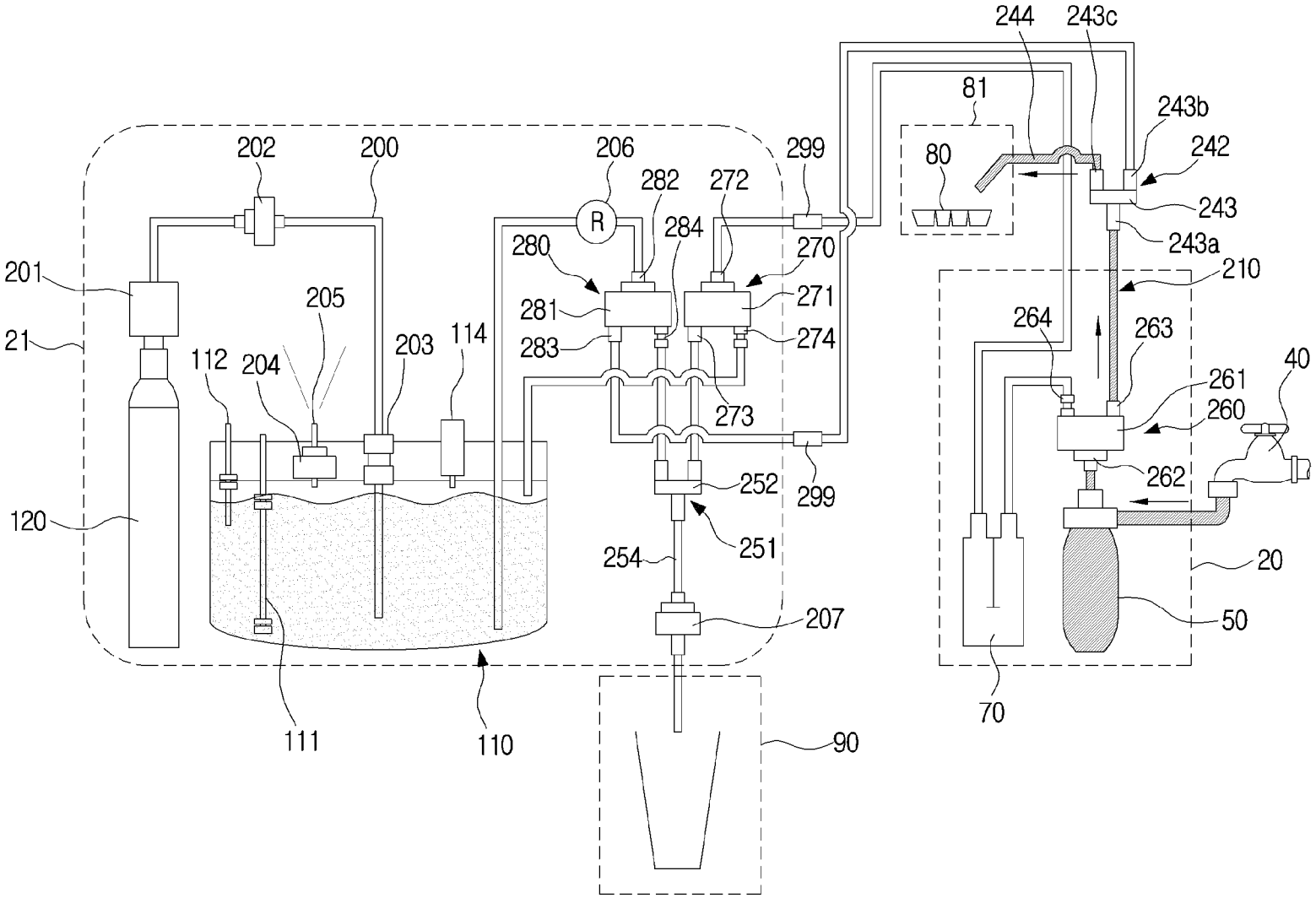
FIG. 5 is a conceptual view of an ice-making general water flow path of the refrigerator of FIG. 1.
Figure 6:
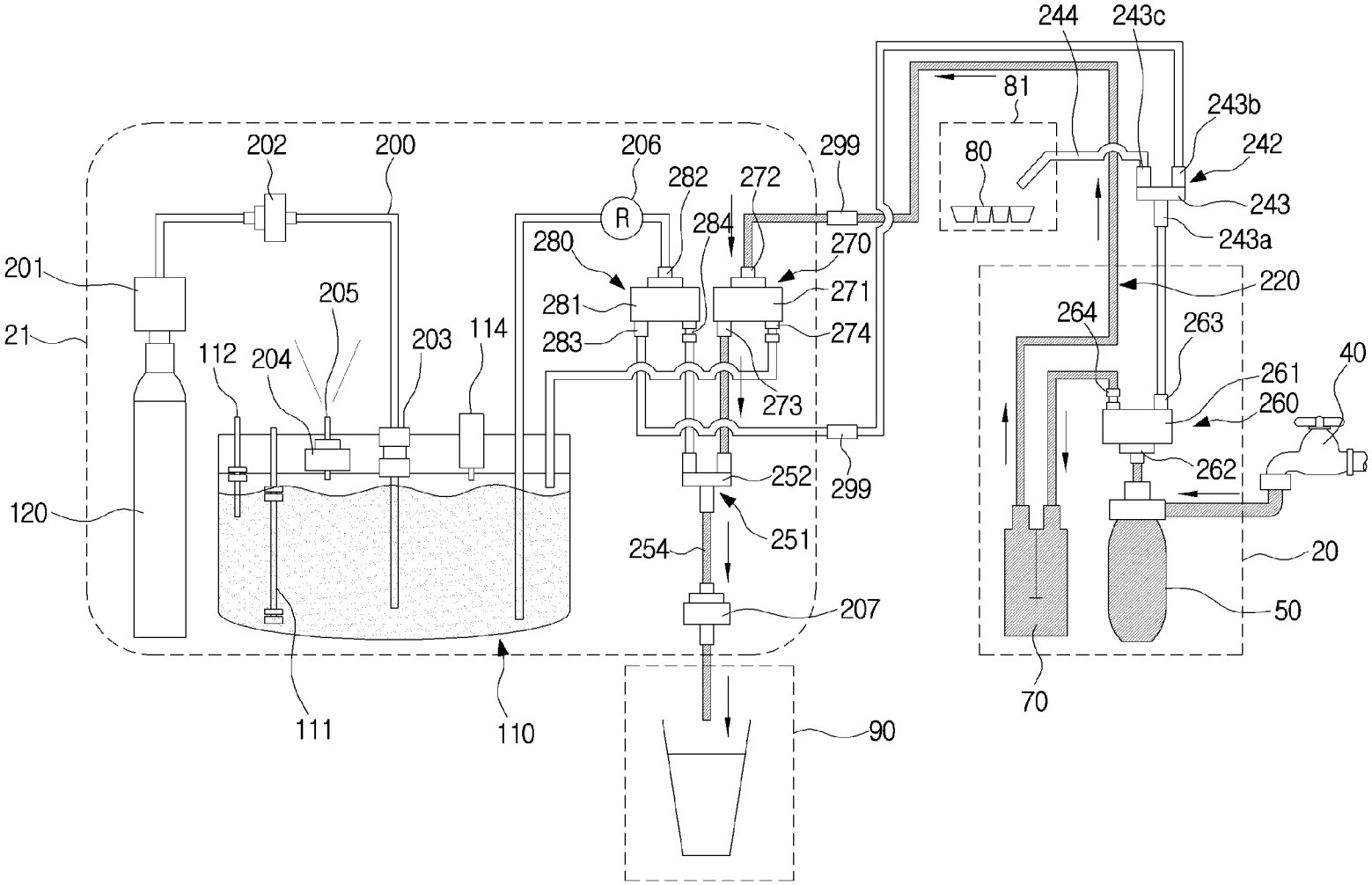
FIG. 6 is a conceptual view of a dispensing general water flow path of the refrigerator of FIG. 1.
Figure 7:
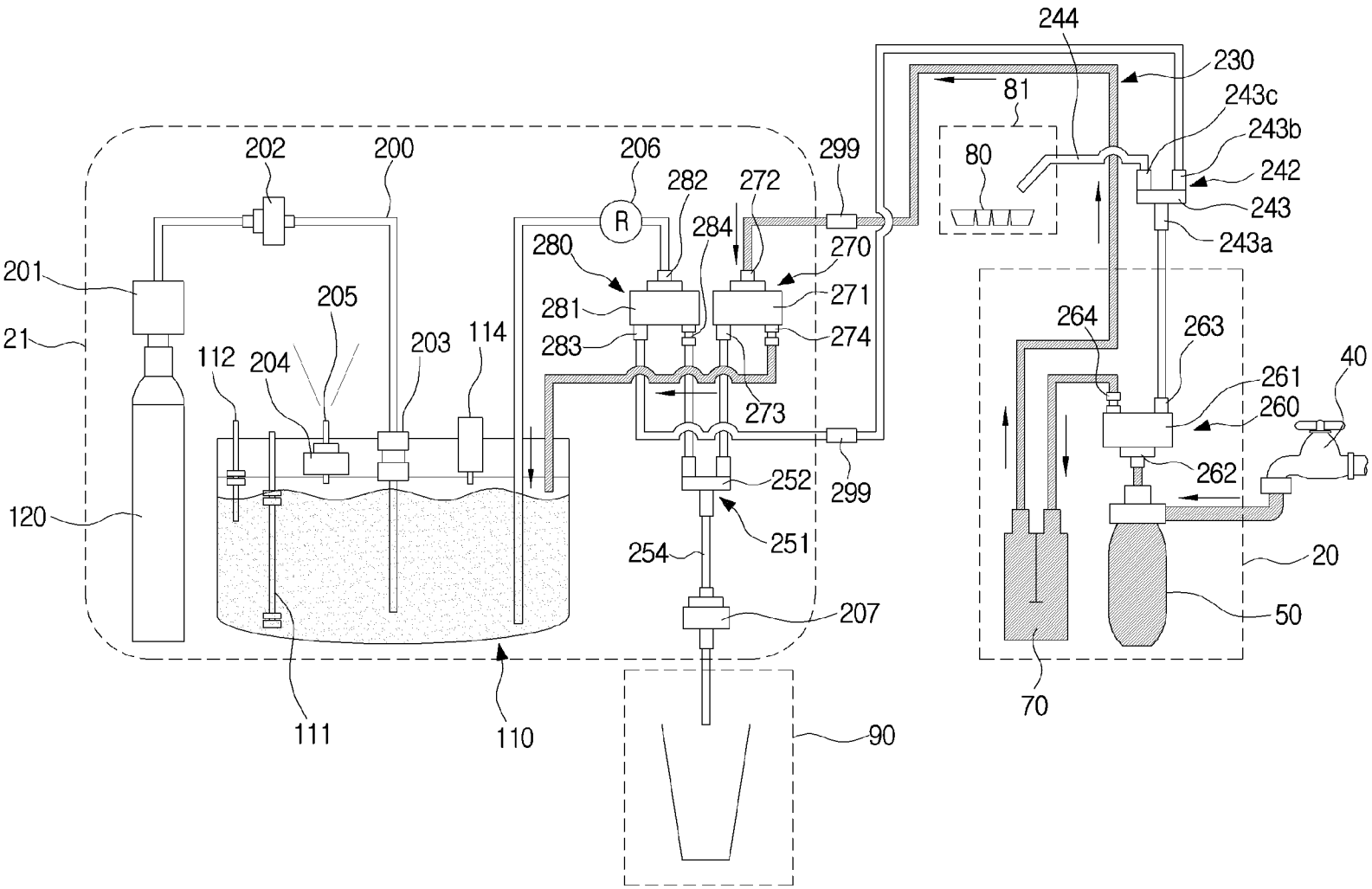
FIG. 7 is a conceptual view of a carbonated water-making general water flow path of the refrigerator of FIG. 1.
Figure 8:
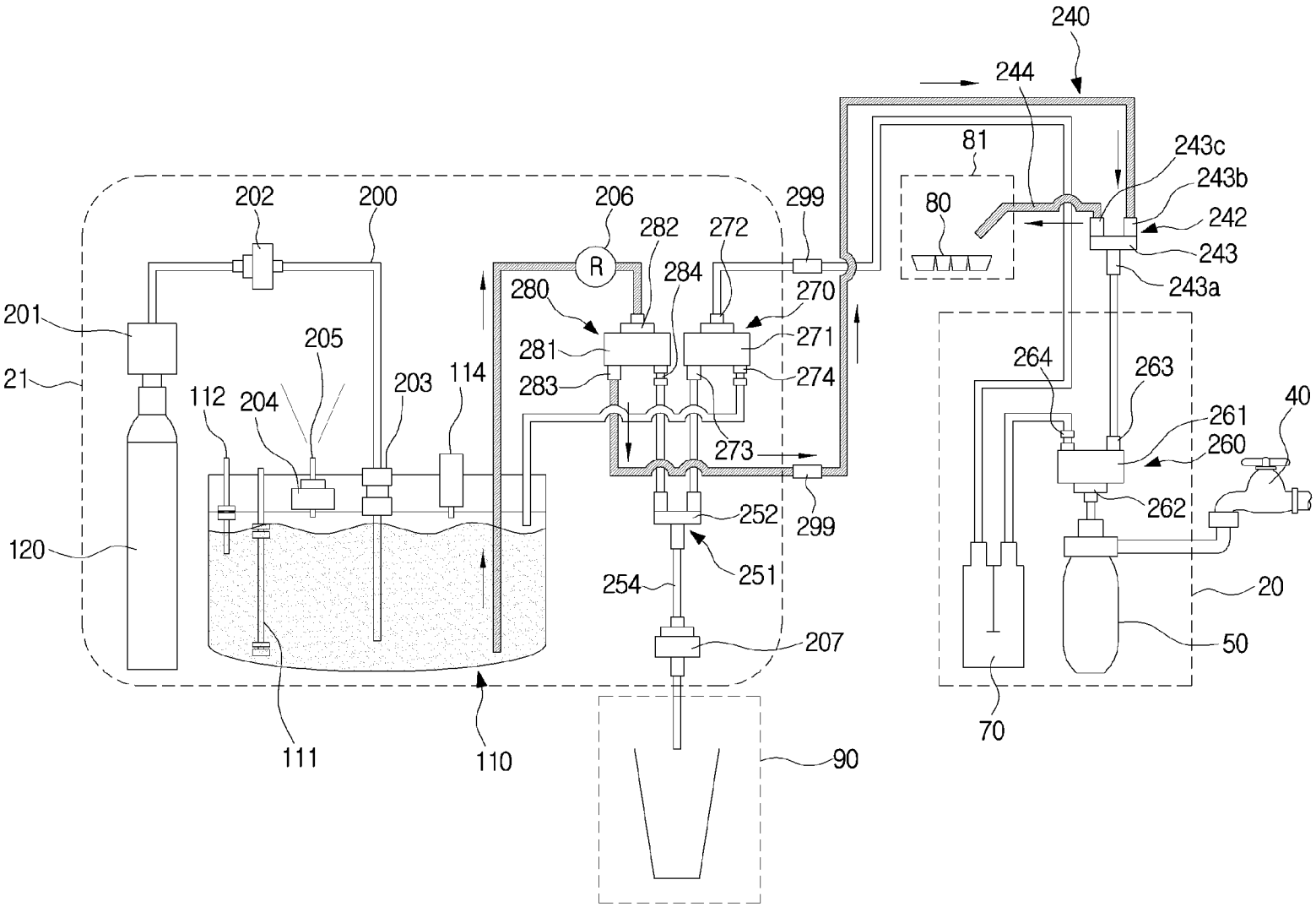
FIG. 8 is a conceptual view of an ice-making carbonated water flow path of the refrigerator of FIG. 1.
Figure 9:
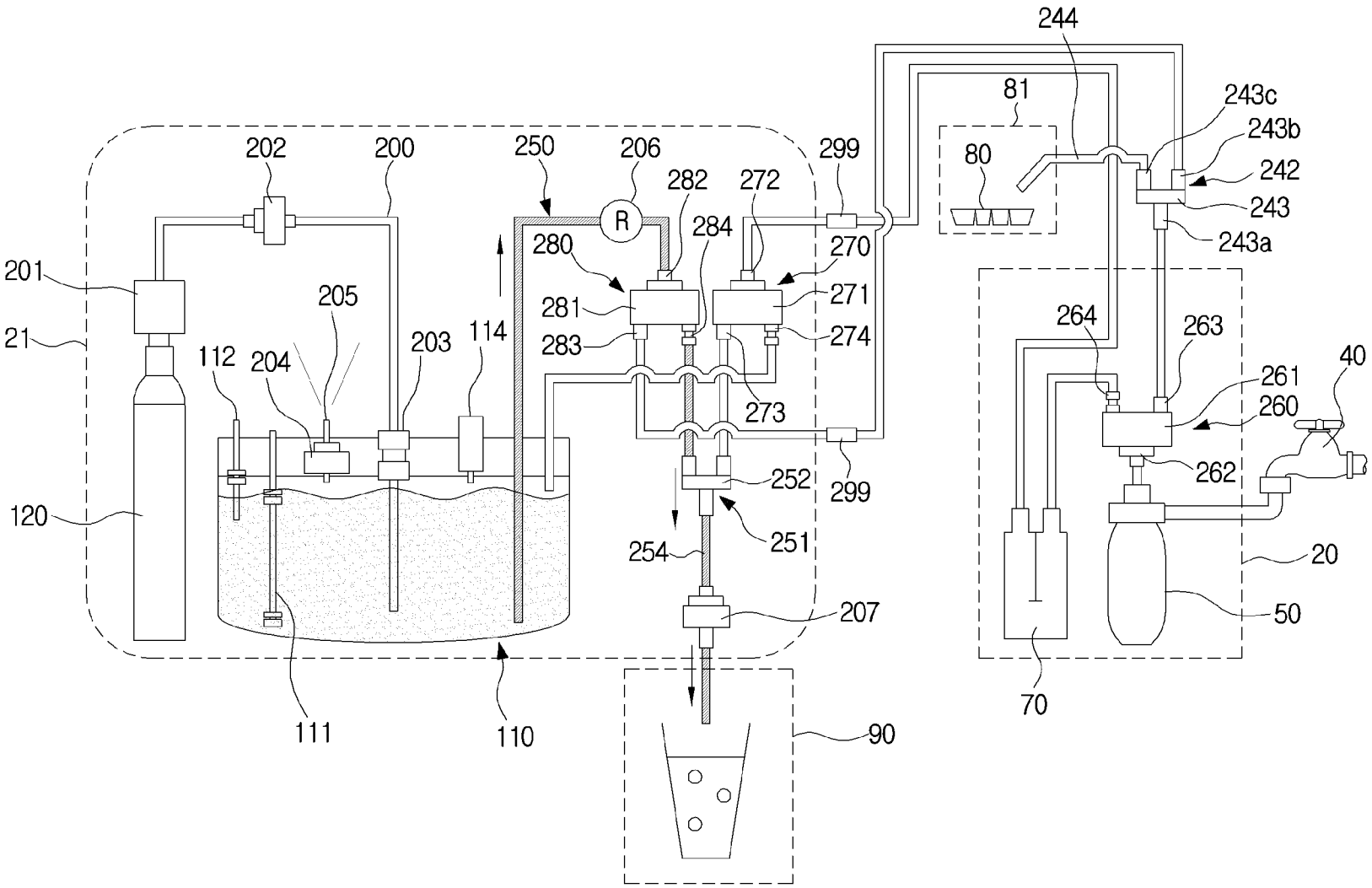
FIG. 9 is a conceptual view of a dispensing carbonated water flow path of the refrigerator of FIG. 1.
Figure 10:
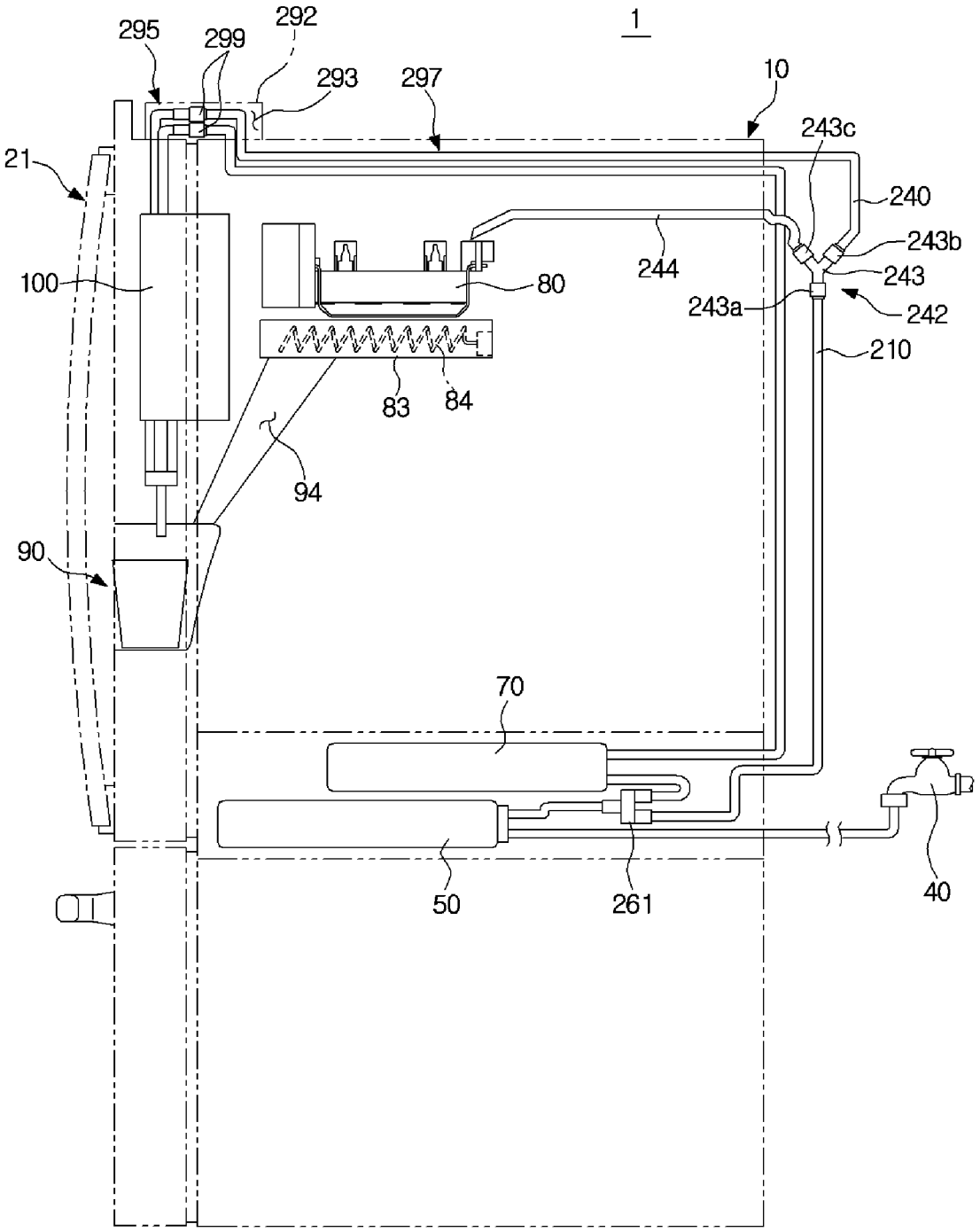
FIG. 10 is a schematic side cross-sectional view of the refrigerator of FIG. 1.

FIG. 5 is a conceptual view of an ice-making general water flow path of the refrigerator 1 of FIG. 1. FIG. 6 is a conceptual view of a dispensing general water flow path of the refrigerator 1 of FIG. 1. FIG. 7 is a conceptual view of a carbonated water-making general water flow path of the refrigerator 1 of FIG. 1. FIG. 8 is a conceptual view of an ice-making carbonated water flow path of the refrigerator 1 of FIG. 1. FIG. 9 is a conceptual view of a dispensing carbonated water flow path of the refrigerator 1 of FIG. 1. FIG. 10 is a schematic side cross-sectional view of the refrigerator 1 of FIG. 1.

As illustrated in FIG. 5, the refrigerator 1 may include an ice-making general water flow path 210 that connects the external water supply source 40 and the ice-making machine 80 so that general water may be supplied to the ice-making machine 80. General water from the external water supply source 40 may be supplied to the ice-making machine 80 through a water pressure of the external water supply source 40 and valve control.

The ice-making general water flow path 210 may be provided to pass through the water-purifying filter 50. Thus, general water from the external water supply source 40 may be purified by the water-purifying filter 50 and may be supplied to the ice-making machine 80.

The ice-making general water flow path 210 may be provided not to pass through the mixing tank 110. This is to supply only general water, without carbonated water, to the ice-making machine 80 regardless of whether carbonated water is stored in the mixing tank 110. That is, if the ice-making general water flow path 210 is disposed to pass through the mixing tank 110, when carbonated water is stored in the mixing tank 110, carbonated water in the mixing tank 110 may be supplied to the ice-making machine 80.

Since general water supplied to the ice-making machine 80 is cooled not in the general water tank 70 but in the ice-making machine 80, the ice-making general water flow path 210 may not pass through the general water tank 70. However, unlike in the current embodiment, the ice-making general water flow path 210 may also be provided to pass through the general water tank 70.

As illustrated in FIG. 6, the refrigerator 1 may include a dispensing general water flow path 220 that connects the external water supply source 40 and the dispenser 90 so that general water may be supplied to the dispenser 90. General water from the external water supply source 40 may be supplied to the dispenser 90 through a water pressure of the external water supply source 40 and valve control.

The dispensing general water flow path 220 may be disposed to pass through the water-purifying filter 50. Thus, general water from the external water supply source 40 may be purified by the water-purifying filter 50 and may be supplied to the dispenser 90.

The dispensing general water flow path 220 may be disposed not to pass through the mixing tank 110. This is to supply only general water, without for carbonated water regardless of whether carbonated water is stored in the mixing tank 110, to the dispenser 90. That is, if the dispensing general water flow path 220 is disposed to pass through the mixing tank 110, when carbonated water is stored in the mixing tank 110, carbonated water may be supplied to the dispenser 90.

The dispensing general water flow path 220 may be provided to pass through the general water tank 70. Thus, general water from the external water supply source 40 may be cooled in the general water tank 70 and then may be supplied to the outside of the refrigerator 1 through the dispenser 90.

As illustrated in FIG. 7, the refrigerator 1 may include a carbonated water-making general water flow path 230 that connects the external water supply source 40 and the mixing tank 110 so that general water may be supplied to the mixing tank 110. General water from the external water supply source 40 may be supplied to the mixing tank 110 through a water pressure of the external water supply source 40 and valve control.

The carbonated water-making general water flow path 230 may be provided to pass through the water-purifying filter 50. Thus, general water from the external water supply source 40 may be purified by the water-purifying filter 50 and may be supplied to the mixing tank 110.

The carbonated water-making general water flow path 230 may be provided to pass through the general water tank 70. Thus, general water from the external water supply source 40 may be cooled in the general water tank 70 and then may be supplied to the mixing tank 110.

As illustrated in FIG. 8, the refrigerator 1 may include an ice-making carbonated water flow path 240 that connects the mixing tank 110 and the ice-making machine 80 so that carbonated water may be supplied to the ice-making machine 80. Carbonated water in the mixing tank 110 may be supplied to the ice-making machine 80 through a water pressure of the mixing tank 110 and valve control.

As illustrated in FIG. 9, the refrigerator 1 may include a dispensing carbonated water flow path 250 that connects the mixing tank 110 and the dispenser 90 so that carbonated water may be supplied to the dispenser 90. Carbonated water in the mixing tank 110 may be supplied to the dispenser 90 through a water pressure of the mixing tank 110 and valve control.

In this way, the refrigerator 1 may have three general water flow paths 210, 220, and 230 which transfer general water, and two carbonated water flow paths 240 and 250 which transfer carbonated water.

Meanwhile, the three general water flow paths 210, 220, and 230, i.e., the ice-making general water flow path 210, the dispensing general water flow path 220, and the carbonated water-making general water flow path 230 may extend as a common flow path from the external water supply source 40 to a first divergence point 260.

At the first divergence point 260, the ice-making general water flow path 210 may be diverged from the dispensing general water flow path 220 and the carbonated water-making general water flow path 230. To this end, the first three-way valve 261 may be provided at the first divergence point 260. The first three-way valve 261 may have an inlet port 262, a first outlet port 263, and a second outlet port 264.

The first outlet port 263 of the first three-way valve 261 may open/close the ice-making general water flow path 210. That is, when the first outlet port 263 of the first three-way valve 261 is open/closed, the ice-making general water flow path 210 may be open/closed.

The second outlet port 264 of the first three-way valve 261 may open/close the dispensing general water flow path 220 and the carbonated water-making general water flow path 230.

That is, when the second outlet port 264 of the first three-way valve 261 is open/closed, the dispensing general water flow path 220 and the carbonated water-making general water flow path 230 may be open/closed.

The first outlet port 263 and the second outlet port 264 may be open/closed independently. That is, only the first outlet port 263 may be open, or only the second outlet port 264 may be open, or both the first outlet port 263 and the second outlet port 264 may be open, or both may be closed.

The dispensing general water flow path 220 and the carbonated water-making general water flow path 230 may extend as a common flow path from the first divergence point 260 to a second divergence point 270 and may be diverged at the second divergence point 270. To this end, the second three-way valve 271 may be provided at the second divergence point 270. The second three-way valve 271 may have an inlet port 272, a first outlet port 273, and a second outlet port 274.

The first outlet port 273 of the second three-way valve 271 may open/close the dispensing general water flow path 220. That is, when the first outlet port 273 of the second three-way valve 271 is open/closed, the dispensing general water flow path 220 may be open/closed.

The second outlet port 274 of the second three-way valve 271 may open/close the carbonated water-making general water flow path 230. That is, when the second outlet port 274 of the second three-way valve 271 is open/closed, the carbonated water-making general water flow path 230 may be open/closed.

The first outlet port 273 and the second outlet port 274 may be open/closed independently. That is, only the first outlet port 273 may be open, or only the second outlet port 274 may be open, or both the first outlet port 273 and the second outlet port 274 may be open, or both may be closed.

Meanwhile, the two carbonated water flow paths 240 and 250, i.e., the ice-making carbonated water flow path 240 and the dispensing carbonated water flow path 250 may extend as a common flow path from the mixing tank 110 to a third divergence point 280 and may be diverged at the third divergence point 280. To this end, the third three-way valve 281 may be provided at the third divergence point 280. The third three-way valve 281 may have an inlet port 282, a first outlet port 283, and a second outlet port 284.

The first outlet port 283 of the third three-way valve 281 may open/close the ice-making carbonated water flow path 240. That is, when the first outlet port 283 of the third three-way valve 281 is open/closed, the ice-making carbonated water flow path 240 may be open/closed.

The second outlet port 284 of the third three-way valve 281 may open/close the dispensing carbonated water flow path 250. That is, when the second outlet port 284 of the third three-way valve 281 is open/closed, the dispensing carbonated water flow path 250 may be open/closed.

The first outlet port 283 and the second outlet port 284 may be open/closed independently. That is, only the first outlet port 283 may be open, or only the second outlet port 284 may be open, or both the first outlet port 283 and the second outlet port 284 may be open, or both may be closed.

A carbonated water regulator 206 that controls pressure of carbonated water discharged from the mixing tank 110 may be disposed on a common path of the ice-making carbonated water flow path 240 and the dispensing carbonated water flow path 250. Meanwhile, the ice-making general water flow path 210 and the ice-making carbonated water flow path 240 may join at one join point 242 and may extend as a common flow path 244 up to the ice-making machine 80. The ice-making general water flow path 210 and the ice-making carbonated water flow path 240 may be connected to each other using a Y fitting member 243.

The Y fitting member 243 may have a first inlet port 243*a*, a second inlet port 243*b*, and an outlet port 243*c*. The Y fitting member 243 may prevent water introduced from one of the first and second inlet ports 243*a* and 243*b* from flowing to the other one of the first and second inlet ports 243*a* and 243*b* and may allow water to flow only to the outlet port 243*c*.

The Y fitting member 243 may be disposed in various positions. For example, as illustrated in FIG. 10, the Y fitting member 243 may be disposed at an outside of the rear of the main body 10. That is, the ice-making general water flow path 210 and the ice-making carbonated water flow path 240 may be coupled to each other at the outside of the rear of the main body 10.

Figure 13:
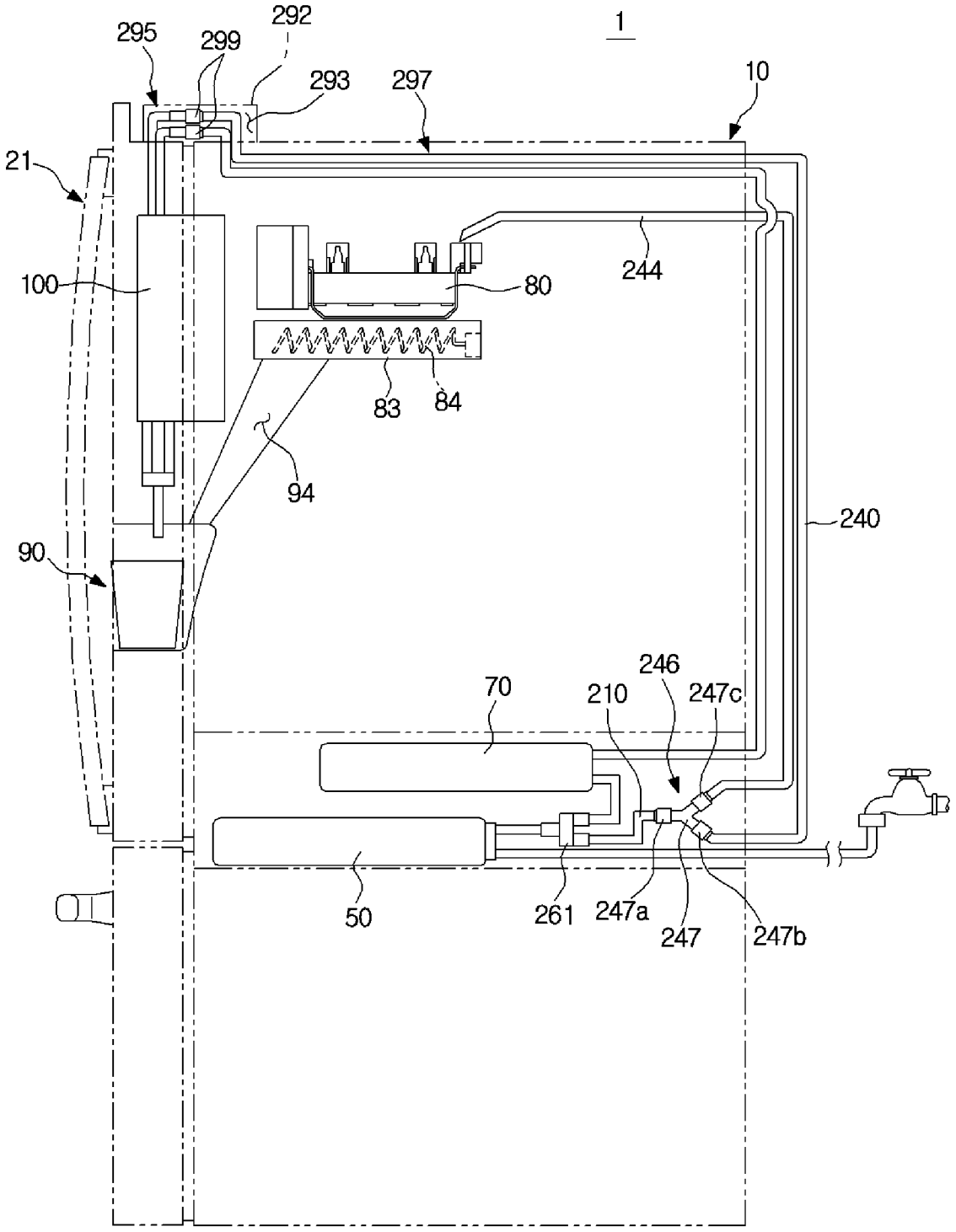
FIG. 13 is a side cross-sectional view of still another modified embodiment of the refrigerator of FIG. 1.

Alternatively, as illustrated in FIG. 13, a Y fitting member 247 may be disposed in the main body 10. That is, the ice-making general water flow path 210 and the ice-making carbonated water flow path 240 may be coupled to each other in the main body 10. Reference numeral 246 represents a join point of the ice-making general water flow path 210 and the ice-making carbonated water flow path 240, and reference numerals 247*a*, 247*b*, and 247*c* represent a first inlet port, a second inlet port, and an outlet port of the Y fitting member 247, respectively.

Figure 11:
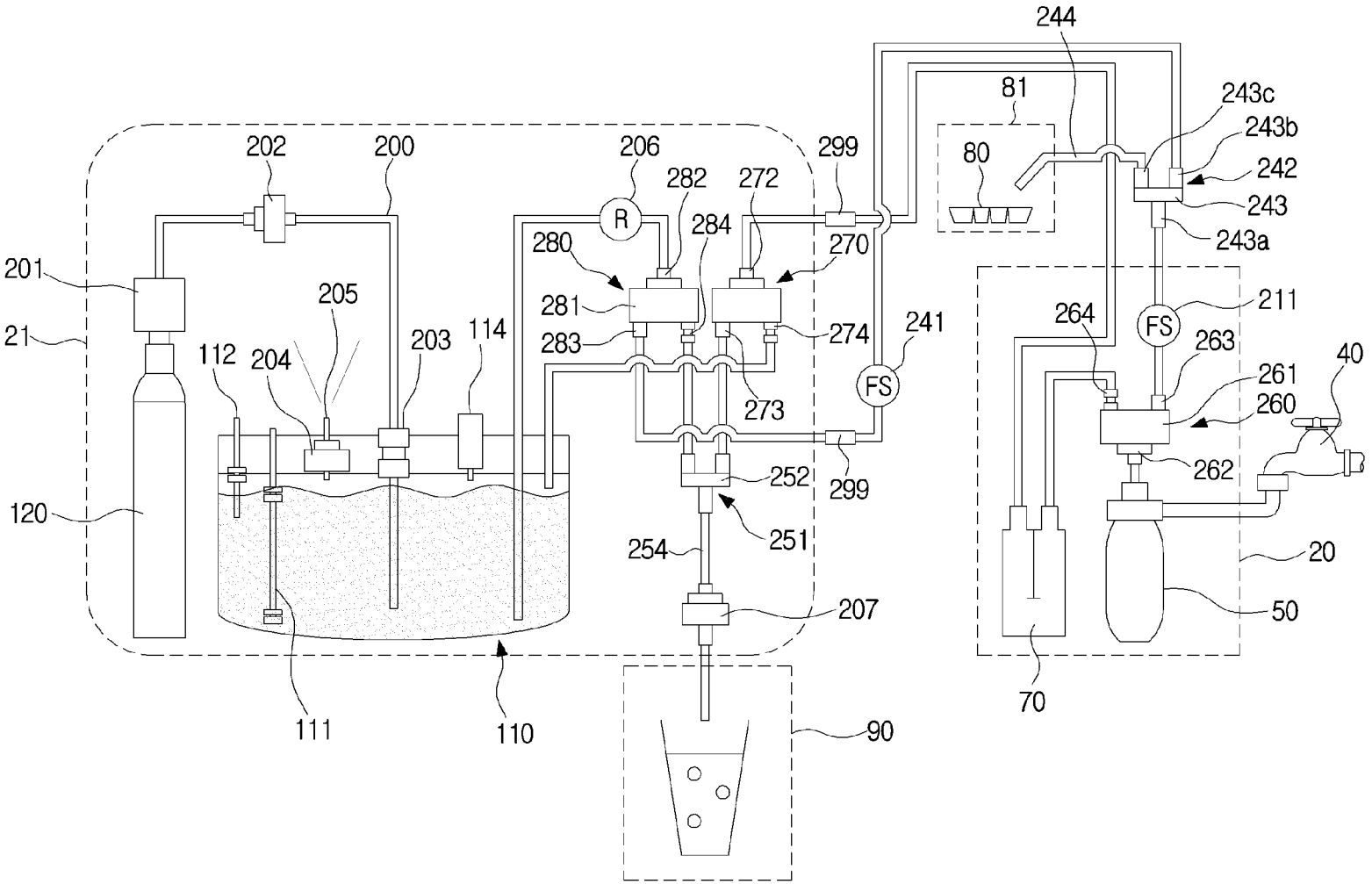
FIG. 11 is a conceptual view of a modified embodiment of the refrigerator of FIG. 1.

As illustrated in FIG. 11, a flow sensor 211 may be disposed on the ice-making general water flow path 210 so that a predetermined amount of general water may be supplied to the ice-making machine 80. In addition, a flow sensor 241 may be disposed on the ice-making carbonated water flow path 240 so that a predetermined amount of carbonated water may be supplied to the ice-making machine 80.

Figure 12:
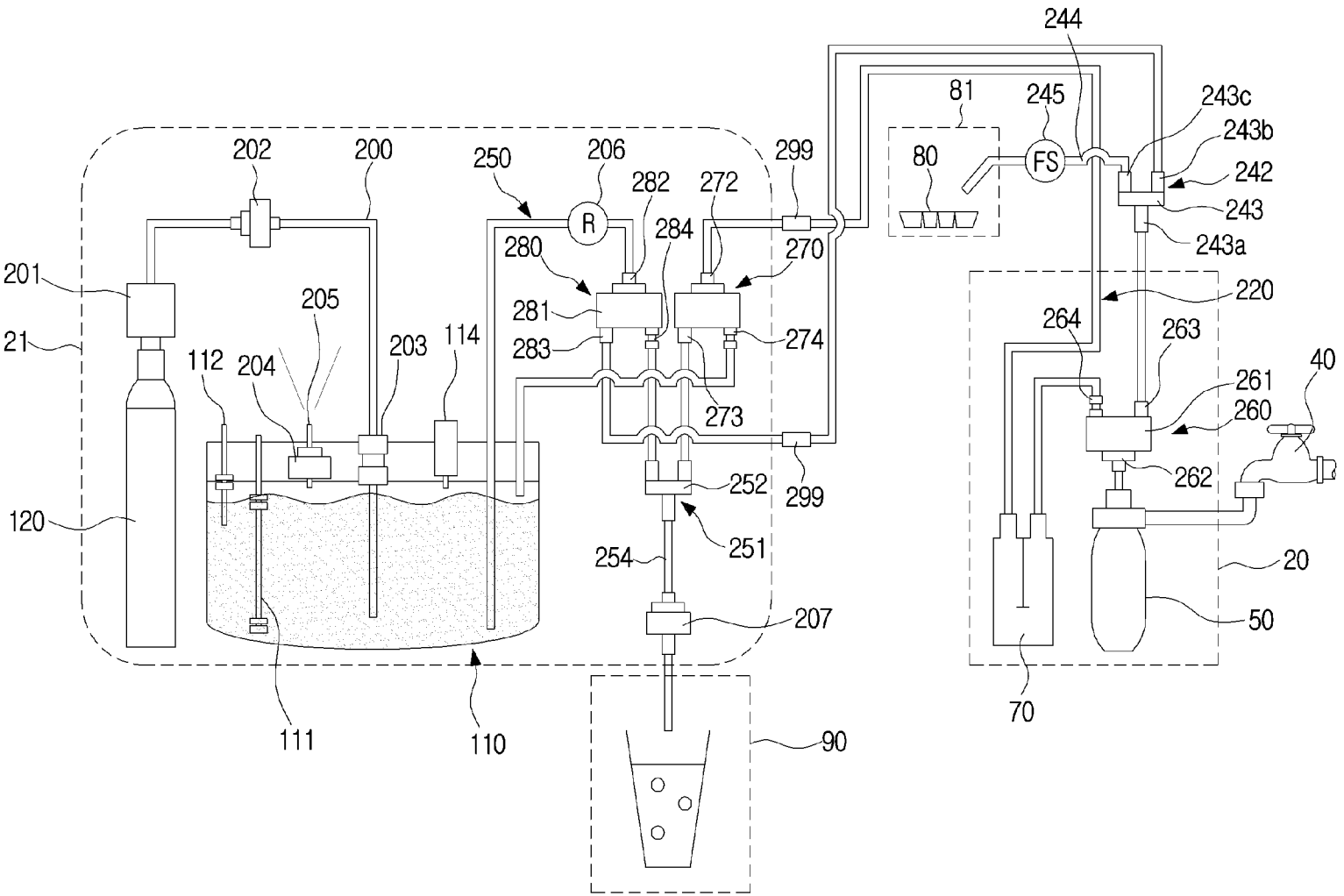
FIG. 12 is a conceptual view of another modified embodiment of the refrigerator of FIG. 1.

Unlike the embodiment shown in FIG. 11, a flow sensor 245, as illustrated in FIG. 12, may be disposed on the common flow path 244 of the ice-making general water flow path 210 and the ice-making carbonated water flow path 240 and may measure the amount of general water or carbonated water supplied to the ice-making machine 80.

Meanwhile, the dispensing general water flow path 220 and the dispensing carbonated water flow path 250 may join at one join point 251 and may extend as a common flow path 254 up to the dispenser 90. A three way valve 252 may be provided at the joint point 251. The dispensing general water flow path 220 and the dispensing carbonated water flow path 250 may be connected to each other using the Y fitting member 247.

A remnant water prevention valve 207 that prevents remnant water may be disposed on the common flow path 254 of the dispensing general water flow path 220 and the dispensing carbonated water flow path 250. The remnant water prevention valve 207 may be disposed close to an end of the common flow path 254 of the dispensing general water flow path 220 and the dispensing carbonated water flow path 250.

The above-described various flow paths 210, 220, 230, 240, and 250 may be formed using a hose. In particular, in the current embodiment, the dispenser 90 and the mixing tank 110 are provided at the door 21 and the general water tank 70 and the ice-making machine 80 are provided in the main body 10. Thus, the flow paths 210, 220, 230, 240, and 250 may be formed by coupling a door hose 295, as shown in FIGS. 10 and 13, that extends from the door 21 and a main body hose 297 that extends from the main body 10.

Returning to the embodiment illustrated in FIG. 10, the door hose 295 and the main body hose 297 may be coupled to each other at an upper portion of an outside of the main body 10. The door hose 295 and the main body hose 297 may be coupled to each other using a straight fitting member 299.

The refrigerator 1 may include a hinge member (see 290 of FIG. 30) that supports the door 21 rotatably and a cover member 292 coupled to an upper side of the hinge member 290 to cover the hinge member 290 and having an internal space 293 formed in the cover member 292. The hinge member 290 may include a hinge shaft (see 294 of FIG. 30) inserted into a shaft insertion hole (see 21*a* of FIG. 30) of the door 21 and having a hollow portion (see 291 of FIG. 30).

The door hose 295 may extend from an inside of the door 21 to an outside of the door 21 through the hollow portion 291 of the hinge shaft 294. The main body hose 297 may penetrate an upper wall 10*a* of the main body 10 and may extend from an inside of the main body 10 to an outside of the main body 10.

The straight fitting member 299 that couples the door hose 295 and the main body hose 297 may be disposed in the internal space 293 of the cover member 292 and may not be exposed to the outside of the refrigerator 1.

Figure 14:
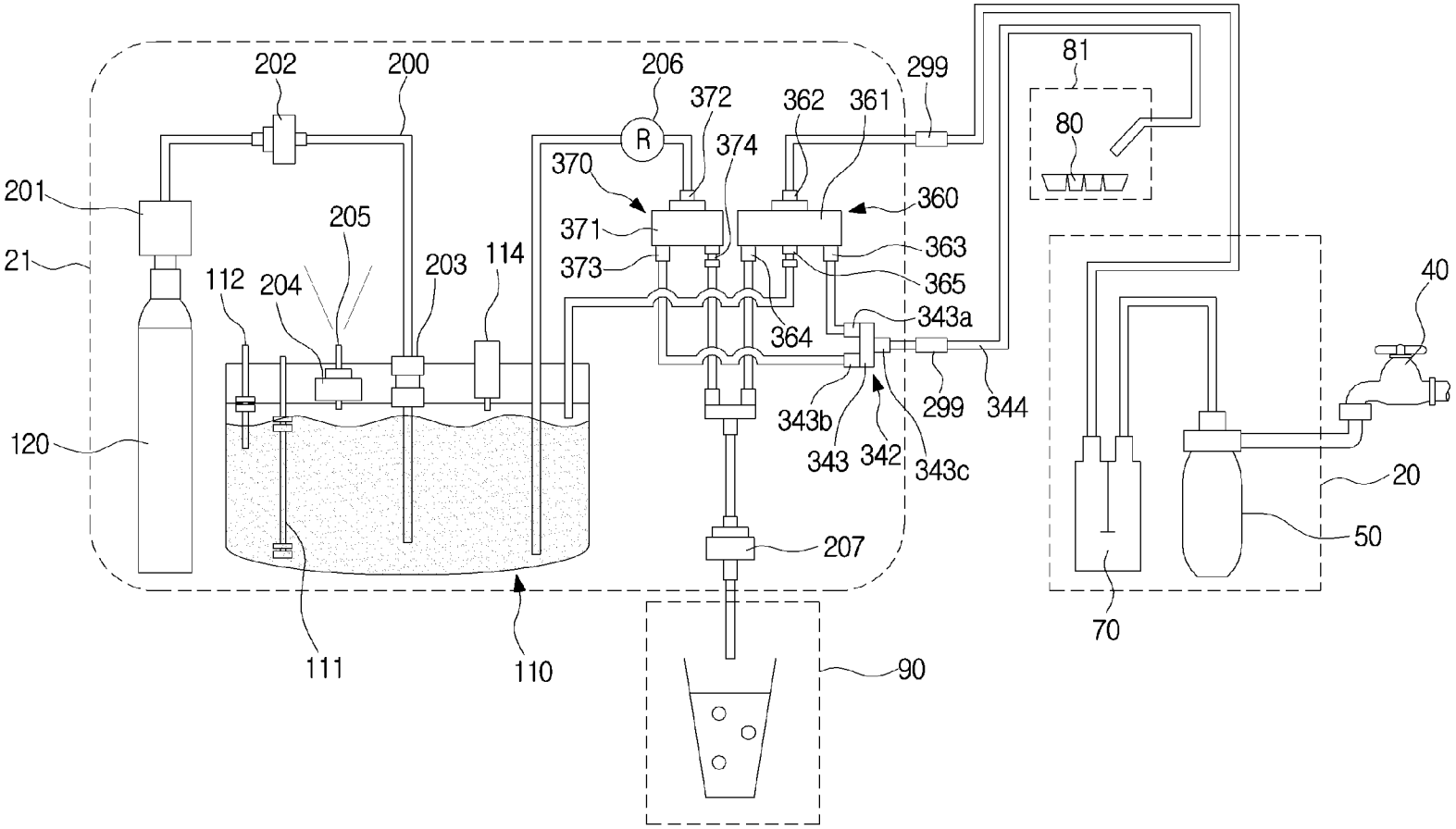
FIG. 14 is a conceptual view of a main configuration of a refrigerator according to a second embodiment of the present disclosure.
Figure 15:
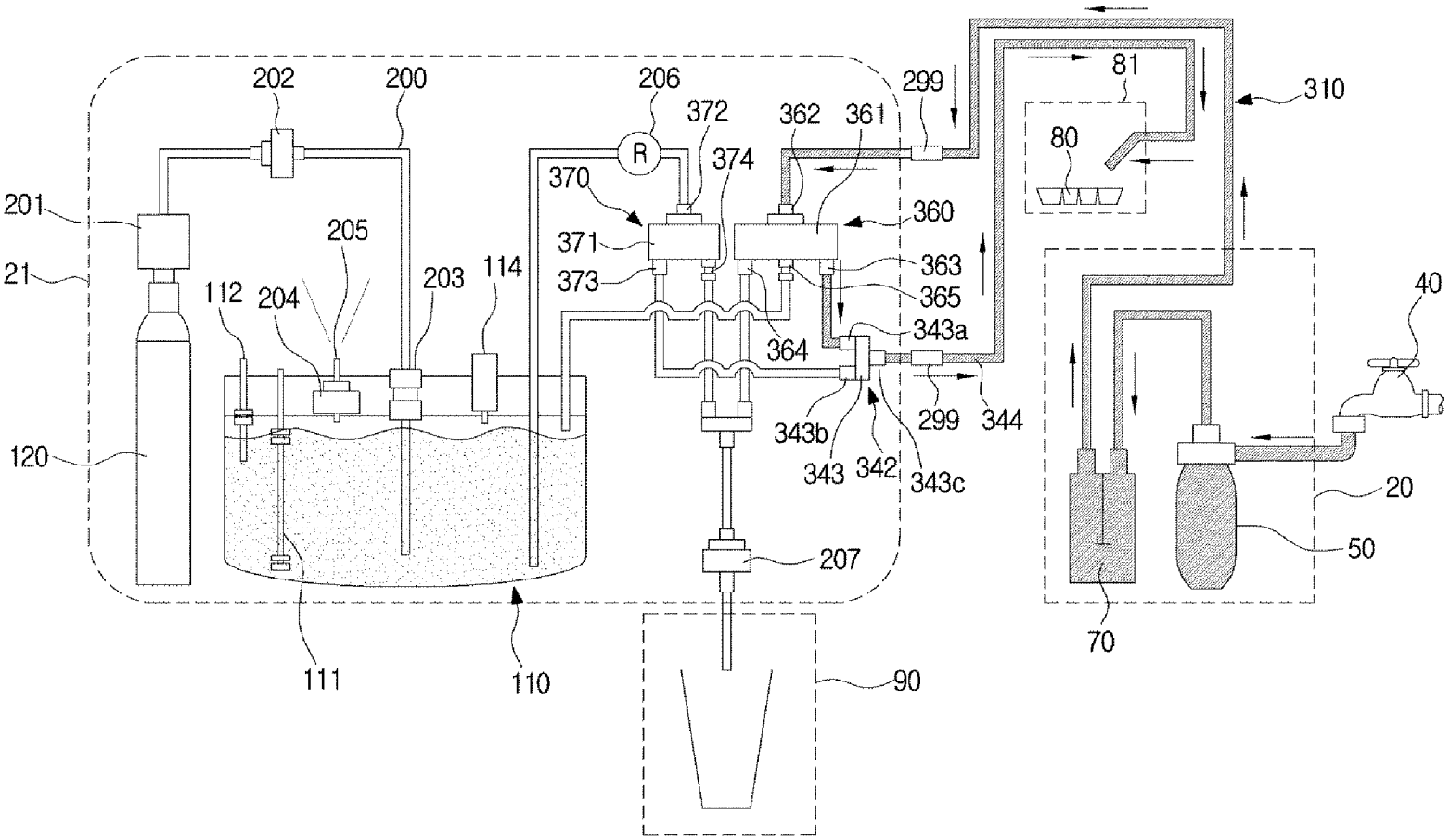
FIG. 15 is a conceptual view of an ice-making general water flow path of the refrigerator of FIG. 14.
Figure 16:
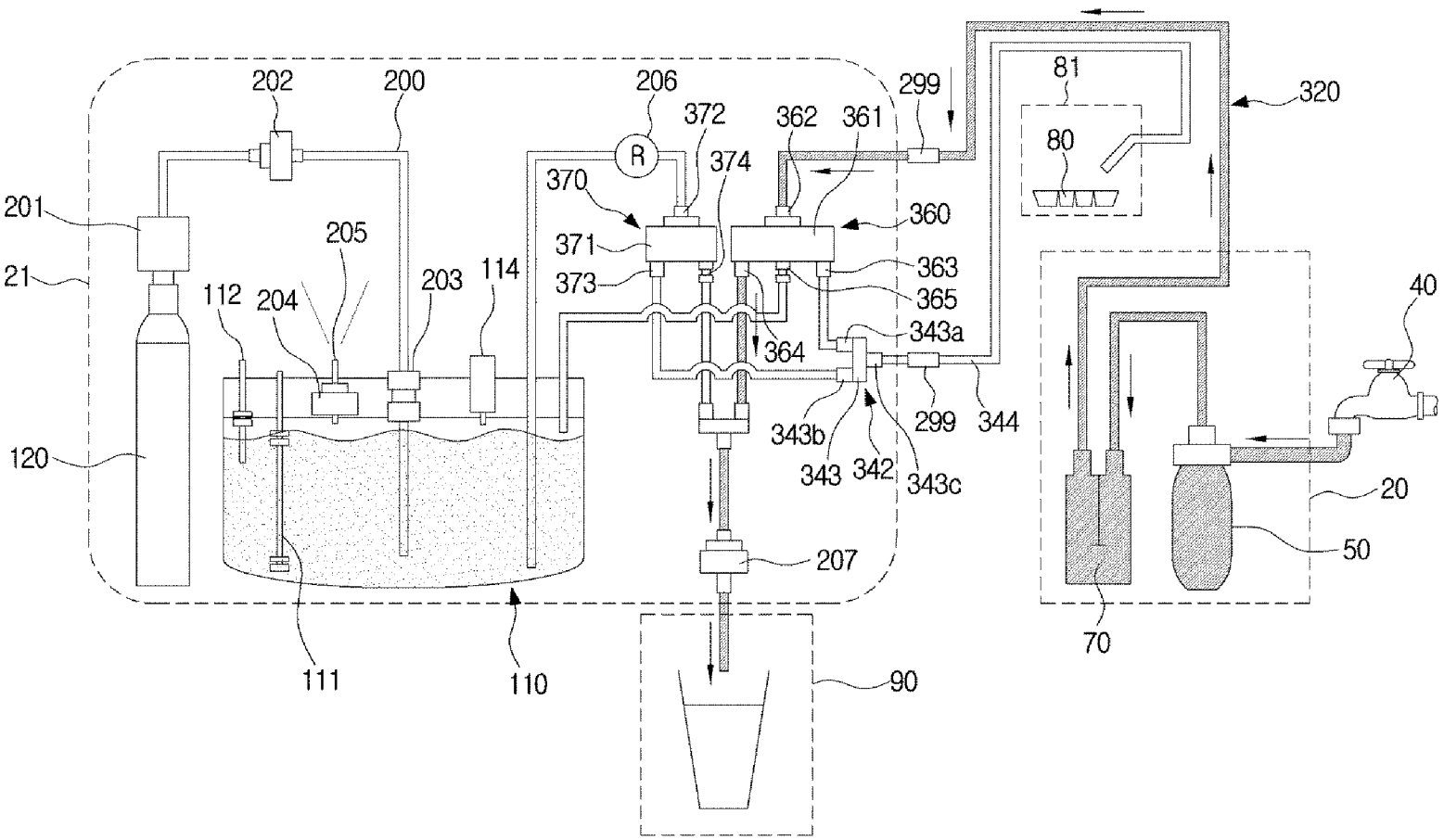
FIG. 16 is a conceptual view of a dispensing general water flow path of the refrigerator of FIG. 14.
Figure 17:
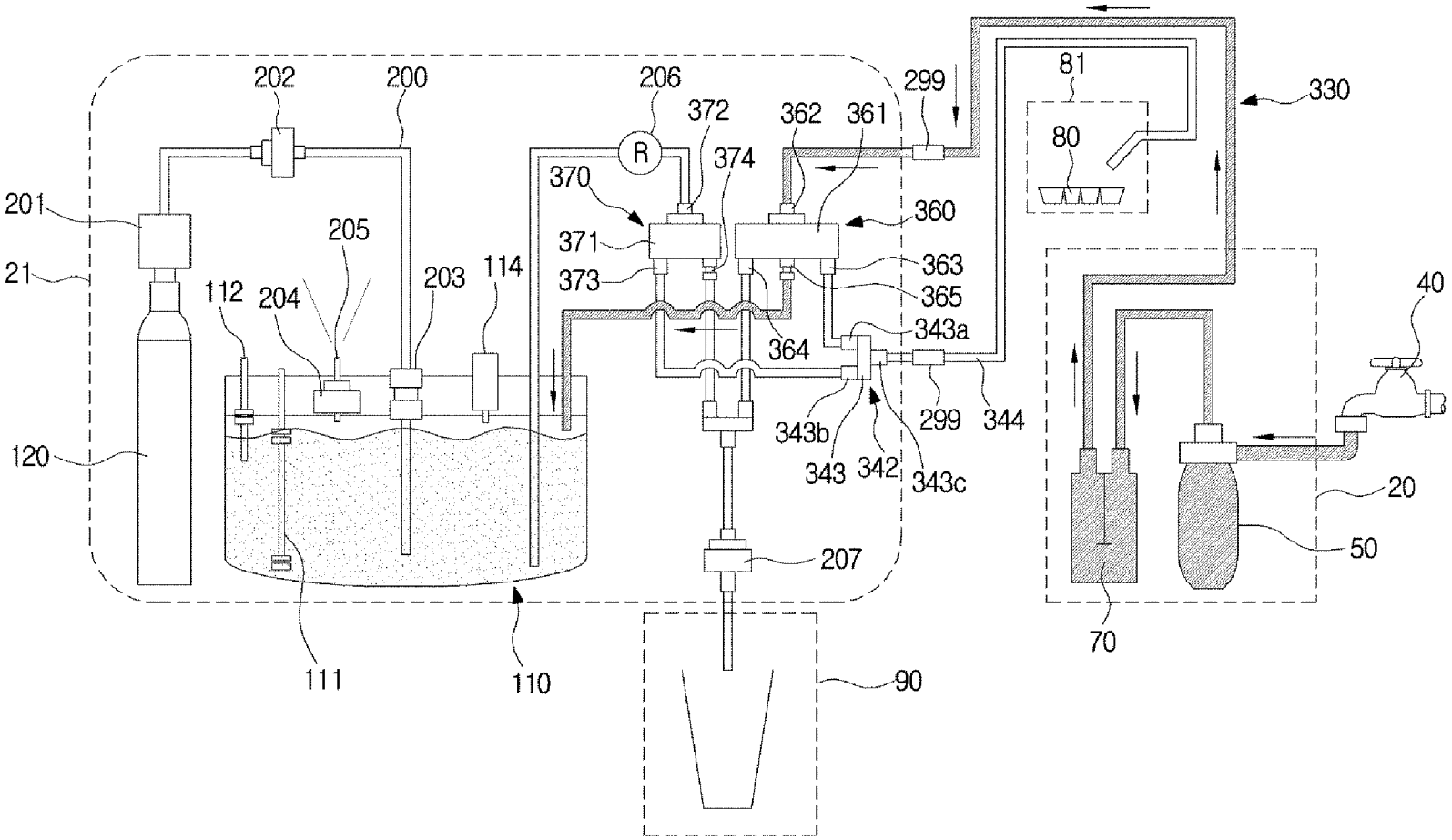
FIG. 17 is a conceptual view of a carbonated water-making general water flow path of the refrigerator of FIG. 14.
Figure 18:
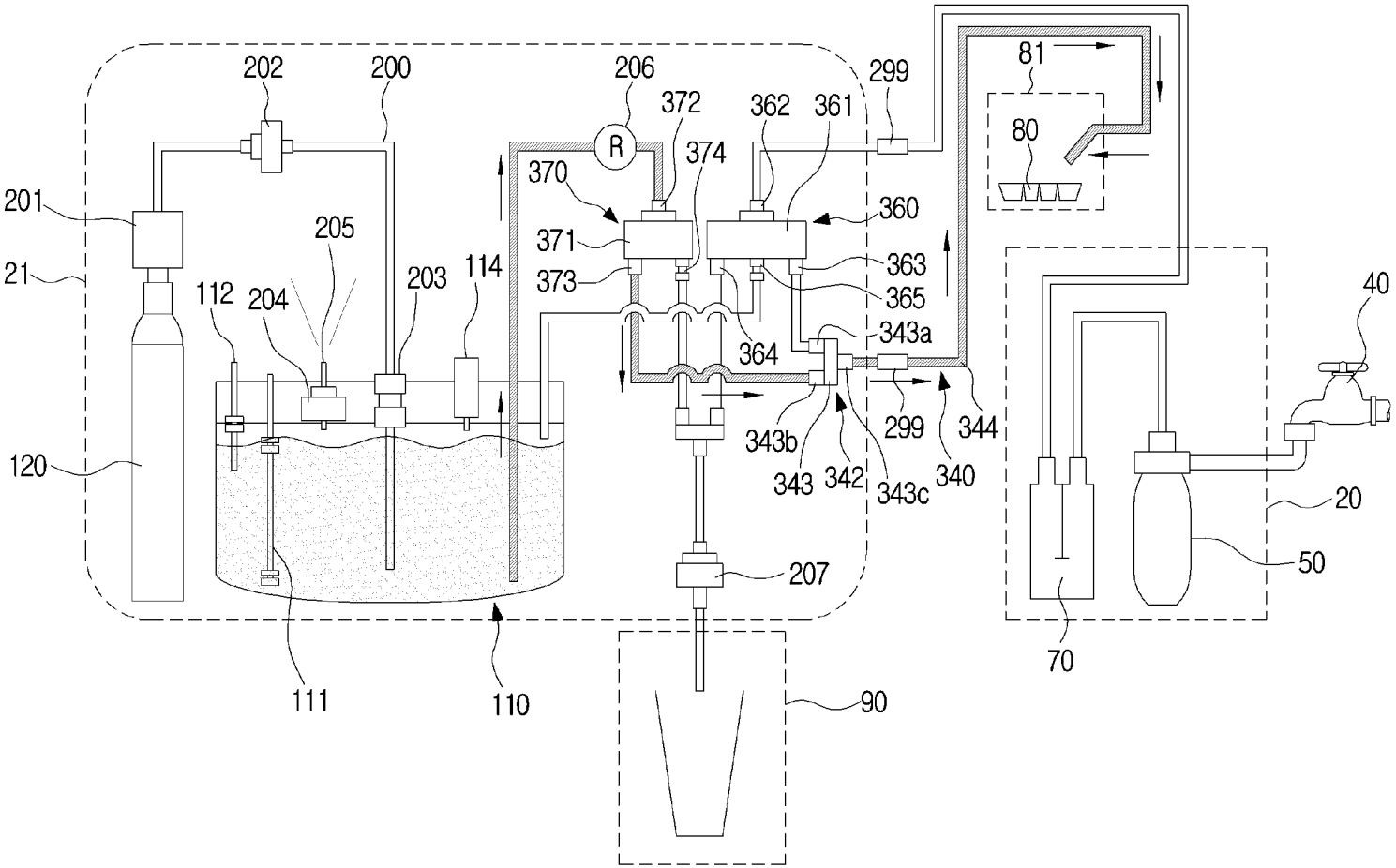
FIG. 18 is a conceptual view of an ice-making carbonated water flow path of the refrigerator of FIG. 14.
Figure 19:
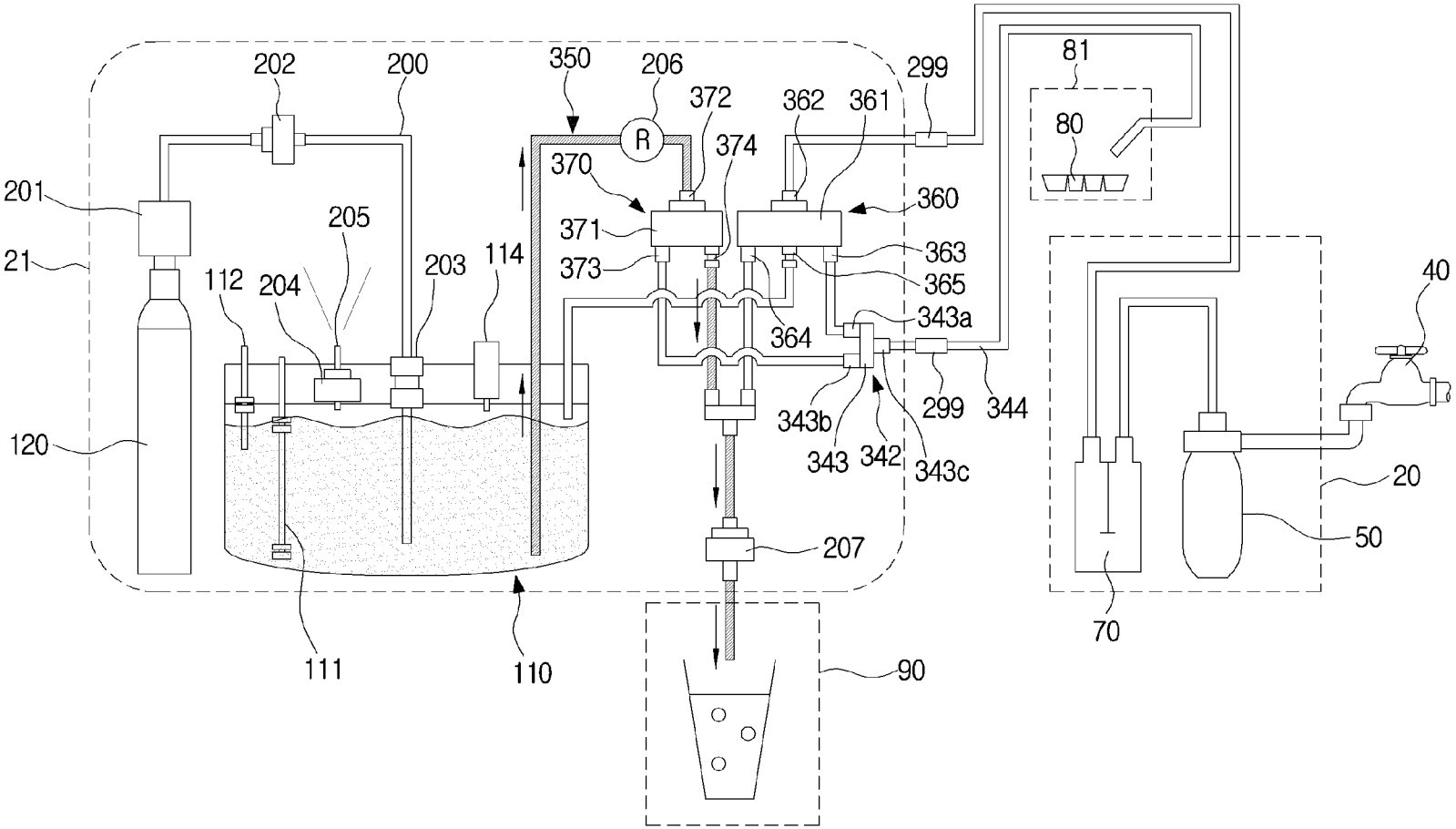
FIG. 19 is a conceptual view of a dispensing carbonated water flow path of the refrigerator of FIG. 14.
Figure 20:
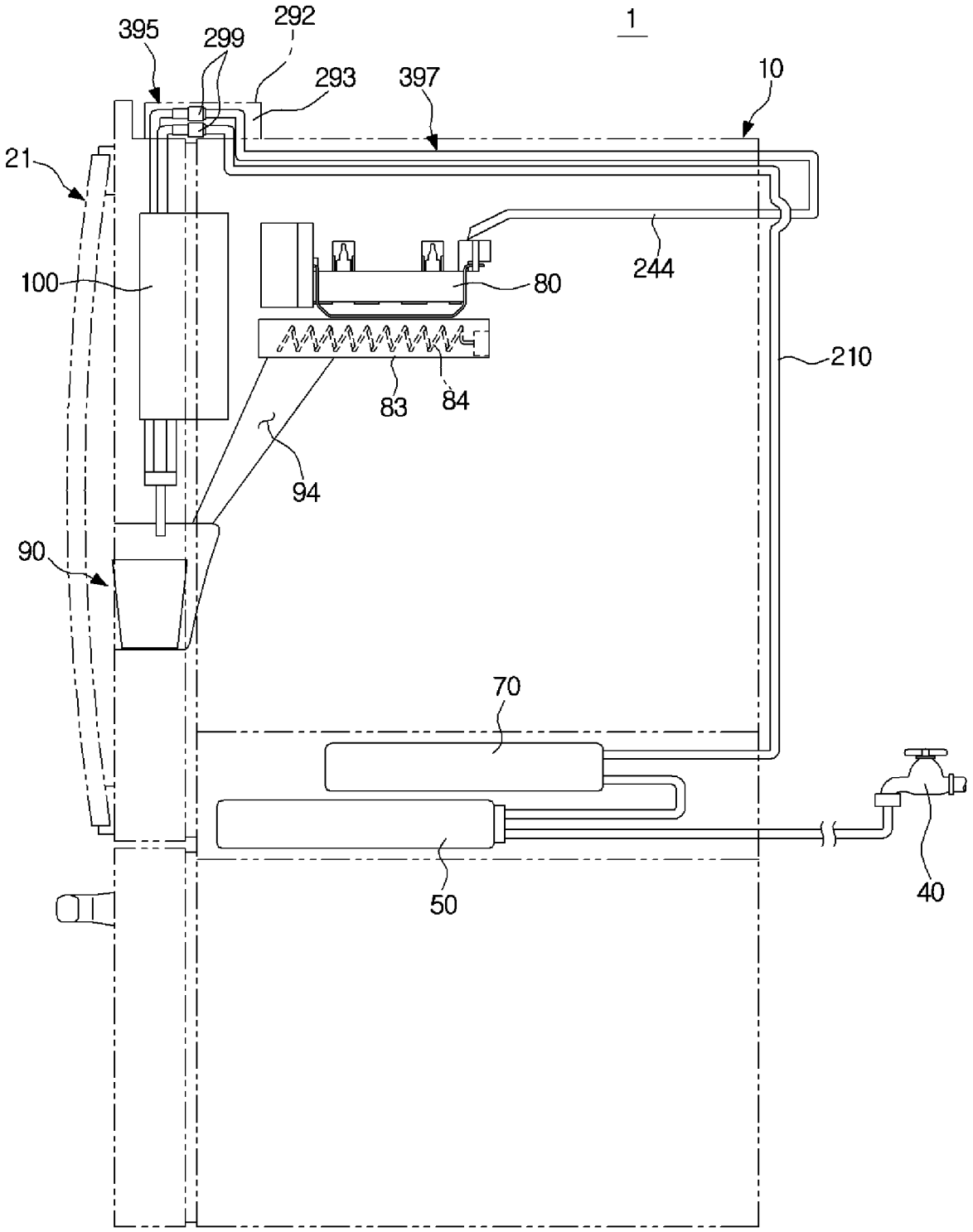
FIG. 20 is a schematic side cross-sectional view of the refrigerator of FIG. 14.

FIG. 14 is a conceptual view of a main configuration of a refrigerator 1 according to a second embodiment of the present disclosure. FIG. 15 is a conceptual view of an ice-making general water flow path of the refrigerator 1 of FIG. 14. FIG. 16 is a conceptual view of a dispensing general water flow path of the refrigerator 1 of FIG. 14. FIG. 17 is a conceptual view of a carbonated water-making general water flow path of the refrigerator 1 of FIG. 14. FIG. 18 is a conceptual view of an ice-making carbonated water flow path of the refrigerator 1 of FIG. 14. FIG. 19 is a conceptual view of a dispensing carbonated water flow path of the refrigerator 1 of FIG. 14. FIG. 20 is a schematic side cross-sectional view of the refrigerator 1 of FIG. 14.

Figure 21:
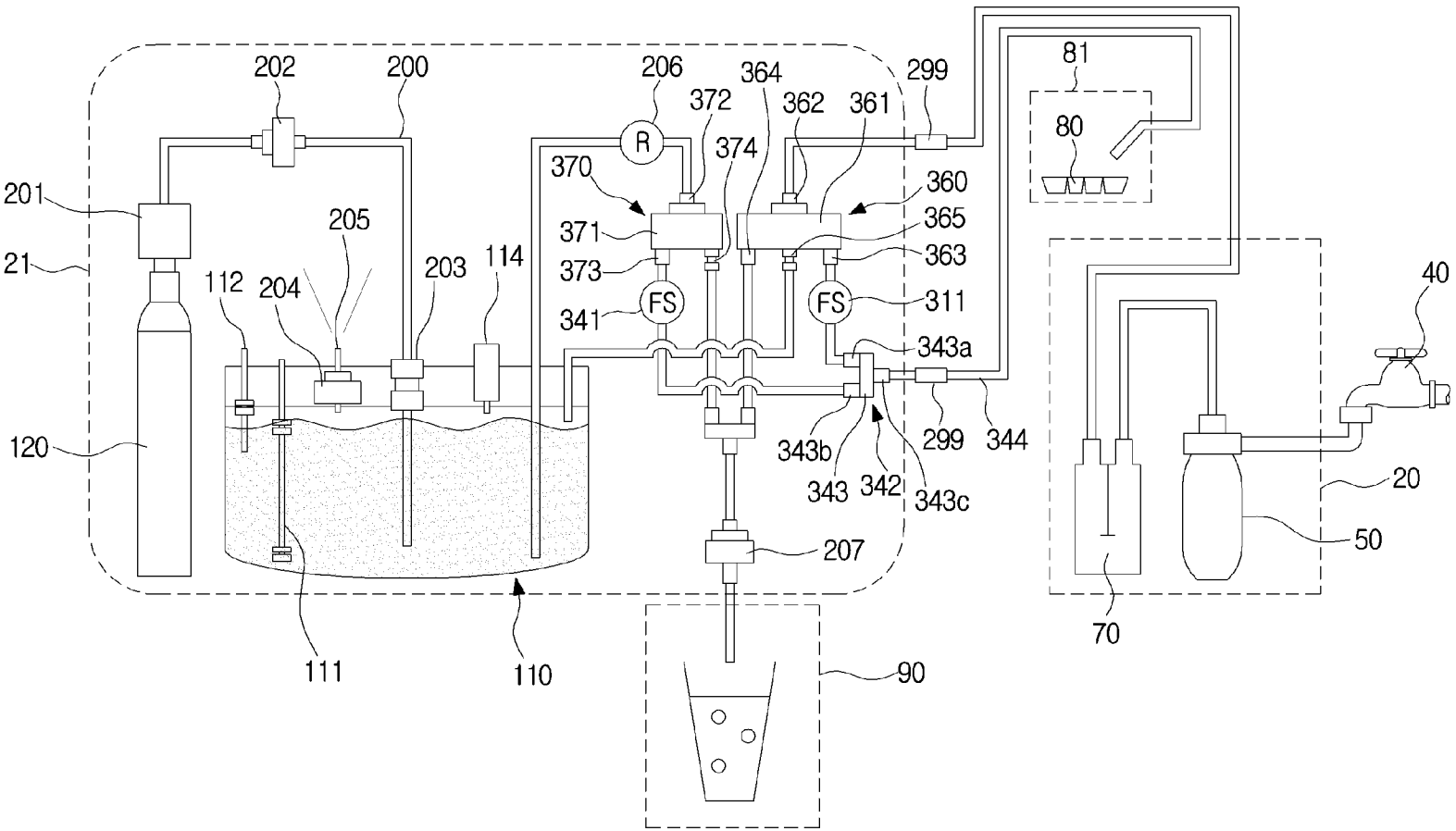
FIG. 21 is a conceptual view of a modified embodiment of the refrigerator of FIG. 14.
Figure 22:
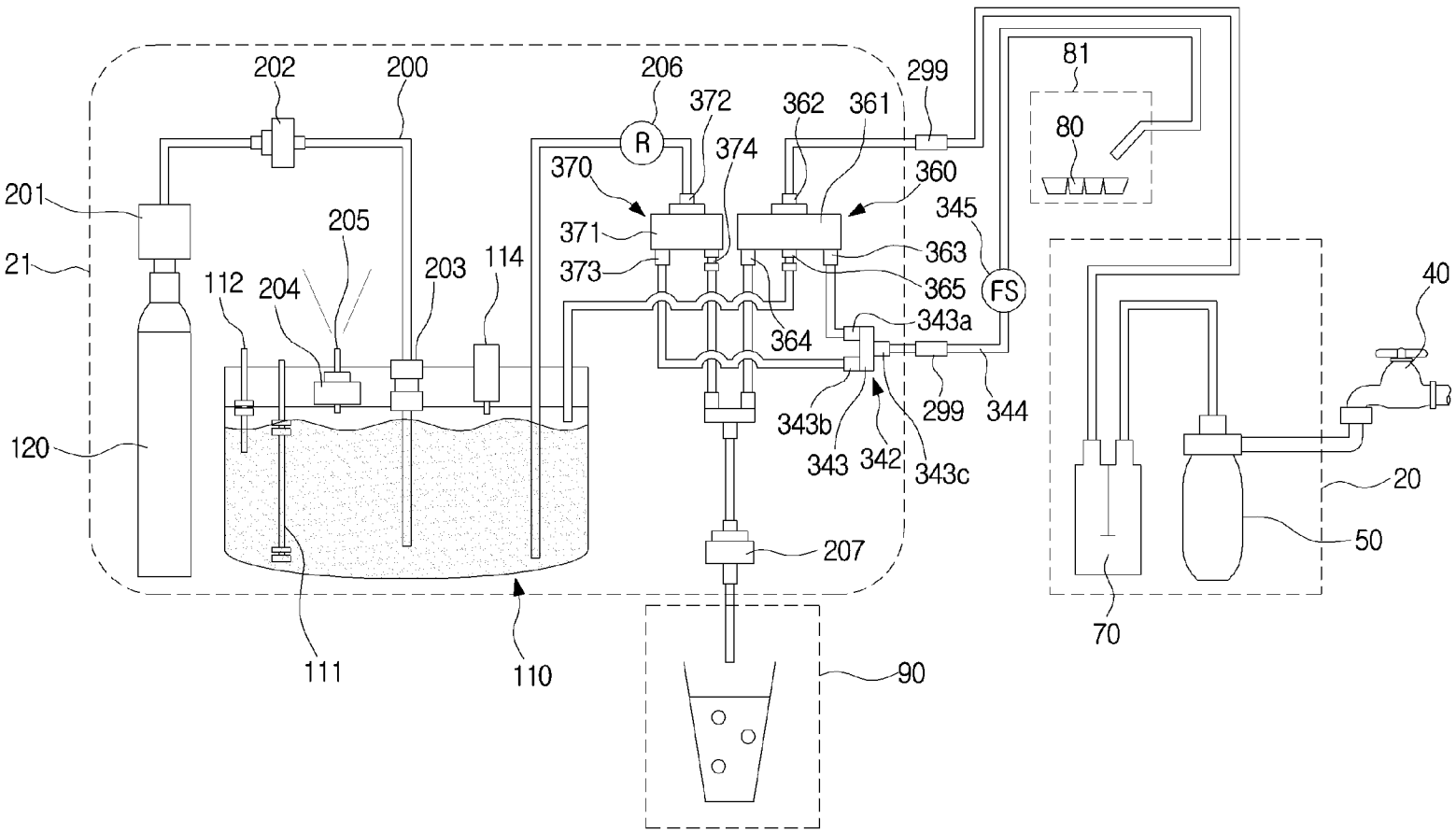
FIG. 22 is a conceptual view of another modified embodiment of the refrigerator of FIG. 14.

FIG. 21 is a conceptual view of a modified embodiment of the refrigerator 1 of FIG. 14. FIG. 22 is a conceptual view of another modified embodiment of the refrigerator 1 of FIG. 14.

A refrigerator according to a second embodiment of the present disclosure will be described with reference to FIGS. 14 through 22. Like reference numerals are used for the same configuration as the first embodiment, and a description thereof will be omitted.

As illustrated in FIG. 15, the refrigerator 1 may include an ice-making general water flow path 310 that connects an external water supply source 40 and an ice-making machine 80 so that general water may be supplied to the ice-making machine 80.

The ice-making general water flow path 310 may be disposed to pass through a water-purifying filter 50. The ice-making general water flow path 310 may be disposed not to pass through a mixing tank 110. The ice-making general water flow path 310 may be disposed to pass through a general water tank 70.

As illustrated in FIG. 16, the refrigerator 1 may include a dispensing general water flow path 320 that connects the external water supply source 40 and a dispenser 90 so that general water may be supplied to the dispenser 90.

The dispensing general water flow path 320 may be disposed to pass through the water-purifying filter 50. The dispensing general water flow path 320 may be disposed not to pass through the mixing tank 110. The dispensing general water flow path 320 may be disposed to pass through the general water tank 70.

As illustrated in FIG. 17, the refrigerator 1 may include a carbonated water-making general water flow path 330 that connects the external water supply source 40 and the mixing tank 110 so that general water may be supplied to the mixing tank 110.

The carbonated water-making general water flow path 330 may be disposed to pass through the water-purifying filter 50. The carbonated water-making general water flow path 330 may be disposed to pass through the general water tank 70.

As illustrated in FIG. 18, the refrigerator 1 may include an ice-making carbonated water flow path 340 that connects the mixing tank 110 and the ice-making machine 80 so that carbonated water may be supplied to the ice-making machine 80.

As illustrated in FIG. 19, the refrigerator 1 may include a dispensing carbonated water flow path 350 that connects the mixing tank 110 and the dispenser 90 so that carbonated water may be supplied to the dispenser 90.

The ice-making general water flow path 310, the dispensing general water flow path 320, and the carbonated water-making general water flow path 330 may be diverged at a first divergence point 360, and a four-way valve 361 may be disposed at the first divergence point 360.

The four-way valve 361 may have an inlet port 362, a first outlet port 363 that opens/closes the ice-making general water flow path 310, a second outlet port 364 that opens/closes the dispensing general water flow path 320, and a third outlet port 365 that opens/closes the carbonated water-making general water flow path 330. The first outlet port 363, the second outlet port 364, and the third outlet port 365 may be open/closed independently.

The ice-making carbonated water flow path 340 and the dispensing carbonated water flow path 350 may be diverged at a second divergence point 370, and a three-way valve 371 may be disposed at the second divergence point 370.

The three-way valve 371 may have an inlet port 372, a first outlet port 373 that opens/closes the ice-making carbonated water flow path 340, and a second outlet port 374 that opens/closes the dispensing carbonated water flow path 350. The first outlet port 373 and the second outlet port 374 may be open/closed independently.

The ice-making general water flow path 310 and the ice-making carbonated water flow path 340 may join at one join point 342 and may extend as a common flow path 344 up to the ice-making machine 80. The ice-making general water flow path 310 and the ice-making carbonated water flow path 340 may be connected to each other using a Y fitting member 343.

The Y fitting member 343 may have a first inlet port 343*a*, a second inlet port 343*b*, and an outlet port 343*c*. The Y fitting member 343 may prevent water introduced from one of the first and second inlet ports 343*a* and 343*b* from flowing to the other one of the first and second inlet ports 343*a* and 343*b* and may allow water to flow only to the outlet port 343*c*.

As illustrated in FIG. 20, a door hose 395 and a main body hose 397 may be coupled to each other at an upper side of an outside of a main body 10. The door hose 395 and the main body hose 397 may be coupled to each other using a straight fitting member 299.

As illustrated in FIG. 21, a flow sensor 311 may be disposed on the ice-making general water flow path 310 so that a predetermined amount of general water may be supplied to the ice-making machine 80. In addition, a flow sensor 341 may be disposed on the ice-making carbonated water flow path 340 so that a predetermined amount of carbonated water may be supplied to the ice-making machine 80.

As illustrated in FIG. 22, one flow sensor 345 may be disposed on the common flow path 344 of the ice-making general water flow path 310 and the ice-making carbonated water flow path 340, and may measure the amount of general water or carbonated water supplied to the ice-making machine 80.

Figure 23:
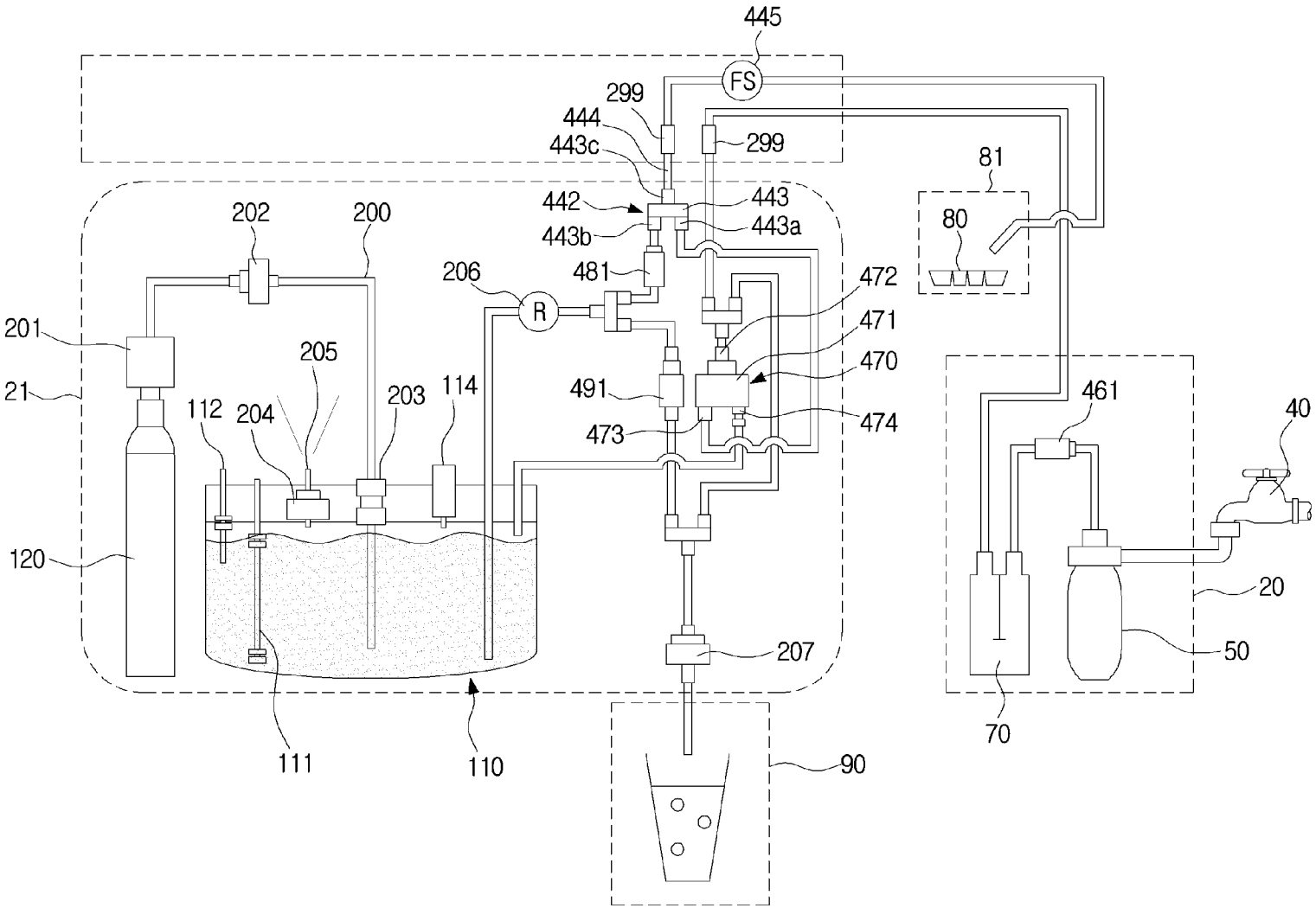
FIG. 23 is a conceptual view of a main configuration of a refrigerator according to a third embodiment of the present disclosure.
Figure 24:
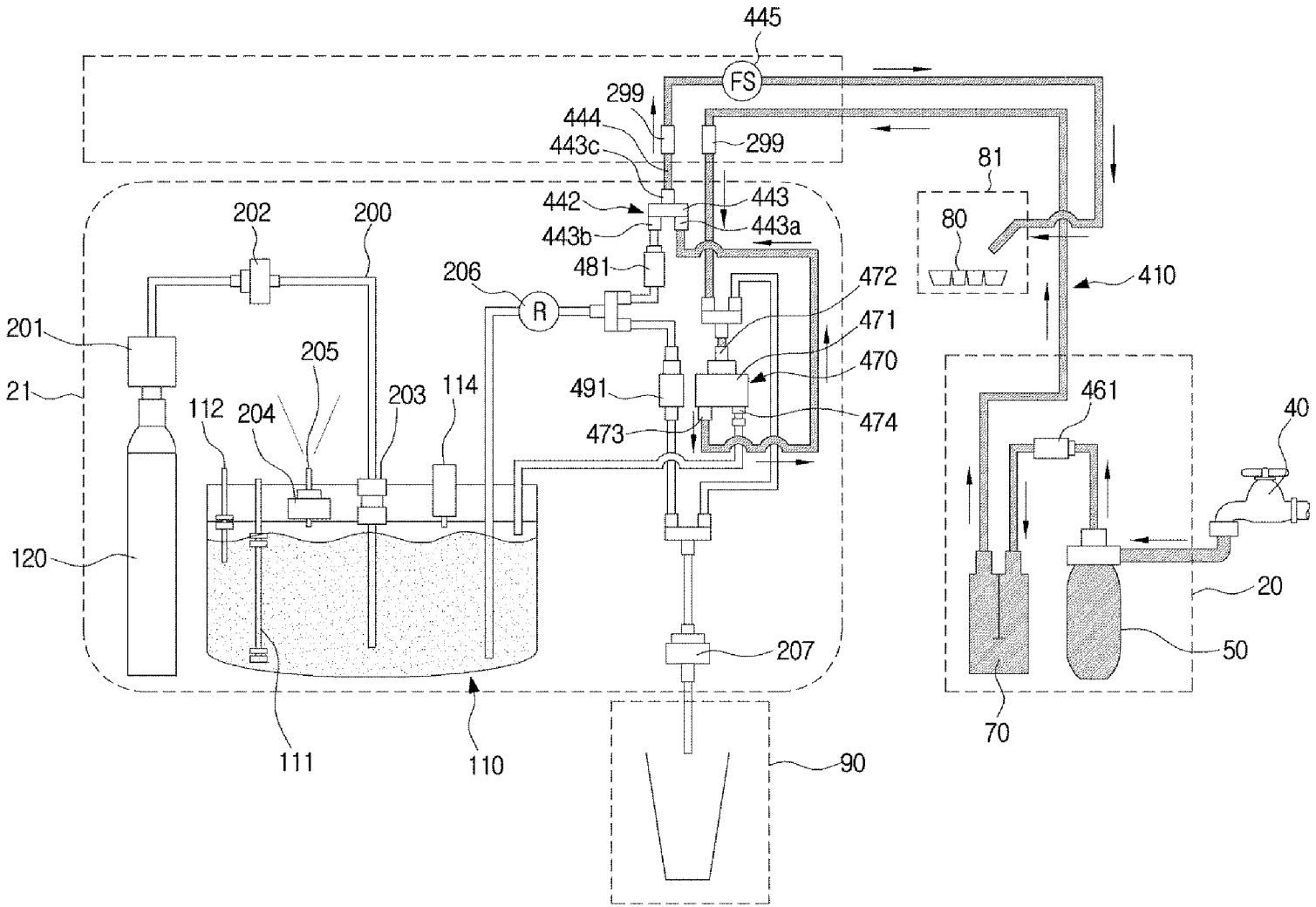
FIG. 24 is a conceptual view of an ice-making general water flow path of the refrigerator of FIG. 23.
Figure 25:
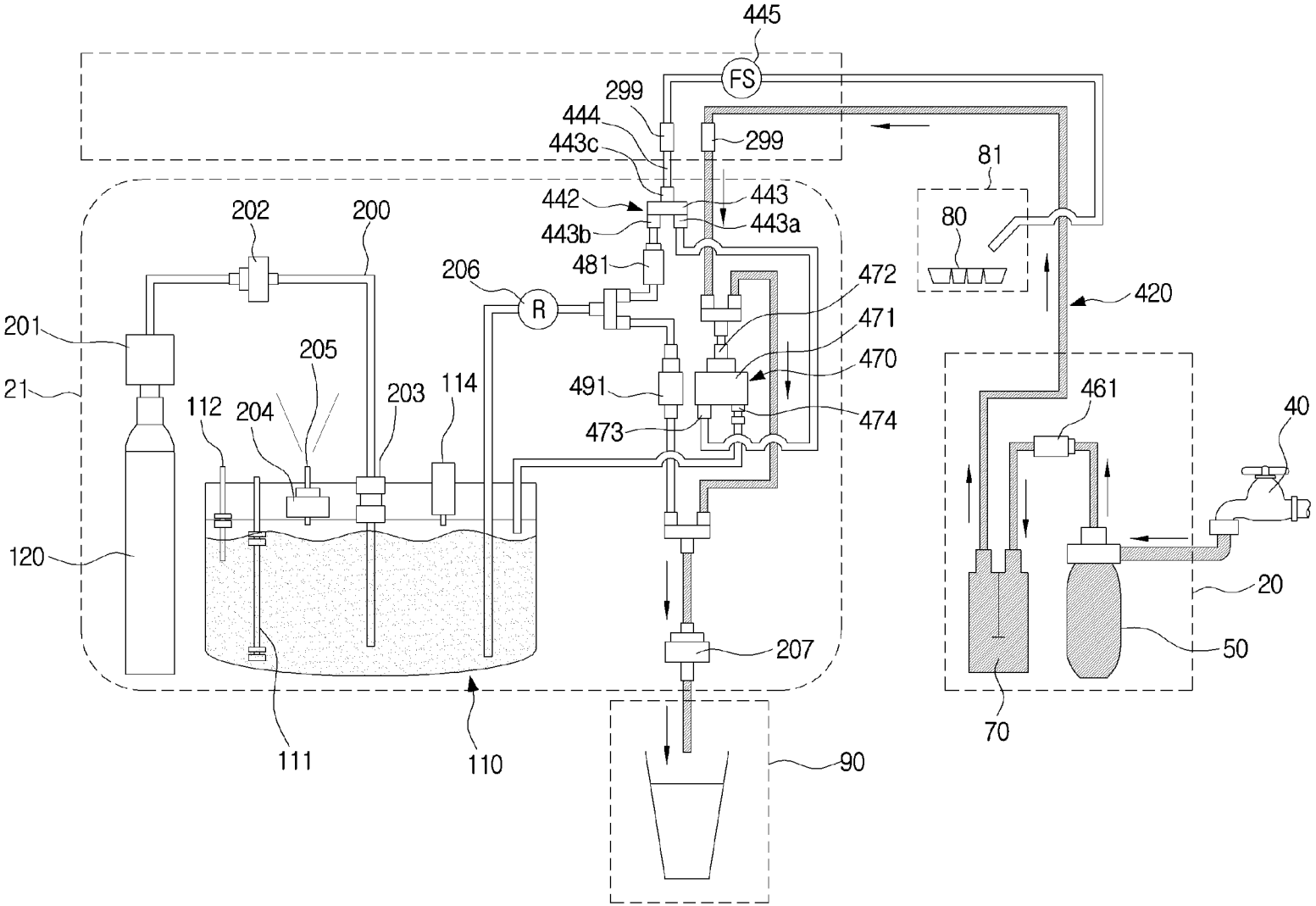
FIG. 25 is a conceptual view of a dispensing general water flow path of the refrigerator of FIG. 23.
Figure 26:
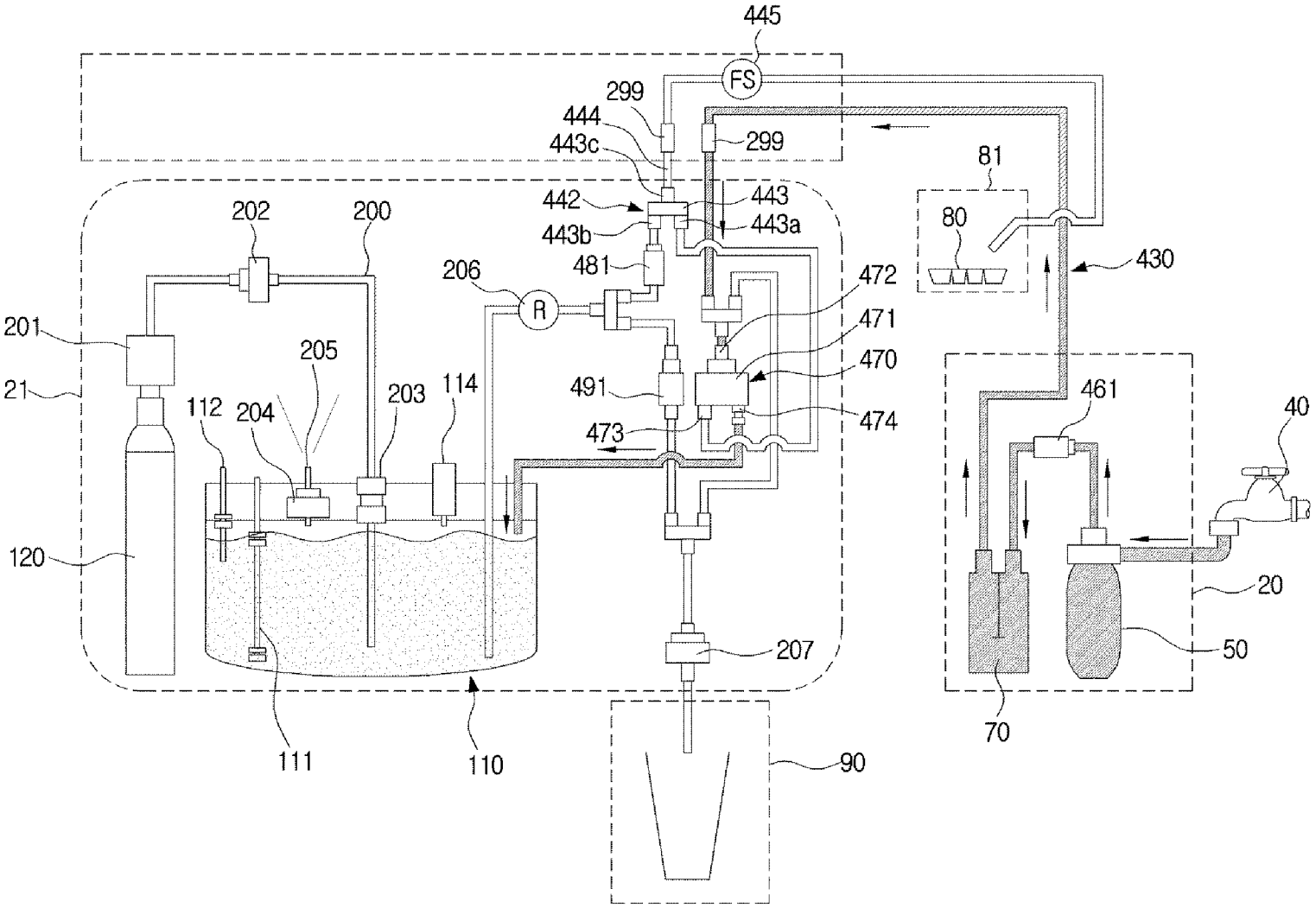
FIG. 26 is a conceptual view of a carbonated water-making general water flow path of the refrigerator of FIG. 23.
Figure 27:
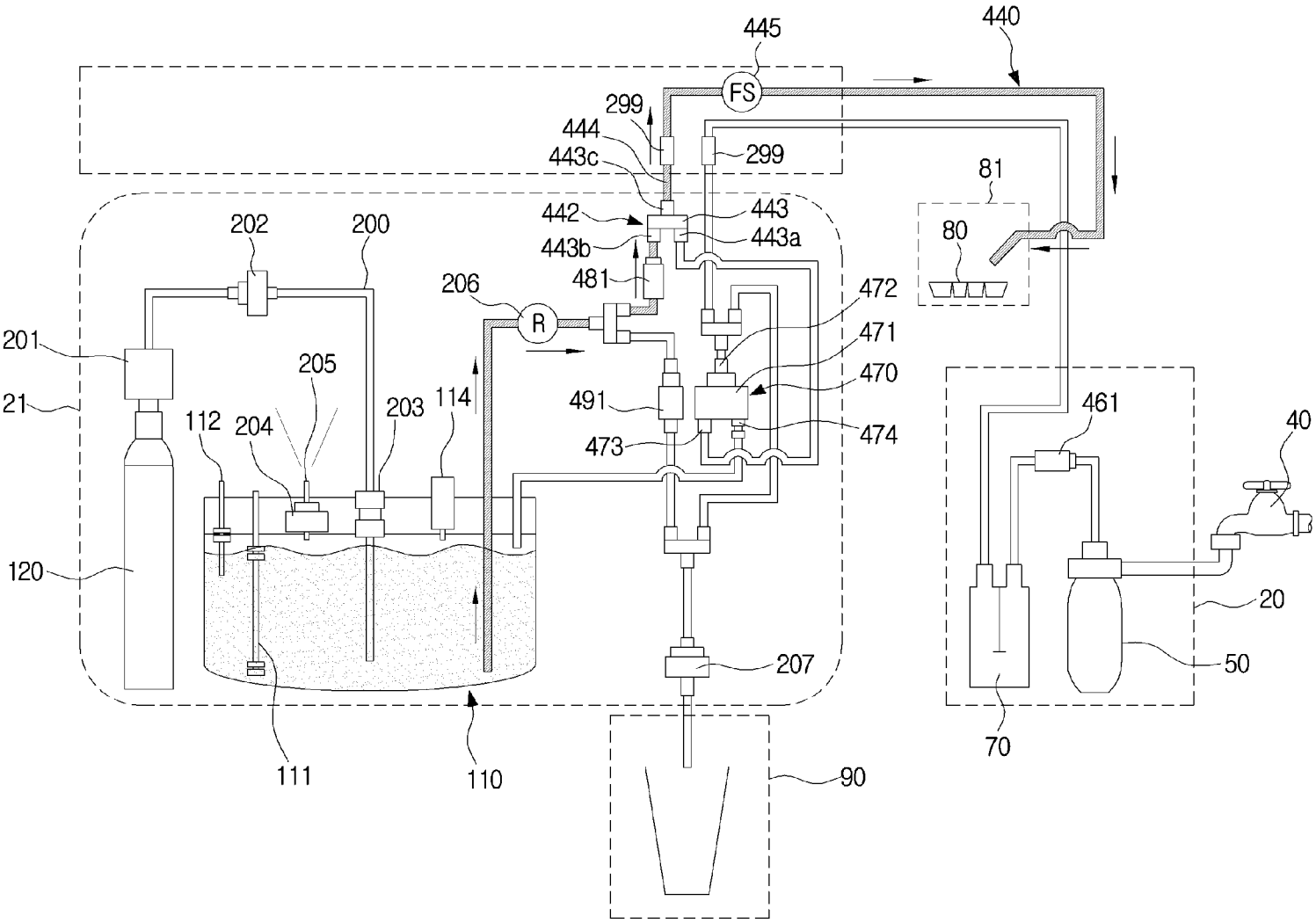
FIG. 27 is a conceptual view of an ice-making carbonated water flow path of the refrigerator of FIG. 23.
Figure 28:
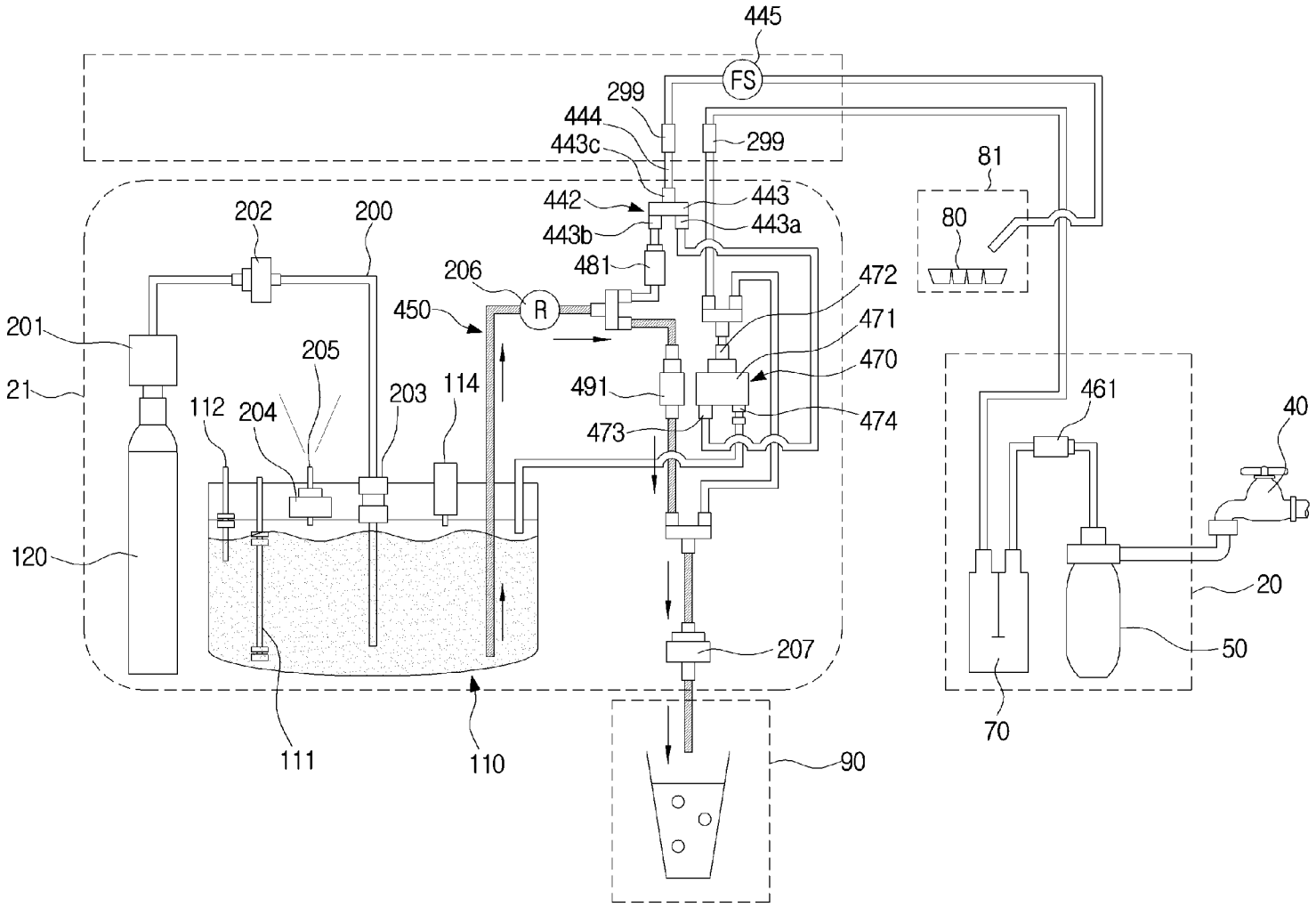
FIG. 28 is a conceptual view of a dispensing carbonated water flow path of the refrigerator of FIG. 23.
Figure 29:
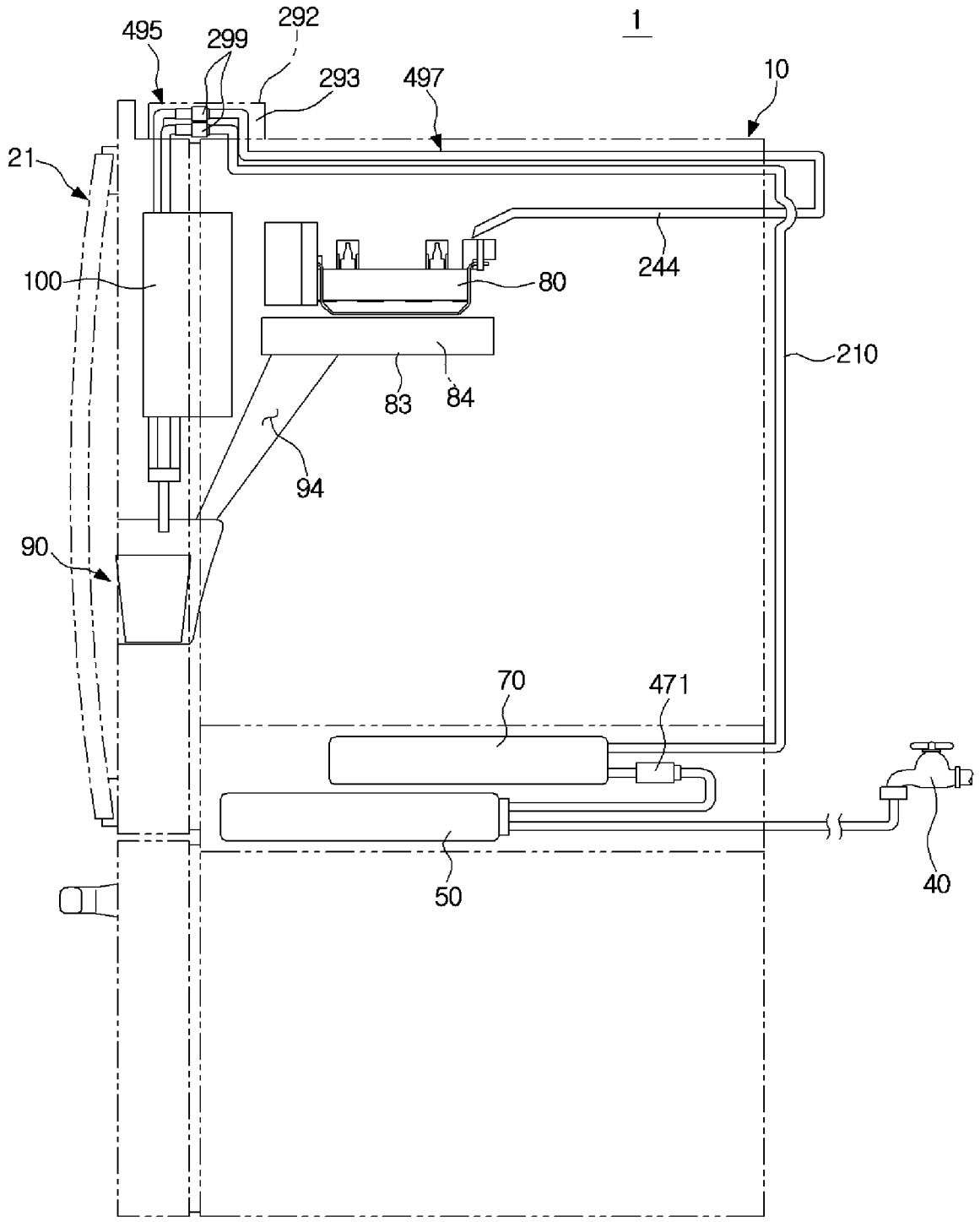
FIG. 29 is a schematic side cross-sectional view of the refrigerator of FIG. 23.

FIG. 23 is a conceptual view of a main configuration of a refrigerator according to a third embodiment of the present disclosure. FIG. 24 is a conceptual view of an ice-making general water flow path of the refrigerator 1 of FIG. 23. FIG. 25 is a conceptual view of a dispensing general water flow path of the refrigerator 1 of FIG. 23. FIG. 26 is a conceptual view of a carbonated water-making general water flow path of the refrigerator of FIG. 23. FIG. 27 is a conceptual view of an ice-making carbonated water flow path of the refrigerator 1 of FIG. 23. FIG. 28 is a conceptual view of a dispensing carbonated water flow path of the refrigerator 1 of FIG. 23. FIG. 29 is a schematic side cross-sectional view of the refrigerator 1 of FIG. 23.

A refrigerator 1 according to a third embodiment of the present disclosure will be described with reference to FIGS. 23 through 29. Like reference numerals are used for the same configuration as the above-described embodiments, and a description thereof will be omitted.

As illustrated in FIG. 24, the refrigerator 1 may include an ice-making general water flow path 410 that connects an external water supply source 40 and an ice-making machine 80 so that general water may be supplied to the ice-making machine 80.

The ice-making general water flow path 410 may be disposed to pass through a water-purifying filter 50. The ice-making general water flow path 410 may be disposed not to pass a mixing tank 110. The ice-making general water flow path 410 may be disposed to pass through a general water tank 70.

As illustrated in FIG. 25, the refrigerator 1 may include a dispensing general water flow path 420 that connects the external water supply source 40 and a dispenser 90 so that general water may be supplied to the dispenser 90.

The dispensing general water flow path 420 may be disposed to pass through the water-purifying filter 50. The dispensing general water flow path 420 may be disposed not to pass through the mixing tank 110. The dispensing general water flow path 420 may be disposed to pass through the general water tank 70.

As illustrated in FIG. 26, the refrigerator 1 may include a carbonated water-making general water flow path 430 that connects the external water supply source 40 and the mixing tank 110 so that general water may be supplied to the mixing tank 110.

The carbonated water-making general water flow path 430 may be disposed to pass through the water-purifying filter 50. The carbonated water-making general water flow path 430 may be disposed to pass through the general water tank 70.

As illustrated in FIG. 27, the refrigerator 1 may include an ice-making carbonated water flow path 440 that connects the mixing tank 110 and the ice-making machine 80 so that carbonated water may be supplied to the ice-making machine 80.

As illustrated in FIG. 28, the refrigerator 1 may include a dispensing carbonated water flow path 450 that connects the mixing tank 110 and the dispenser 90 so that carbonated water may be supplied to the dispenser 90.

A first two-way valve 461 may be disposed on a common flow path of the ice-making general water flow path 410, the dispensing general water flow path 420, and the carbonated water-making general water flow path 430 and may open/close the ice-making general water flow path 410, the dispensing general water flow path 420, and the carbonated water-making general water flow path 430.

The ice-making general water flow path 410 and the carbonated water-making general water flow path 430 may be diverged at a first divergence point 470, and a three-way valve 471 may be disposed at the first divergence point 470 and may open/close the ice-making general water flow path 410 and the carbonated water-making general water flow path 430.

The three-way valve 471 may have an inlet port 472, a first outlet port 473 that opens/closes the ice-making general water flow path 410, and a second outlet port 474 that opens/closes the carbonated water-making general water flow path 430. The first outlet port 473 and the second outlet port 474 may be open/closed independently.

The dispensing general water flow path 420 and the dispensing carbonated water flow path 450 may join at one join point 454 and may form a common flow path 454, and a second two-way valve 207 may be disposed on the common flow path of the dispensing general water flow path 420 and the dispensing carbonated water flow path 450. Here, the second two-way valve 207 may be the remnant water prevention valve 207 in the above-described embodiment.

A third two-way valve 481 may be disposed on the ice-making carbonated water flow path 440 and may open/close the ice-making carbonated water flow path 440.

A fourth two-way valve 491 may be disposed on the dispensing carbonated water flow path 450 and may open/close the dispensing carbonated water flow path 450.

As illustrated in the embodiment of FIG. 24, the ice-making general water flow path 410 and the ice-making carbonated water flow path 440 may join at one join point 442 and may extend as a common flow path 444 up to the ice-making machine 80. The ice-making general water flow path 410 and the ice-making carbonated water flow path 440 may be connected to each other using a Y fitting member 443.

The Y fitting member 443 may have a first inlet port 443*a*, a second inlet port 443*b*, and an outlet port 443*c*. The Y fitting member 443 may prevent water introduced from one of the first and second inlet ports 443*a* and 443*b* from flowing to the other one of the first and second inlet ports 443*a* and 443*b* and may allow water to flow only to the outlet port 443*c*.

One flow sensor 445 may be disposed on the common flow path 444 of the ice-making general water flow path 410 and the ice-making carbonated water flow path 440 and may measure the amount of general water or carbonated water supplied to the ice-making machine 80.

Figure 30:
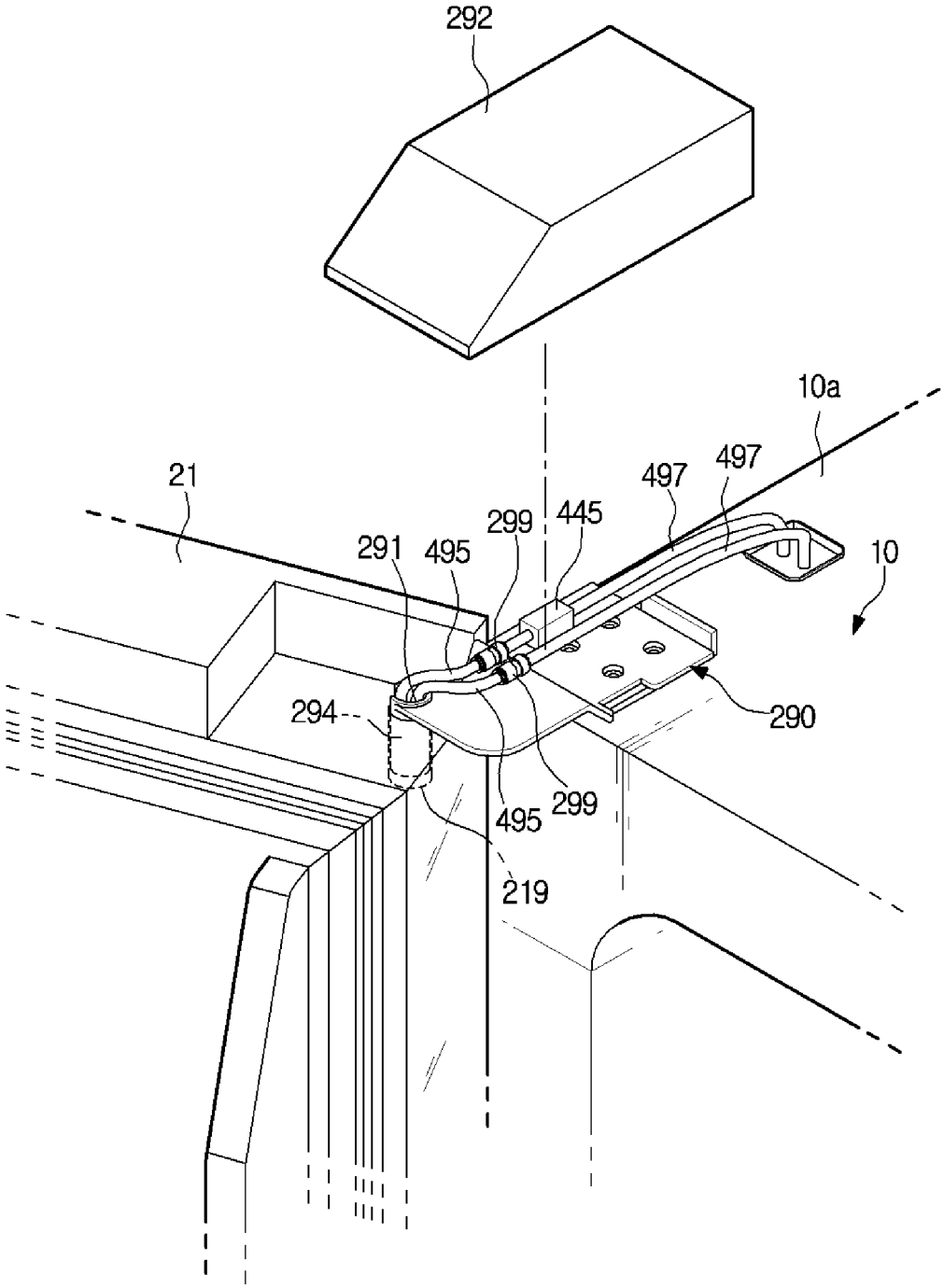
FIG. 30 is a view for describing a structure in which a fitting member and a flow sensor are disposed in a cover member that covers a hinge member, in the refrigerator of FIG. 23.

As illustrated in FIGS. 29 and 30, a door hose 495 and a main body hose 497 may be coupled to each other at an upper side of an outside of a main body 10. The door hose 495 and the main body hose 497 may be coupled to each other using a straight fitting member 299. The fitting member 299 and the flow sensor 445 may be disposed in an internal space 293 of a cover member 292 and may not be exposed to the outside of the refrigerator 1.

Figure 31:
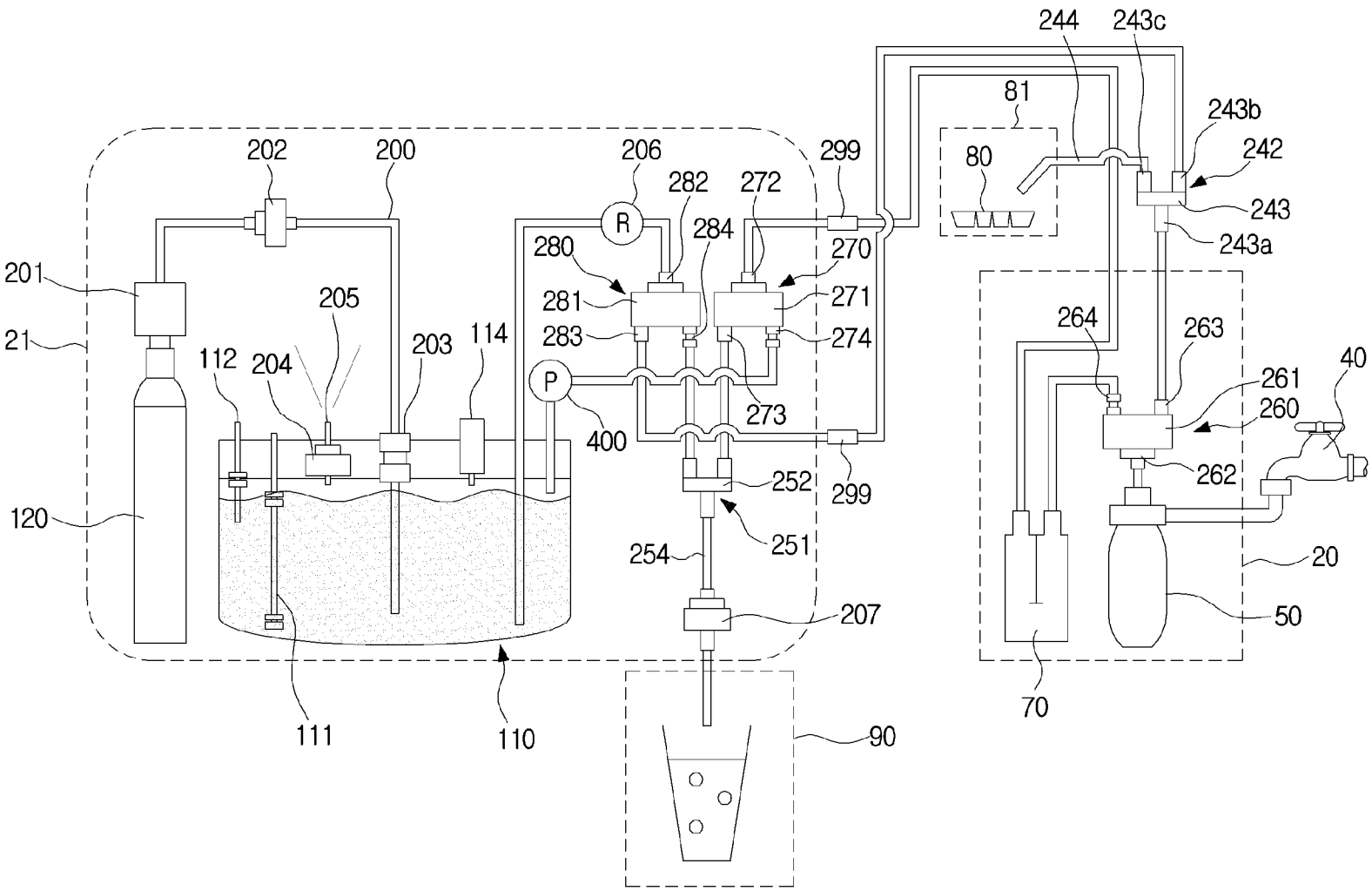
FIG. 31 is a conceptual view of a main configuration of a refrigerator according to a fourth embodiment of the present disclosure.

FIG. 31 is a conceptual view of a main configuration of the refrigerator 1 according to a fourth embodiment of the present disclosure. The refrigerator according to the fourth embodiment of the present disclosure will be described with reference to FIG. 31. Like reference numerals are used for the same configuration as the first embodiment.

The refrigerator according to the first through third embodiments use a $CO_2$ spray technique when making carbonated water. That is, a mixing tank 110 is filled with general water, and high-pressure $CO_2$ is sprayed into the mixing tank 110, and general water and $CO_2$ are mixed with each other in the mixing tank 110. The mixing tank 110 has pressure-resisting characteristics in which the mixing tank 110 withstands a high pressure of $CO_2$.

In the $CO_2$ spray technique, as $CO_2$ is sprayed at a higher pressure, carbonated water may be rapidly made. A manual $CO_2$ spray technique is a technique for making carbonated water more conveniently. In an automatic $CO_2$ spray technique, the number of times of spraying $CO_2$ is controlled so that the concentration of carbonated water may be controlled. That is, the amount of general water and the amount of injecting $CO_2$ may be controlled so that the concentration of carbonated water may be controlled.

The refrigerator according to the fourth embodiment of the present disclosure uses not the $CO_2$ spray technique but a water spray technique. That is, in the water spray technique, general water is sprayed into the mixing tank 110 in which $CO_2$ is present. To this end, the refrigerator 1 has a water pump 400 that sprays general water at a higher pressure than pressure of $CO_2$. The technique for spraying general water using the water pump 400 has the advantage of rapidly making high-concentration carbonated water compared to the technique for spraying $CO_2$.

Figure 32:
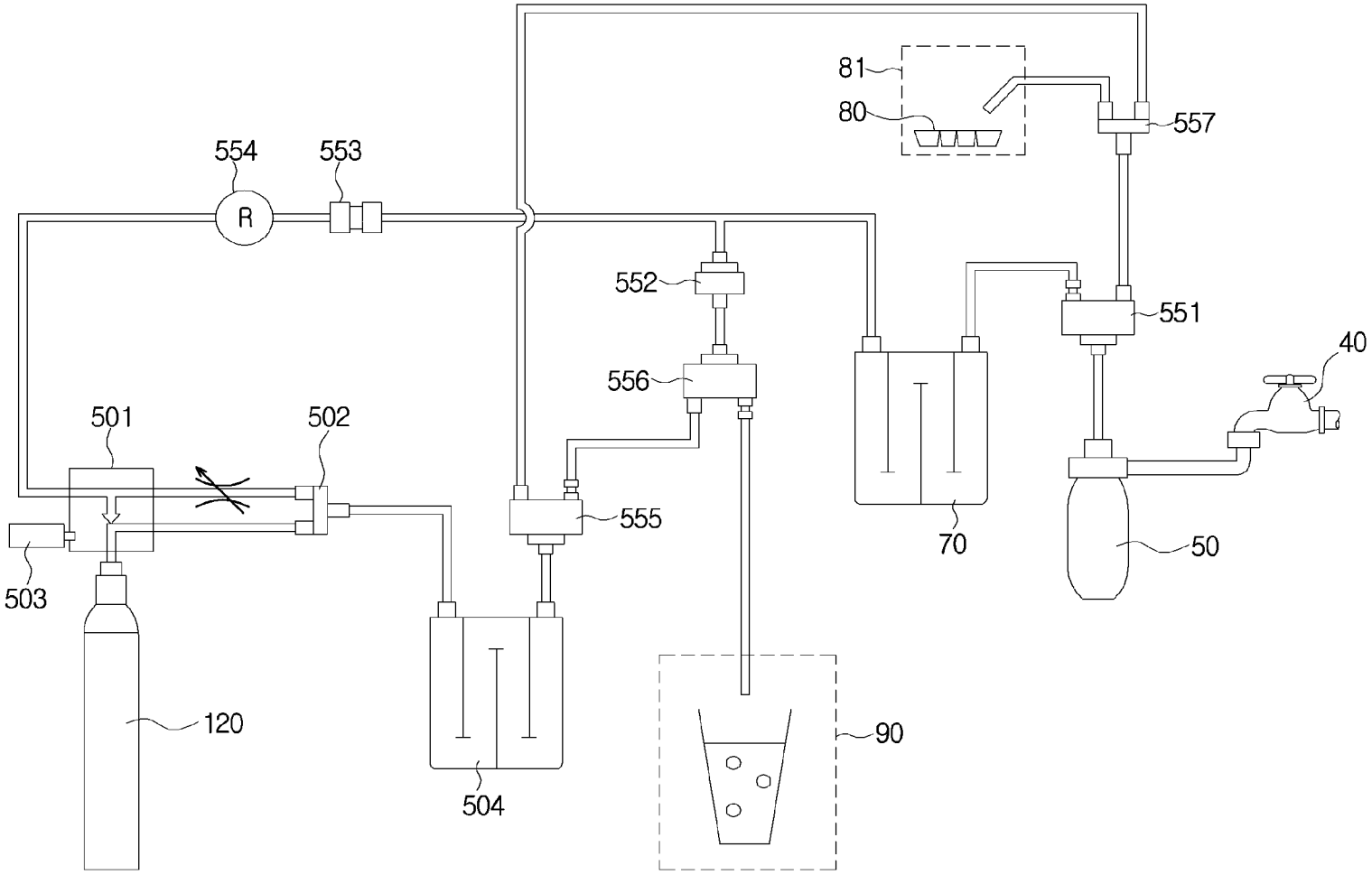
FIG. 32 is a conceptual view of a main configuration of a refrigerator according to a fifth embodiment of the present disclosure.
Figure 33:
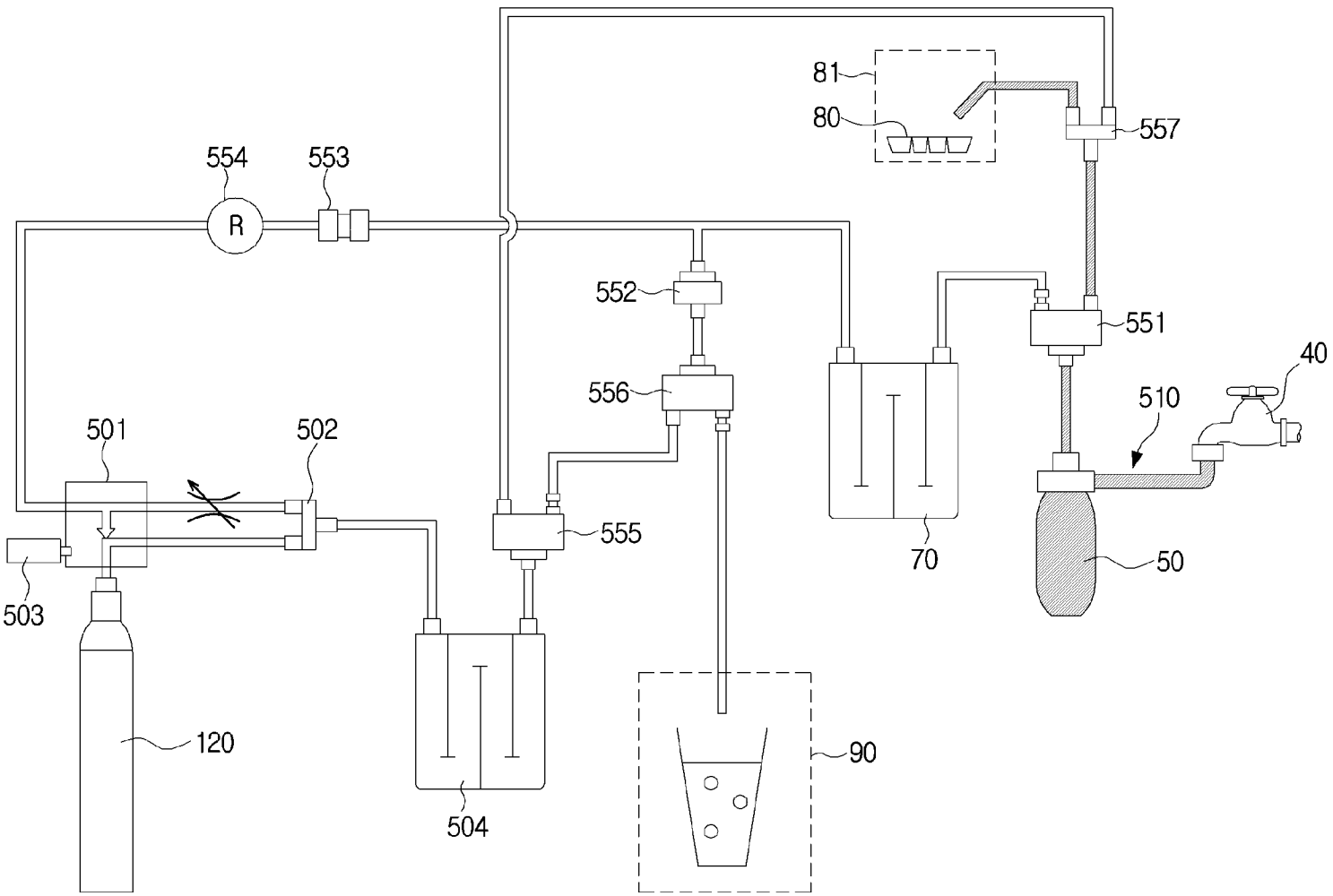
FIG. 33 is a conceptual view of an ice-making general water flow path of the refrigerator of FIG. 32.
Figure 34:
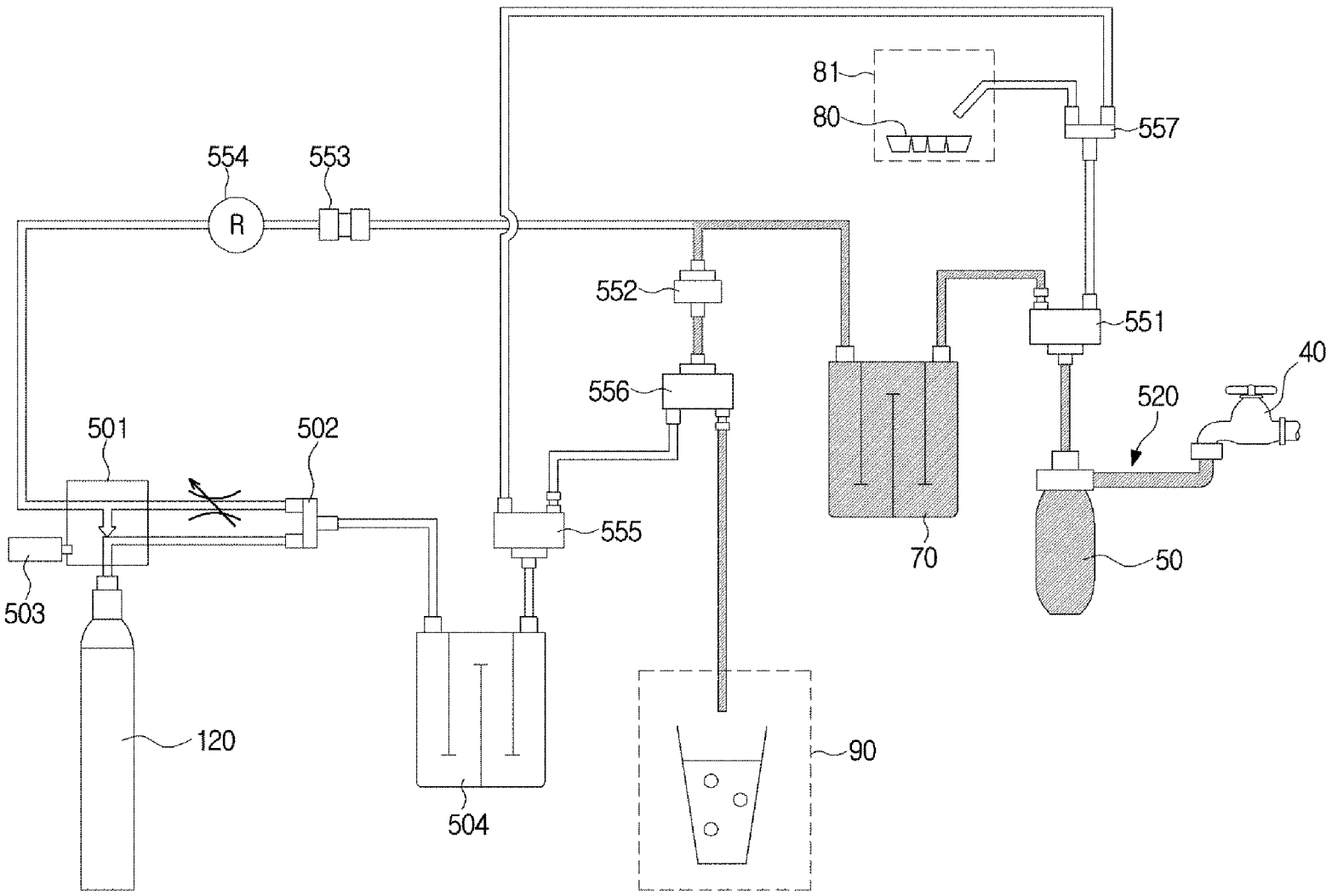
FIG. 34 is a conceptual view of a dispensing general water flow path of the refrigerator of FIG. 32.
Figure 35:
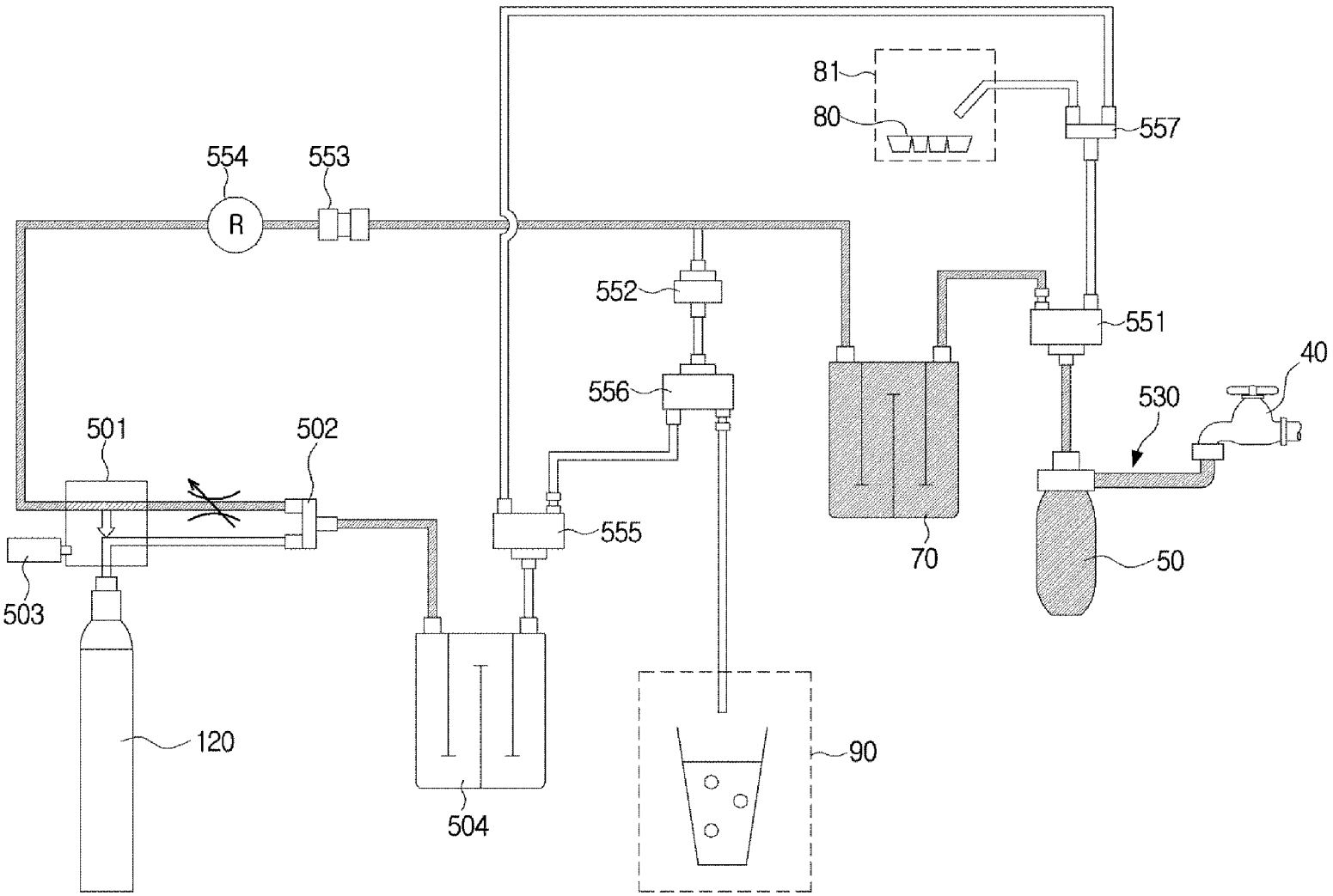
FIG. 35 is a conceptual view of a carbonated water-making general water flow path of the refrigerator of FIG. 32.
Figure 36:
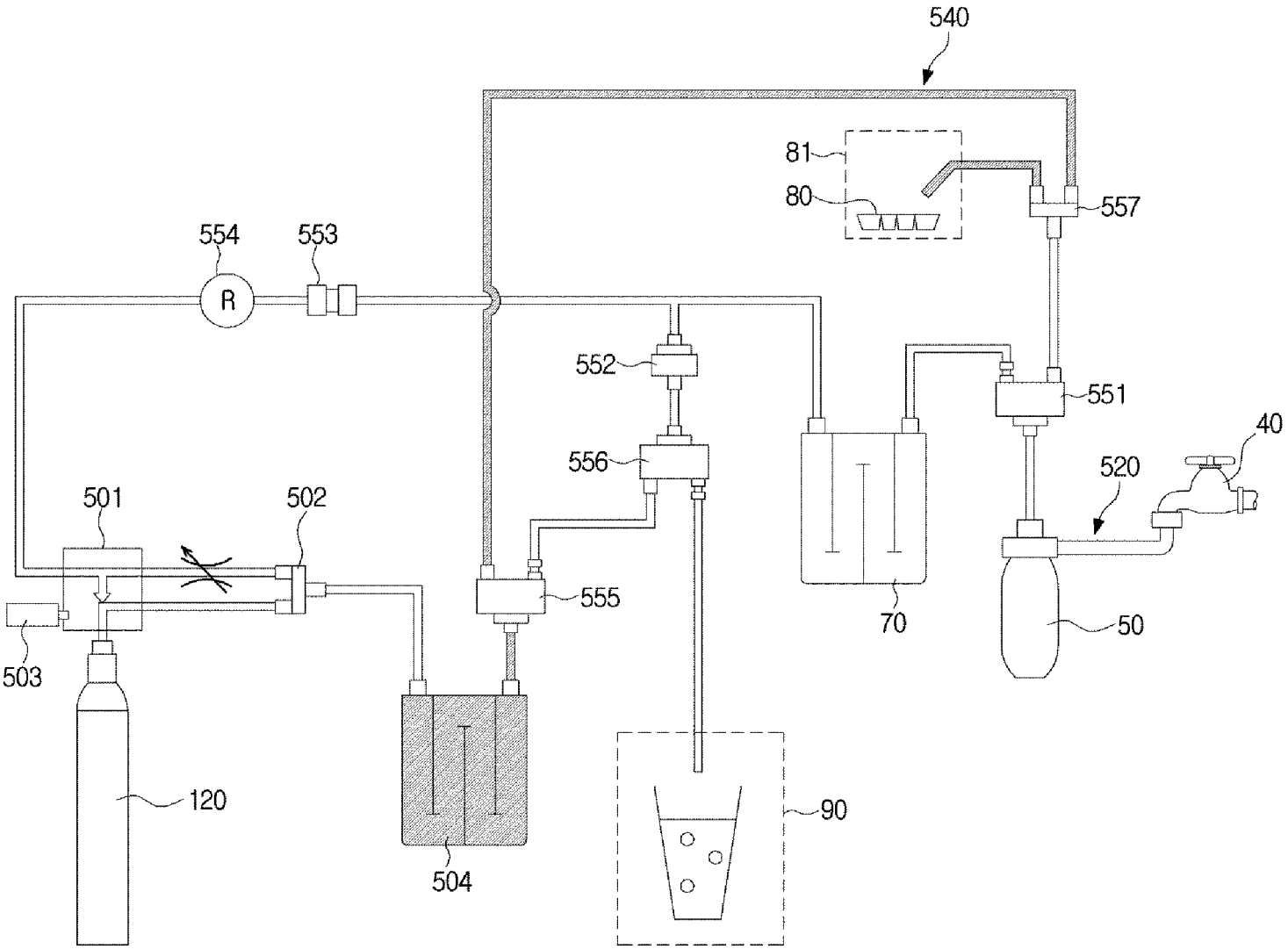
FIG. 36 is a conceptual view of an ice-making carbonated water flow path of the refrigerator of FIG. 32.
Figure 37:
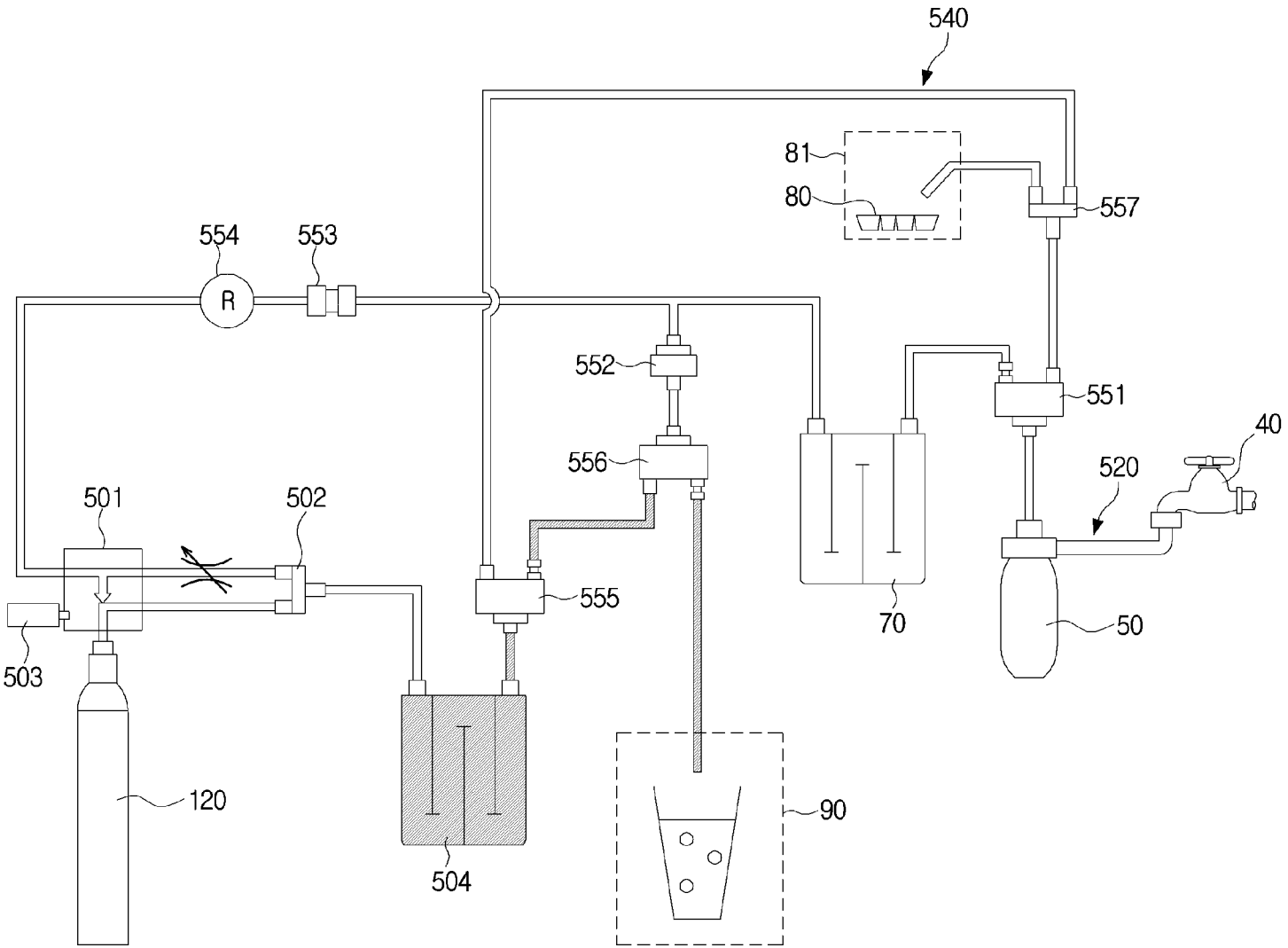
FIG. 37 is a conceptual view of a dispensing carbonated water flow path of the refrigerator of FIG. 32.

FIG. 32 is a conceptual view of a main configuration of a refrigerator according to a fifth embodiment of the present disclosure. FIG. 33 is a conceptual view of an ice-making general water flow path of the refrigerator 1 of FIG. 32. FIG. 34 is a conceptual view of a dispensing general water flow path of the refrigerator 1 of FIG. 32. FIG. 35 is a conceptual view of a carbonated water-making general water flow path of the refrigerator 1 of FIG. 32. FIG. 36 is a conceptual view of an ice-making carbonated water flow path of the refrigerator 1 of FIG. 32. FIG. 37 is a conceptual view of a dispensing carbonated water flow path of the refrigerator 1 of FIG. 32.

A refrigerator 1 according to a fifth embodiment of the present disclosure will described with reference to FIGS. 32 through 37. Like reference numerals are used for the same configuration as the above-described embodiments.

In the first through third embodiments, a $CO_2$ spray technique is used as a technique for making carbonated water, and in the fourth embodiment, a general water spray technique is used. However, in the fifth embodiment, a continuous making technique is used.

The continuous making technique is a technique in which general water and $CO_2$ are simultaneously mixed with each other at the same pressure. Since the pressure of general water is generally low, general water and $CO_2$ are mixed with each other at a low pressure. Thus, it may take long to stabilize the mixture. However, the continuous making technique may have a simple structure.

As illustrated in FIG. 32, the refrigerator 1 includes a water-purifying filter 50 that purifies general water, a general water tank 70 in which general water supplied from an external water supply source 40 is stored, a $CO_2$ gas cylinder 120 in which a $CO_2$ gas is stored, a pressure operation valve 501 that sprays the $CO_2$ gas and general water at the same pressure, a mixing valve 502 that mixes the $CO_2$ gas and general water sprayed by the pressure operation valve 501 at the same pressure to make carbonated water, a carbonated water tank 504 in which carbonated water is stored, a dispenser 90 that provides general water or carbonated water to the outside of the refrigerator 1, and an ice-making machine 80 that makes general ice or carbonated ice.

The refrigerator 1 may include an ice-making general water flow path (see 510 of FIG. 33) that provides general water to the ice-making machine 80, a dispensing general water flow path (see 520 of FIG. 34) that provides general water to the dispenser 90, a carbonated water-making general water flow path (see 530 of FIG. 35) that provides general water to the pressure operation valve 501, an ice-making carbonated water flow path 540 that provides carbonated water to the ice-making machine 80, and a dispensing carbonated water flow path 550 that provides carbonated water to the dispenser 90.

The ice-making general water flow path (see 510 of FIG. 33) does not pass through the mixing valve 502 and the carbonated water tank 504. Thus, only general water except for carbonated water regardless of whether carbonated water is stored in the carbonated water tank 504, may be supplied to the ice-making machine 80.

The dispensing general water flow path (see 520 of FIG. 34) does not pass through the mixing valve 502 and the carbonated water tank 504. Thus, only general water, without except for carbonated water regardless of whether carbonated water is stored in the carbonated water tank 504, may be supplied to the ice-making machine 80.

Reference numeral 503 is a safety valve, and reference numerals 551, 555, and 556 are three-way valves for switching a flow path, and reference numerals 552 and 553 are two-way valves.

Figure 38:
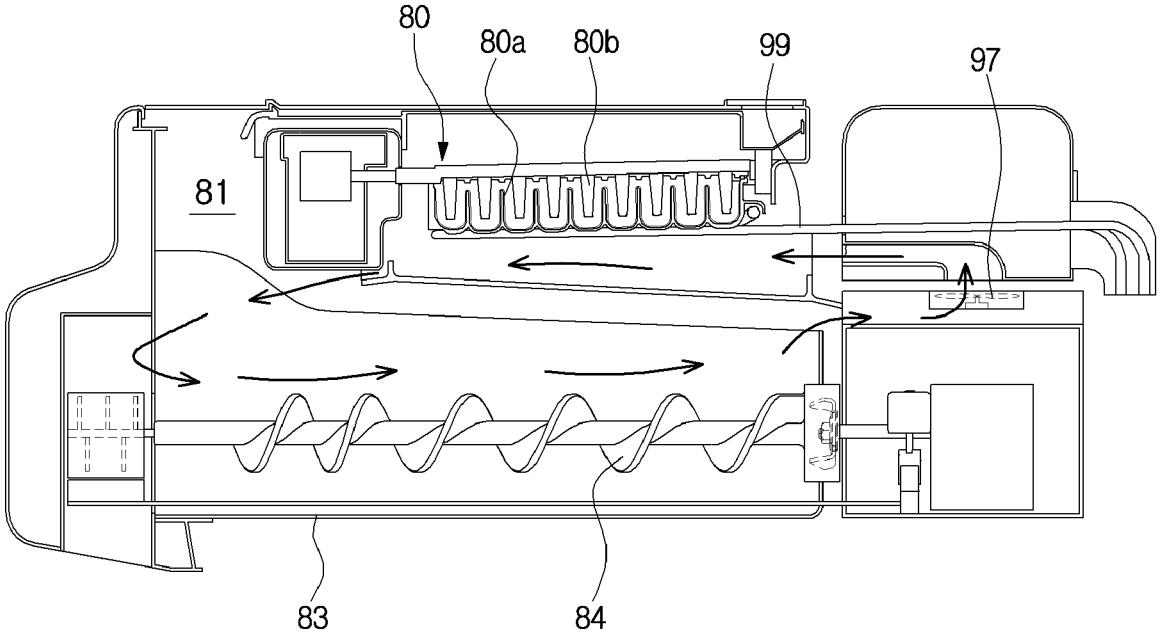
FIG. 38 is a view of a structure of an ice-making compartment and an ice-making machine according to an embodiment of the present disclosure.
Figure 39:
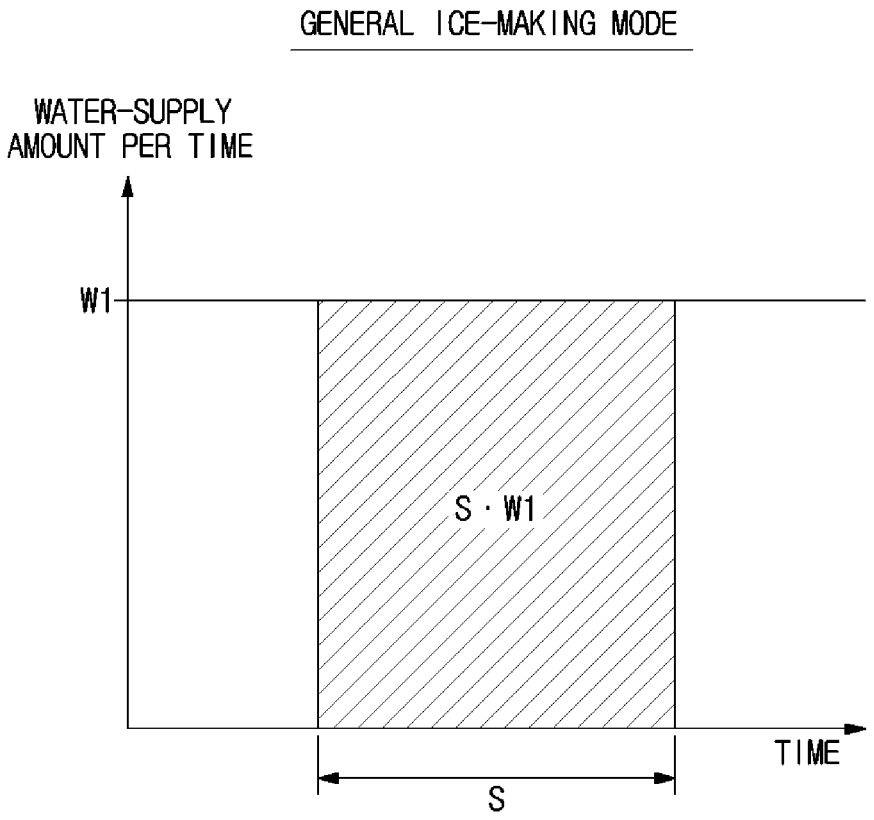
FIGS. 39 and 40 are views for comparing the amount of water supplied to an ice-making tray in a general ice-making mode and a carbonated ice-making mode of a refrigerator according to an embodiment of the present disclosure.
Figure 40:
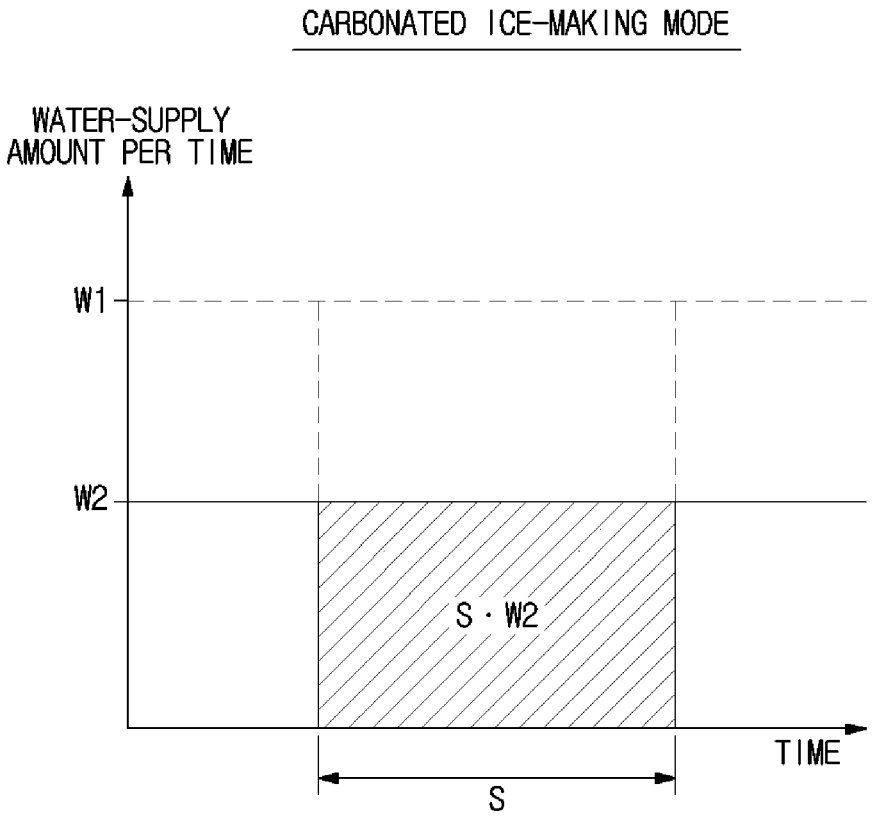

FIG. 38 is a view of a structure of an ice-making compartment 81 and an ice-making machine 80 according to an embodiment of the present disclosure. FIGS. 39 and 40 are views for comparing the amount of water supplied to an ice-making tray 80*a* in a general ice-making mode and a carbonated ice-making mode of a refrigerator 1 according to an embodiment of the present disclosure.

An ice-making machine 80 may be disposed in an ice-making compartment 81. The ice-making compartment 81 may be formed to be partitioned by a separate ice-making compartment wall 82 (see FIG. 2) inside a refrigerator compartment 20, as in the current embodiment. However, unlike this embodiment, the ice-making compartment 81 may also be formed in a freezer compartment.

The ice-making machine 80 may include an ice-making tray 80*a* to which general water or carbonated water is supplied, and an ejector 80*b* that separates general ice or carbonated ice generated in the ice-making tray 80*a* from the ice-making tray 80*a* and drops the general ice or carbonated ice into an ice bucket 83.

A refrigerant pipe 99 that allows a refrigerant to flow and supplies cooling energy into the ice-making tray 80*a* and the ice-making compartment 81, may contact the ice-making tray 80*a*. That is, the ice-making machine 80 according to an embodiment of the present disclosure may be cooled through a direct cooling technique. However, unlike in the current embodiment, an indirect cooling technique, whereby cold air generated in a separate cooling compartment is supplied into the ice-making compartment 81 via a duct, may also be used.

An ice-separating heater (not shown) may be disposed in the ice-making tray 80*a* to heat the ice-making tray 80*a* during ice separation so that ice separation may be smoothly performed. A blower fan 97 that circulates air inside the ice-making compartment 81 may be disposed in the ice-making compartment 81.

A cooling device that supplies cooling energy into the ice-making compartment 81 and the ice-making tray 80*a* may include a freezing cycle device including a compressor, a condenser, an expansion valve, an evaporator, and a refrigerant pipe 99, and the blower fan 97 that allows air to flow.

The refrigerator 1 according to an embodiment of the present disclosure has a general ice-making mode in which general ice is made, and a carbonated ice-making mode in which carbonated ice is made. In the general ice-making mode, general water is supplied into the ice-making tray

80*a*, and in the carbonated ice-making mode, carbonated water is supplied into the ice-making tray 80*a*.

The general ice-making mode and the carbonated ice-making mode commonly include an ice-making compartment cooling operation of cooling the ice-making compartment 81, a water-supplying operation of supplying water into the ice-making tray 80*a*, an ice-making operation of making ice by cooling the ice-making tray 80*a*, and an ice-separating operation of separating ice in the ice-making tray 80*a* from the ice-making tray 80*a*.

After the ice-separating operation, the general ice-making mode and the carbonated ice-making mode may further include a full ice detecting operation of determining whether the ice bucket 83 is fully filled with ice. If it is determined that the ice bucket 83 is not fully filled with ice, a series of operations may be repeatedly performed again.

In the current embodiment, the ice-making operation may include a water-supplying operation. That is, at an initial stage of the ice-making operation, water supply may be performed.

In this way, the general ice-making mode and the carbonated ice-making mode commonly include an ice-making compartment cooling operation, a water-supplying operation, an ice-making operation and an ice-separating operation. Since characteristics of general ice and carbonated ice are different from each other, a controlling method in each of the operations may be changed.

In one example, according to an embodiment of the present disclosure, the amount of water supplied into the ice-making tray 80*a* in the water-supplying operation of the general ice-making mode and the amount of water supplied into the ice-making tray 80*a* in the water-supplying operation of the carbonated ice-making mode may be different from each other.

As illustrated in FIGS. 39 and 40, when the amount of water supply of general water supplied into the ice-making tray 80*a* in the water-supplying operation of the general ice-making mode is S*W1, the amount of water supply of carbonated water supplied into the ice-making tray 80*a* in the water-supplying operation of the carbonated ice-making mode may be S*W2 (W1>W2). That is, the amount of water supply of carbonated water supplied into the ice-making tray 80*a* in the water-supplying operation of the carbonated ice-making mode may be smaller than the amount of water supply of general water supplied into the ice-making tray 80*a* in the water-supplying operation of the general ice-making mode. This is because, when the same amount of water is cooled, the volume of carbonated ice is increased due to a $CO_2$ gas contained in carbonated water compared to the volume of general ice.

In this way, as a method of adjusting the amount of water supply, as illustrated in FIGS. 39 and 40, a time S for performing the water-supplying operation may be set to be the same, while the amount of water supply per unit time may be changed. However, unlike this embodiment, the amount of water supply per time may be set to be the same, while the time S for performing the water-supplying operation may be set to be different.

Figure 41:
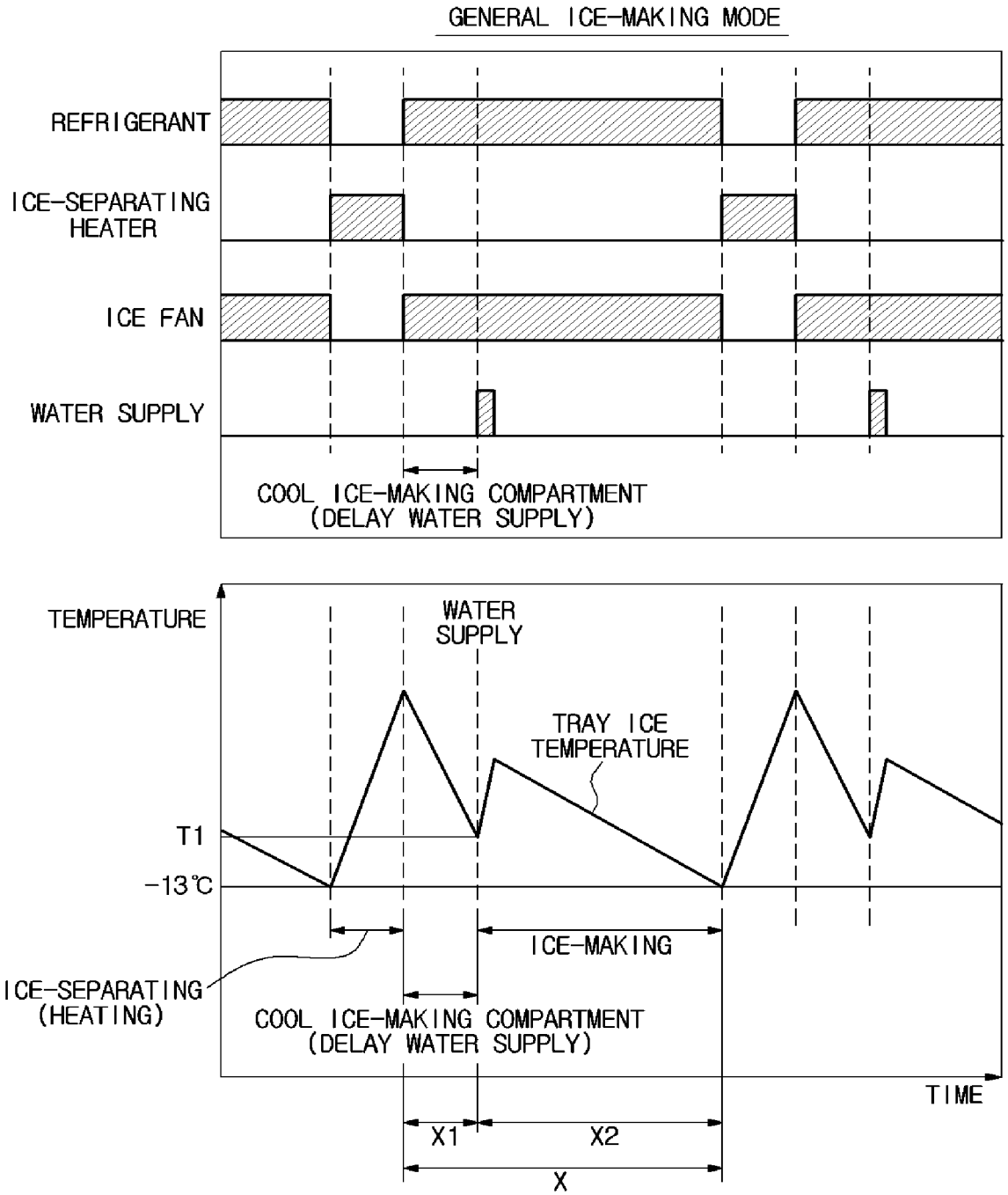
FIGS. 41 and 42 are views for comparing the temperature of an ice-making compartment at an initial stage of an ice-making operation in the general ice-making mode and the carbonated ice-making mode of the refrigerator according to an embodiment of the present disclosure.
Figure 42:
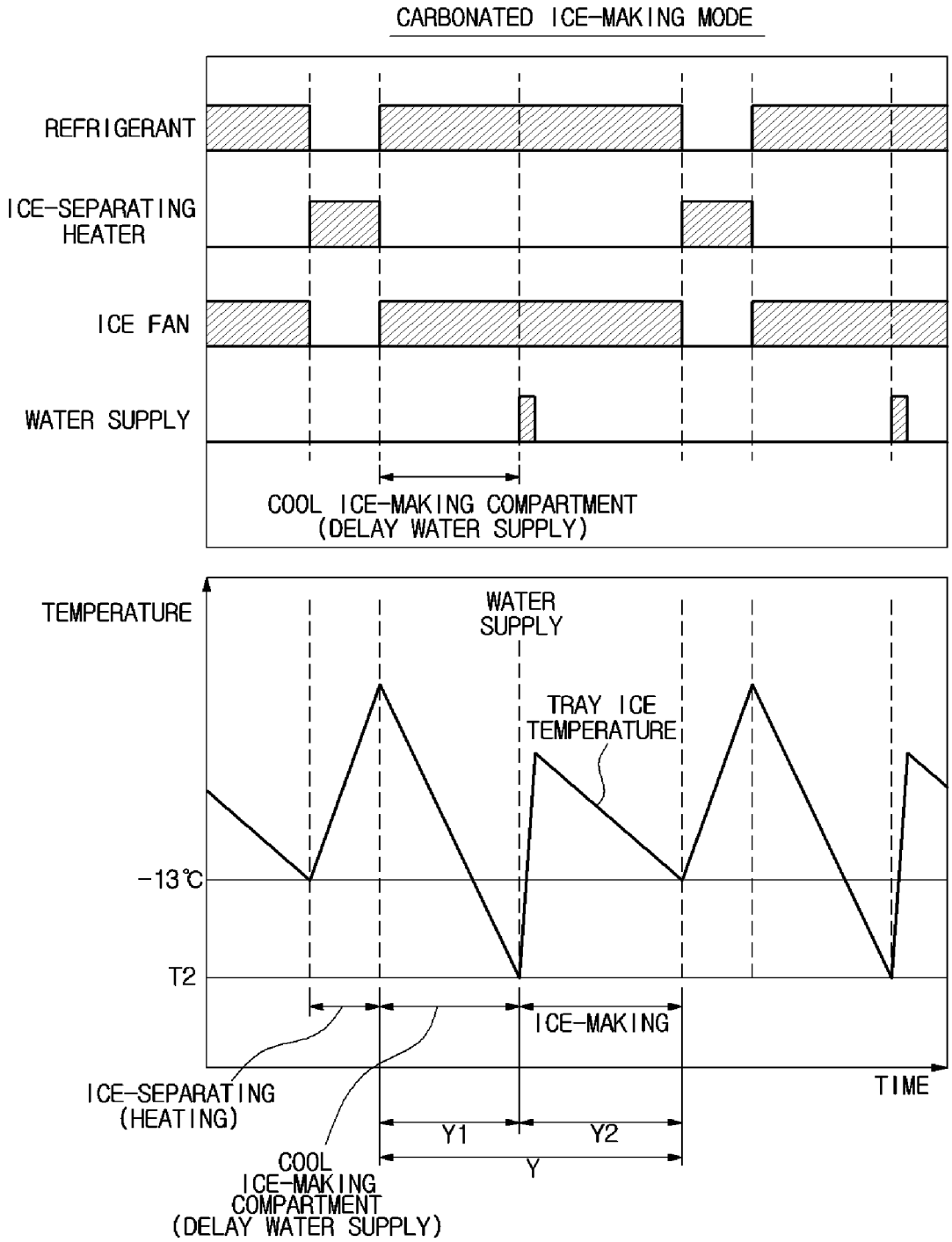
Figure 43:
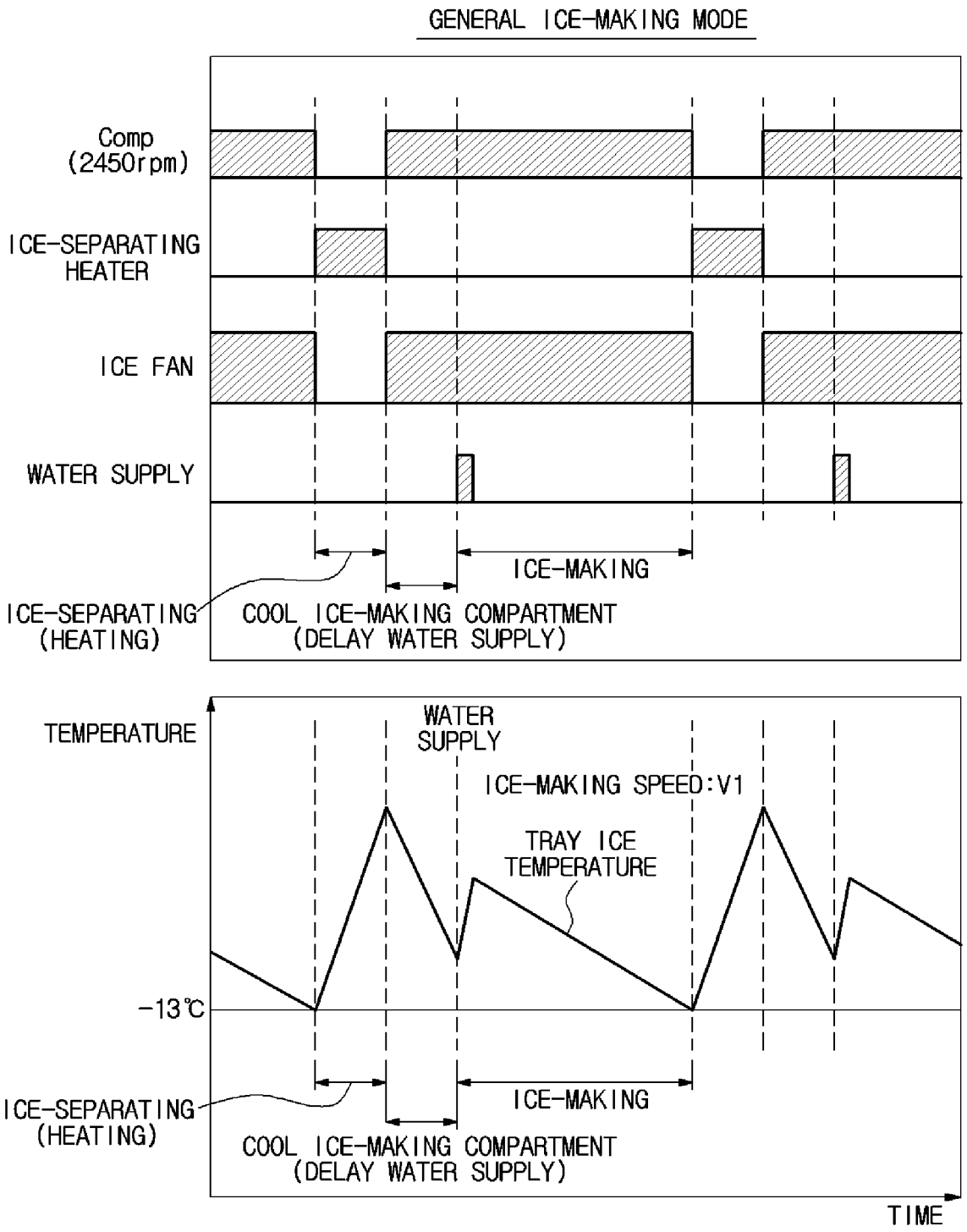
FIGS. 43 and 44 are views for comparing ice-making speed of the ice-making operation in the general ice-making mode and the carbonated ice-making mode of the refrigerator according to an embodiment of the present disclosure.
Figure 44:
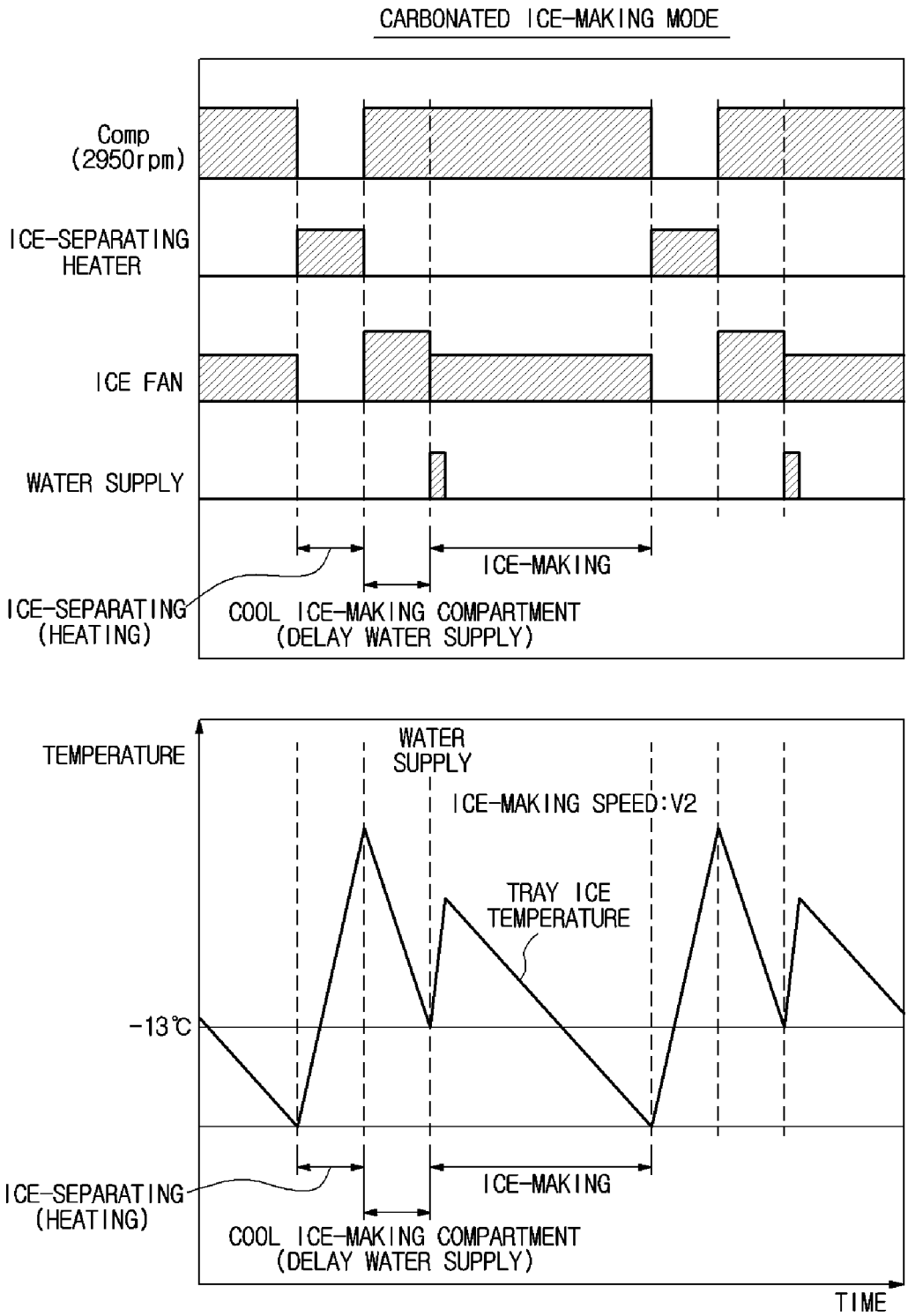

FIGS. 41 and 42 are views for comparing the temperature of an ice-making compartment at an initial stage of an ice-making operation in the general ice-making mode and the carbonated ice-making mode of the refrigerator 1 according to an embodiment of the present disclosure, and FIGS. 43 and 44 are views for comparing ice-making speed of the ice-making operation in the general ice-making mode and the carbonated ice-making mode of the refrigerator 1 according to an embodiment of the present disclosure.

A method of making high-concentration carbonated ice in a carbonated ice-making mode according to an embodiment of the present disclosure will be described with reference to FIGS. 41 through 44. The method of making high-concentration carbonated ice includes a method of lowering temperature of an ice-making compartment 81 at an initial stage of an ice-making operation. This is to increase solubility of $CO_2$ according to the Henry's law.

As illustrated in FIGS. 41 and 42, when the temperature of the ice-making compartment 81 at the initial stage of the ice-making operation of the general ice-making mode is T1, the temperature of the ice-making compartment 81 at the initial stage of the ice-making operation of the carbonated ice-making mode may be T2 (T1>T2).

This may be achieved when a time for performing an ice-making compartment cooling operation is increased in the carbonated ice-making mode than in the general ice-making mode. That is, when the time for performing the ice-making compartment cooling operation in the general ice-making mode is X1 and the time for performing the ice-making compartment cooling operation in the carbonated ice-making mode is Y1, the relationship X1<Y1 is established.

Here, when the entire cooling time (the sum of the time for performing the ice-making compartment cooling operation and the time for performing the ice-making operation) in the general ice-making mode and the entire cooling time in the carbonated ice-making mode are the same, an ice-making time X2 in the general ice-making mode and an ice-making time Y2 in the carbonated ice-making mode may satisfy the relationship X2>Y2 in reverse. Another method of making high-concentration carbonated ice includes a method of increasing an ice-making speed in an ice-making operation. This is because, as the ice-making speed is increased, a loss of $CO_2$ may be prevented as much as the ice-making speed.

As illustrated in FIGS. 43 and 44, when the ice-making speed in the ice-making operation in the general ice-making mode is V1 and the ice-making speed in the ice-making operation in the carbonated ice-making mode is V2, the relationship V1<V2 may be established. In this way, in an inverter compressor that is capable of adjusting rotation speed to increase the ice-making speed in the carbonated ice-making mode, the rotation speed of the compressor may be increased. In one example, when revolutions per minute (RPM) of the compressor in the general ice-making mode is 2450 RPM of the compressor in the carbonated ice-making mode may be increased to 2950 RPM. In order to increase the ice-making speed, the rotation speed of the blower fan 97 of the ice-making compartment 81 may also be properly adjusted.

Still another method of making high-concentration carbonated ice may include a method of increasing concentration of carbonated water substantially. That is, when a mode in which only carbonated water is made for the purpose of supplying carbonated water to the dispenser 90, is referred to as a carbonated water mode and a mode in which carbonated ice is made, is referred to as a carbonated ice mode, a larger amount of $CO_2$ in the carbonated ice mode than in the carbonated water mode may be injected into the mixing tank 110.

Since $CO_2$ is injected into the mixing tank 110 at regular intervals with a predetermined number of times, an injection interval may be reduced, or the number of times of injection may be increased so that the amount of injection may be increased.

According to the spirit of the present disclosure, a refrigerator can also make carbonated ice. The refrigerator 1 can supply the made carbonated ice to a user through a dispenser.

Additionally, according to the spirit of the present disclosure, the refrigerator 1 can make general ice or carbonated ice and can supply the general ice or carbonated ice to the user through the dispenser. A phenomenon in which carbonated ice is large when the carbonated ice is made so that ice separation is not smoothly performed or ice is caught on a component can be prevented and thus reliability of the supply of carbonated ice can be improved. A higher-concentration carbonated ice can be made.

Although a few embodiments of the present disclosure have been shown and described, it would be appreciated by those skilled in the art that changes may be made in these embodiments without departing from the principles and spirit of the invention, the scope of which is defined in the claims and their equivalents.

The invention claimed is:

1. A refrigerator comprising a mixing tank in which carbon dioxide ($CO_2$) and general water are mixed with each other so that carbonated water is made, and an ice-making machine, the refrigerator further comprising:

an ice-making general water flow path that connects an external water supply source and the ice-making machine so that general water is supplied to the ice-making machine, the ice-making general water flow path being disposed not to pass through the mixing tank;

a carbonated water-making general water flow path that connects the external water supply source and the mixing tank so that general water is supplied to the mixing tank;

an ice-making carbonated water flow path that connects the mixing tank and the ice-making machine so that carbonated water is supplied to the ice-making machine;

a dispenser;

a dispensing general water flow path that connects the external water supply source and the dispenser so that general water is supplied to the dispenser; and a dispensing carbonated water flow path that connects the mixing tank and the dispenser so that carbonated water is supplied to the dispenser, wherein the ice-making general water flow path is diverged from the dispensing general water flow path and the carbonated water-making general water flow path at a first divergence point, and wherein a first three-way valve is disposed at the first divergence point and opens/closes the ice-making general water flow path, the dispensing general water flow path, and the carbonated water-making general water flow path.

2. The refrigerator of claim 1, wherein the dispensing general water flow path and the carbonated water-making general water flow path are diverged at a second divergence point, and a second three-way valve is disposed at the second divergence point and opens/closes the dispensing general water flow path and the carbonated water-making general water flow path.

3. The refrigerator of claim 2, wherein the ice-making carbonated water flow path and the dispensing carbonated water flow path are diverged at a third divergence point, and a third three-way valve is disposed at the third divergence point and opens/closes the ice-making carbonated water flow path and the dispensing carbonated water flow path.

4. A refrigerator comprising a mixing tank in which carbon dioxide ($CO_2$) and general water are mixed with each other so that carbonated water is made, and an ice-making machine, the refrigerator further comprising:

an ice-making general water flow path that connects an external water supply source and the ice-making machine so that general water is supplied to the ice-making machine, the ice-making general water flow path being disposed not to pass through the mixing tank;

a carbonated water-making general water flow path that connects the external water supply source and the mixing tank so that general water is supplied to the mixing tank;

an ice-making carbonated water flow path that connects the mixing tank and the ice-making machine so that carbonated water is supplied to the ice-making machine;

a dispenser;

a dispensing general water flow path that connects the external water supply source and the dispenser so that general water is supplied to the dispenser; and a dispensing carbonated water flow path that connects the mixing tank and the dispenser so that carbonated water is supplied to the dispenser, wherein the ice-making general water flow path, the dispensing general water flow path, and the carbonated water-making general water flow path are diverged at a first divergence point, and wherein a four-way valve is disposed at the first divergence point and opens/closes the ice-making general water flow path, the dispensing general water flow path, and the carbonated water-making general water flow path.

5. The refrigerator of claim 4, wherein the ice-making carbonated water flow path and the dispensing carbonated water flow path are diverged at a second divergence point, and a three-way valve is disposed at the second divergence point and opens/closes the ice-making carbonated water flow path and the dispensing carbonated water flow path.

6. A refrigerator comprising a mixing tank in which carbon dioxide ($CO_2$) and general water are mixed with each other so that carbonated water is made, and an ice-making machine, the refrigerator further comprising:

an ice-making general water flow path that connects an external water supply source and the ice-making machine so that general water is supplied to the ice-making machine, the ice-making general water flow path being disposed not to pass through the mixing tank;

a carbonated water-making general water flow path that connects the external water supply source and the mixing tank so that general water is supplied to the mixing tank;

an ice-making carbonated water flow path that connects the mixing tank and the ice-making machine so that carbonated water is supplied to the ice-making machine;

a dispenser;

a dispensing general water flow path that connects the external water supply source and the dispenser so that general water is supplied to the dispenser; and a dispensing carbonated water flow path that connects the mixing tank and the dispenser so that carbonated water is supplied to the dispenser, wherein a first two-way valve is disposed on a common flow path of the ice-making general water flow path, the dispensing general water flow path and the carbonated water-making general water flow path and opens/closes the ice-making general water flow path, the dispensing general water flow path, and the carbonated water-making general water flow path.

7. The refrigerator of claim 6, wherein the ice-making general water flow path and the carbonated water-making general water flow path are diverged at a first divergence point, and a three-way valve is disposed at the first divergence point and opens/closes the ice-making general water flow path and the carbonated water-making general water flow path.

8. The refrigerator of claim 7, wherein the dispensing general water flow path and the dispensing carbonated water flow path join at one join point and form a common flow path, and a second two-way valve is disposed on the common flow path and opens/closes the common flow path.

9. The refrigerator of claim 8, wherein a third two-way valve is disposed on the ice-making carbonated water flow path and opens/closes the ice-making carbonated water flow path.

10. The refrigerator of claim 9, wherein a fourth two-way valve is disposed on the dispensing carbonated water flow path and opens/closes the dispensing carbonated water flow path.

11. A refrigerator comprising:

an ice-making compartment;

an ice-making tray disposed in the ice-making compartment;

a cooling device that supplies cooling energy to the ice-making tray; and a mixing tank in which general water and carbon dioxide ($CO_2$) are mixed so that carbonated water is made, wherein the refrigerator has a general ice-making mode in which general ice is made by supplying general water to the ice-making tray, and a carbonated ice-making mode in which carbonated ice is made by supplying carbonated water to the ice-making tray, and wherein each of the general ice-making mode and the carbonated ice-making mode comprises a water-supplying operation of supplying water to the ice-making tray, an ice-making operation of making ice by cooling the ice-making tray, and an ice-separating operation of separating ice in the ice-making tray from the ice-making tray, and in the water-supplying operation of the general ice-making mode, a first water-supply amount of general water is supplied to the ice-making tray, and in the water-supplying operation of the carbonated ice-making mode, a second water-supply amount of carbonated water that is smaller than the first water-supply amount is supplied to the ice-making tray.

12. The refrigerator of claim 11, wherein the amount of water-supply per unit time in the water-supplying operation of the general ice-making mode and the amount of water-supply per unit time the water-supplying operation of the carbonated ice-making mode are controlled to be different from each other.

13. The refrigerator of claim 11, wherein a time for performing the water-supplying operation of the general ice-making mode and a time for performing the water-supplying operation of the carbonated ice-making mode are controlled to be different from each other.

14. A refrigerator comprising:

an ice-making compartment;

an ice-making tray disposed in the ice-making compartment;

a cooling device that supplies cooling energy to the ice-making tray; and a mixing tank in which general water and carbon dioxide ($CO_2$) are mixed so that carbonated water is made, wherein the refrigerator has a general ice-making mode in which general ice is made by supplying general water to the ice-making tray, and a carbonated ice-making mode in which carbonated ice is made by supplying carbonated water to the ice-making tray, and wherein each of the general ice-making mode and the carbonated ice-making mode comprises an ice-making compartment cooling operation of cooling the ice-making compartment, a water-supplying operation of supplying water to the ice-making tray, an ice-making operation of making ice by cooling the ice-making tray, and an ice-separating operation of separating ice in the ice-making tray from the ice-making tray, and at an initial stage of the ice-making operation of the general ice-making mode, the ice-making compartment has a first ice-making compartment temperature, and at an initial stage of the ice-making operation of the carbonated ice-making mode, the ice-making compartment has a second ice-making compartment temperature that is lower than the first ice-making compartment temperature.

15. The refrigerator of claim 14, wherein the ice-making compartment cooling operation of the general ice-making mode has a first performance time, and the ice-making compartment cooling operation of the carbonated ice-making mode has a second performance time that is longer than the first performance time.

16. A refrigerator comprising:

an ice-making compartment;

an ice-making tray disposed in the ice-making compartment;

a cooling device that supplies cooling energy to the ice-making tray; and a mixing tank in which general water and carbon dioxide ($CO_2$) are mixed so that carbonated water is made, wherein the refrigerator has a general ice-making mode in which general ice is made by supplying general water to the ice-making tray, and a carbonated ice-making mode in which carbonated ice is made by supplying carbonated water to the ice-making tray, and wherein each of the general ice-making mode and the carbonated ice-making mode comprises a water-supplying operation of supplying water to the ice-making tray, an ice-making operation of making ice by cooling the ice-making tray, and an ice-separating operation of separating ice in the ice-making tray from the ice-making tray, and the ice-making operation of the general ice-making mode has a first ice-making speed, and the ice-making operation of the carbonated ice-making mode has a second ice-making speed that is faster than the first ice-making speed.

17. The refrigerator of claim 16, wherein the cooling device comprises a compressor that constitutes a freezing cycle device, and rotation speed of the compressor in the ice-making operation of the general ice-making mode and rotation speed of the compressor in the ice-making operation of the carbonated ice-making mode are controlled to be different from each other.

18. The refrigerator of claim 16, wherein the cooling device comprises a blower fan that allows air to flow in the ice-making compartment, and rotation speed of the blower fan in the ice-making operation of the general ice-making mode and rotation speed of the blower fan in the ice-making operation of the carbonated ice-making mode are controlled to be different from each other.

19. A refrigerator comprising:

a mixing tank in which general water and carbon dioxide ($CO_2$) are mixed so that carbonated water is made;

a dispenser that provides carbonated water made in the mixing tank to an outside; and an ice-making machine that makes carbonated ice by receiving carbonated water from the mixing tank, wherein the refrigerator has a carbonated water mode in which carbonated water is supplied to the dispenser, and a carbonated ice mode in which carbonated water is provided to the ice-making machine, and in a carbon dioxide ($CO_2$) injecting operation of the carbonated water mode, a first injection amount of $CO_2$ is injected into the mixing tank, and in a $CO_2$ injecting operation of the carbonated ice mode, a second injection amount of $CO_2$ that is larger than the first injection amount is injected into the mixing tank.

20. The refrigerator of claim 19, wherein the number of times of injecting $CO_2$ in the $CO_2$ injecting operation of the carbonated water mode and the number of times of injecting $CO_2$ in the $CO_2$ injecting operation of the carbonated ice mode are controlled to be different from each other.

21. The refrigerator of claim 19, wherein an interval for injecting $CO_2$ in the $CO_2$ injecting operation of the carbonated water mode and an interval for injecting $CO_2$ in the $CO_2$ injecting operation of the carbonated ice mode are controlled to be different from each other.

22. The refrigerator of claim 1, wherein the ice-making general water flow path and the ice-making carbonated water flow path join at one join point and form a common flow path.

23. The refrigerator of claim 22, wherein a flow sensor is disposed in each of the ice-making general water flow path and the ice-making carbonated water flow path so that a predetermined amount of general water or carbonated water is supplied to the ice-making machine.

24. The refrigerator of claim 22, wherein a flow sensor is disposed on a common path of the ice-making general water flow path and the ice-making carbonated water flow path so that a predetermined amount of general water or carbonated water is supplied to the ice-making machine.

* * * * *